US008424617B2

(12) United States Patent
Faircloth et al.

(10) Patent No.: US 8,424,617 B2
(45) Date of Patent: Apr. 23, 2013

(54) METHODS AND APPARATUS FOR DELIVERING HIGH POWER LASER ENERGY TO A SURFACE

(75) Inventors: Brian O. Faircloth, Evergreen, CO (US); Mark S. Zediker, Weldon Spring, MO (US); Charles C. Rinzler, Denver, CO (US); Yeshaya Koblick, Sharon, MA (US); Joel F. Moxley, Denver, CO (US)

(73) Assignee: Foro Energy Inc., Littleton, CO (US)

( * ) Notice: Subject to any disclaimer, the term of this patent is extended or adjusted under 35 U.S.C. 154(b) by 95 days.

(21) Appl. No.: 12/544,094

(22) Filed: Aug. 19, 2009

(65) Prior Publication Data

US 2010/0044105 A1 Feb. 25, 2010

Related U.S. Application Data

(60) Provisional application No. 61/090,384, filed on Aug. 20, 2008, provisional application No. 61/102,730, filed on Oct. 3, 2008, provisional application No. 61/106,472, filed on Oct. 17, 2008, provisional application No. 61/153,271, filed on Feb. 17, 2009.

(51) Int. Cl.
*E21B 7/15* (2006.01)

(52) U.S. Cl.
USPC ..... 175/16

(58) Field of Classification Search ..... 175/16
See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |
| 2,742,555 | A | 4/1956 | Murray |
| 3,122,212 | A | 2/1964 | Karlovitz |
| 3,383,491 | A | 5/1968 | Muncheryan |
| 3,461,964 | A | 8/1969 | Venghiattis |
| 3,493,060 | A | 2/1970 | Van Dyk |
| 3,503,804 | A | 3/1970 | Schneider et al. |
| 3,539,221 | A | 11/1970 | Gladstone |
| 3,544,165 | A | 12/1970 | Snedden |
| 3,556,600 | A | 1/1971 | Shoupp et al. |
| 3,574,357 | A | 4/1971 | Alexandru et al. |
| 3,586,413 | A | 6/1971 | Adams |
| 3,652,447 | A | 3/1972 | Yant |
| 3,693,718 | A | 9/1972 | Stout |
| 3,699,649 | A | 10/1972 | McWilliams |

(Continued)

FOREIGN PATENT DOCUMENTS

| | | |
|---|---|---|
| EP | 0295 045 A2 | 12/1988 |
| EP | 0515983 A1 | 12/1992 |

(Continued)

OTHER PUBLICATIONS

International Search Report and Written Opinion for PCT App. No. PCT/US10/24368, dated Nov. 2, 2010, 16 pgs.

(Continued)

*Primary Examiner* — Brad Harcourt

(74) *Attorney, Agent, or Firm* — Glen Belvis; Brinks Hofer Gilson & Lione

(57) ABSTRACT

There is provided a system, apparatus and methods for providing a laser beam to borehole surface in a predetermined and energy deposition profile. The predetermined energy deposition profiles may be uniform or tailored to specific downhole applications. Optic assemblies for obtaining these predetermined energy deposition profiles are further provided.

157 Claims, 28 Drawing Sheets

U.S. PATENT DOCUMENTS

| | | | |
|---|---|---|---|
| 3,802,203 | A | 4/1974 | Ichise et al. |
| 3,820,605 | A | 6/1974 | Barber et al. |
| 3,821,510 | A | 6/1974 | Muncheryan |
| 3,823,788 | A | 7/1974 | Garrison et al. |
| 3,871,485 | A | 3/1975 | Keenan, Jr. |
| 3,882,945 | A | 5/1975 | Keenan, Jr. |
| 3,938,599 | A | 2/1976 | Horn |
| 3,960,448 | A | 6/1976 | Schmidt et al. |
| 3,977,478 | A | 8/1976 | Shuck |
| 3,992,095 | A | 11/1976 | Jacoby et al. |
| 3,998,281 | A | 12/1976 | Salisbury et al. |
| 4,019,331 | A | 4/1977 | Rom et al. |
| 4,025,091 | A | 5/1977 | Zeile, Jr. |
| 4,026,356 | A | 5/1977 | Shuck |
| 4,047,580 | A | 9/1977 | Yahiro et al. |
| 4,057,118 | A | 11/1977 | Ford |
| 4,061,190 | A | 12/1977 | Bloomfield |
| 4,066,138 | A | 1/1978 | Salisbury et al. |
| 4,090,572 | A | 5/1978 | Welch |
| 4,113,036 | A | 9/1978 | Stout |
| 4,125,757 | A | 11/1978 | Ross |
| 4,151,393 | A | 4/1979 | Fenneman et al. |
| 4,162,400 | A | 7/1979 | Pitts, Jr. |
| 4,189,705 | A | 2/1980 | Pitts, Jr. |
| 4,194,536 | A | 3/1980 | Stine et al. |
| 4,199,034 | A | 4/1980 | Salisbury et al. |
| 4,227,582 | A | 10/1980 | Price |
| 4,228,856 | A | 10/1980 | Reale |
| 4,243,298 | A | 1/1981 | Kao et al. |
| 4,249,925 | A | 2/1981 | Kawashima et al. |
| 4,252,015 | A | 2/1981 | Harbon et al. |
| 4,256,146 | A | 3/1981 | Genini et al. |
| 4,266,609 | A | 5/1981 | Rom et al. |
| 4,280,535 | A | 7/1981 | Willis |
| 4,281,891 | A | 8/1981 | Shinohara et al. |
| 4,282,940 | A | 8/1981 | Salisbury et al. |
| 4,332,401 | A | 6/1982 | Stephenson et al. |
| 4,336,415 | A | 6/1982 | Walling |
| 4,340,245 | A | 7/1982 | Stalder |
| 4,367,917 | A | 1/1983 | Gray |
| 4,370,886 | A | 2/1983 | Smith, Jr. et al. |
| 4,374,530 | A | 2/1983 | Walling |
| 4,375,164 | A | 3/1983 | Dodge et al. |
| 4,389,645 | A | 6/1983 | Wharton |
| 4,415,184 | A | 11/1983 | Stephenson et al. |
| 4,417,603 | A | 11/1983 | Argy |
| 4,436,177 | A | 3/1984 | Elliston |
| 4,444,420 | A | 4/1984 | McStravick et al. |
| 4,453,570 | A | 6/1984 | Hutchison |
| 4,459,731 | A | 7/1984 | Hutchison |
| 4,477,106 | A | 10/1984 | Hutchison |
| 4,504,112 | A | 3/1985 | Gould et al. |
| 4,522,464 | A | 6/1985 | Thompson et al. |
| 4,531,552 | A | 7/1985 | Kim |
| 4,565,351 | A | 1/1986 | Conti et al. |
| 4,662,437 | A | 5/1987 | Renfro |
| 4,694,865 | A | 9/1987 | Tauschmann |
| 4,725,116 | A | 2/1988 | Spencer et al. |
| 4,741,405 | A | 5/1988 | Moeny et al. |
| 4,744,420 | A | 5/1988 | Patterson et al. |
| 4,770,493 | A | 9/1988 | Ara et al. |
| 4,793,383 | A | 12/1988 | Gyory et al. |
| 4,830,113 | A | 5/1989 | Geyer |
| 4,860,654 | A | 8/1989 | Chawla et al. |
| 4,860,655 | A | 8/1989 | Chawla |
| 4,872,520 | A | 10/1989 | Nelson |
| 4,924,870 | A | 5/1990 | Wlodarczyk et al. |
| 4,952,771 | A | 8/1990 | Wrobel |
| 4,989,236 | A | 1/1991 | Myllymäki |
| 4,997,250 | A | 3/1991 | Ortiz, Jr. |
| 5,003,144 | A | 3/1991 | Lindroth et al. |
| 5,004,166 | A | 4/1991 | Sellar |
| 5,033,545 | A | 7/1991 | Sudol |
| 5,049,738 | A | 9/1991 | Gergely et al. |
| 5,084,617 | A | 1/1992 | Gergely |
| 5,086,842 | A | 2/1992 | Cholet |
| 5,107,936 | A | 4/1992 | Foppe |
| 5,121,872 | A | 6/1992 | Legget |
| 5,125,061 | A | 6/1992 | Marlier et al. |
| 5,125,063 | A | 6/1992 | Panuska et al. |
| 5,128,882 | A | 7/1992 | Cooper et al. |
| 5,140,664 | A | 8/1992 | Bosisio et al. |
| 5,163,321 | A | 11/1992 | Perales |
| 5,168,940 | A | 12/1992 | Foppe |
| 5,172,112 | A | 12/1992 | Jennings |
| 5,212,755 | A | 5/1993 | Holmberg |
| 5,269,377 | A | 12/1993 | Martin |
| 5,285,204 | A | 2/1994 | Sas-Jaworsky |
| 5,348,097 | A | 9/1994 | Giannesini et al. |
| 5,351,533 | A | 10/1994 | Macadam et al. |
| 5,353,875 | A | 10/1994 | Schultz et al. |
| 5,355,967 | A | 10/1994 | Mueller et al. |
| 5,356,081 | A | 10/1994 | Sellar |
| 5,396,805 | A | 3/1995 | Surjaatmadja |
| 5,411,081 | A | 5/1995 | Moore et al. |
| 5,411,085 | A | 5/1995 | Moore et al. |
| 5,411,105 | A | 5/1995 | Gray |
| 5,413,045 | A | 5/1995 | Miszewski |
| 5,413,170 | A | 5/1995 | Moore |
| 5,419,188 | A | 5/1995 | Rademaker et al. |
| 5,423,383 | A | 6/1995 | Pringle |
| 5,425,420 | A | 6/1995 | Pringle |
| 5,435,351 | A | 7/1995 | Head |
| 5,435,395 | A | 7/1995 | Connell |
| 5,463,711 | A | 10/1995 | Chu |
| 5,465,793 | A | 11/1995 | Pringle |
| 5,469,878 | A | 11/1995 | Pringle |
| 5,479,860 | A | 1/1996 | Ellis |
| 5,483,988 | A | 1/1996 | Pringle |
| 5,488,992 | A | 2/1996 | Pringle |
| 5,500,768 | A | 3/1996 | Doggett et al. |
| 5,503,014 | A | 4/1996 | Griffith |
| 5,503,370 | A | 4/1996 | Newman et al. |
| 5,505,259 | A | 4/1996 | Wittrisch et al. |
| 5,515,926 | A | 5/1996 | Boychuk |
| 5,526,887 | A | 6/1996 | Vestavik |
| 5,561,516 | A | 10/1996 | Noble et al. |
| 5,566,764 | A | 10/1996 | Elliston |
| 5,573,225 | A | 11/1996 | Boyle et al. |
| 5,577,560 | A | 11/1996 | Coronado et al. |
| 5,586,609 | A | 12/1996 | Schuh |
| 5,599,004 | A | 2/1997 | Newman et al. |
| 5,615,052 | A | 3/1997 | Doggett |
| 5,638,904 | A | 6/1997 | Misselbrook et al. |
| 5,655,745 | A | 8/1997 | Morrill |
| 5,694,408 | A | 12/1997 | Bott et al. |
| 5,707,939 | A | 1/1998 | Patel |
| 5,757,484 | A | 5/1998 | Miles et al. |
| 5,759,859 | A | 6/1998 | Sausa |
| 5,771,984 | A | 6/1998 | Potter et al. |
| 5,773,791 | A | 6/1998 | Kuykendal |
| 5,794,703 | A | 8/1998 | Newman et al. |
| 5,813,465 | A | 9/1998 | Terrell et al. |
| 5,828,003 | A | 10/1998 | Thomeer et al. |
| 5,832,006 | A | 11/1998 | Rice et al. |
| 5,833,003 | A | 11/1998 | Longbottom et al. |
| 5,847,825 | A | 12/1998 | Alexander |
| 5,862,273 | A | 1/1999 | Pelletier |
| 5,862,862 | A | 1/1999 | Terrell |
| 5,896,482 | A | 4/1999 | Blee et al. |
| 5,896,938 | A | 4/1999 | Moeny et al. |
| 5,902,499 | A | 5/1999 | Richerzhagen |
| 5,909,306 | A | 6/1999 | Goldberg et al. |
| 5,913,337 | A | 6/1999 | Williams et al. |
| 5,924,489 | A | 7/1999 | Hatcher |
| 5,929,986 | A | 7/1999 | Slater et al. |
| 5,933,945 | A | 8/1999 | Thomeer et al. |
| 5,938,954 | A | 8/1999 | Onuma et al. |
| 5,973,783 | A | 10/1999 | Goldner et al. |
| 5,986,756 | A | 11/1999 | Slater et al. |
| RE36,525 | E | 1/2000 | Pringle |
| 6,015,015 | A | 1/2000 | Luft et al. |
| 6,038,363 | A | 3/2000 | Slater et al. |
| 6,059,037 | A | 5/2000 | Longbottom et al. |
| 6,060,662 | A | 5/2000 | Rafie et al. |
| 6,065,540 | A | 5/2000 | Thomeer et al. |
| RE36,723 | E | 6/2000 | Moore et al. |

6,076,602 A 6/2000 Gano et al.
6,092,601 A 7/2000 Gano et al.
6,104,022 A 8/2000 Young et al.
RE36,880 E 9/2000 Pringle
6,116,344 A 9/2000 Longbottom et al.
6,135,206 A 10/2000 Gano et al.
6,147,754 A 11/2000 Theriault et al.
6,157,893 A 12/2000 Berger et al.
6,166,546 A 12/2000 Scheihing et al.
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,275,645 B1 8/2001 Vereecken et al.
6,281,489 B1 8/2001 Tubel et al.
6,301,423 B1 10/2001 Olson
6,309,195 B1 10/2001 Bottos et al.
6,321,839 B1 11/2001 Vereecken et al.
6,352,114 B1 3/2002 Toalson et al.
6,355,928 B1 3/2002 Skinner et al.
6,356,683 B1 3/2002 Hu et al.
6,377,591 B1 4/2002 Hollister et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,494,259 B2 12/2002 Surjaatmadja
6,497,290 B1 12/2002 Misselbrook et al.
6,557,249 B1 5/2003 Pruett et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,661,815 B1 12/2003 Kozlovsky et al.
6,710,720 B2 3/2004 Carstensen et al.
6,712,150 B1 3/2004 Misselbrook et al.
6,725,924 B2 4/2004 Davidson et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,923,273 B2 8/2005 Terry et al.
6,957,576 B2 10/2005 Skinner et al.
6,967,322 B2 11/2005 Jones et al.
6,977,367 B2 12/2005 Tubel et al.
6,978,832 B2 12/2005 Gardner et al.
6,981,561 B2 1/2006 Krueger et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,484 B2 8/2006 Smith, Jr.
7,087,865 B2 8/2006 Lerner
7,088,437 B2 8/2006 Blomster et al.
7,126,332 B2 10/2006 Blanz et al.
7,134,488 B2 11/2006 Tudor et al.
7,134,514 B2 11/2006 Riel et al.
7,140,435 B2 11/2006 Defretin et al.
7,147,064 B2 12/2006 Batarseh et al.
7,152,700 B2 12/2006 Church et al.
7,163,875 B2 1/2007 Richerzhagen
7,172,026 B2 2/2007 Misselbrook
7,172,038 B2 2/2007 Terry et al.
7,174,067 B2 2/2007 Murshid et al.
7,188,687 B2 3/2007 Rudd et al.
7,195,731 B2 3/2007 Jones
7,196,786 B2 3/2007 DiFoggio
7,199,869 B2 4/2007 MacDougall
7,201,222 B2 4/2007 Kanady et al.
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,372,230 B2 5/2008 McKay
7,394,064 B2 7/2008 Marsh
7,395,696 B2 7/2008 Bissonnette et al.
7,416,032 B2 8/2008 Moeny et al.
7,416,258 B2 8/2008 Reed et al.
7,424,190 B2 9/2008 Dowd et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,515,782 B2 4/2009 Zhang et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 de Montmorillon et al.
7,600,564 B2 10/2009 Shampine et al.
7,603,011 B2 10/2009 Varkey et al.
7,617,873 B2 11/2009 Lovell et al.
7,624,743 B2 12/2009 Sarkar et al.
7,628,227 B2 12/2009 Marsh
7,646,953 B2 1/2010 Dowd et al.
7,647,948 B2 1/2010 Quigley et al.
7,671,983 B2 3/2010 Shammai et al.
7,715,664 B1 5/2010 Shou et al.
7,720,323 B2 5/2010 Yamate et al.
7,769,260 B2 8/2010 Hansen et al.
7,802,384 B2 9/2010 Kobayashi et al.
7,834,777 B2 11/2010 Gold
7,848,368 B2 12/2010 Gapontsev et al.
7,900,699 B2 3/2011 Ramos et al.
7,938,175 B2 5/2011 Skinner et al.
8,011,454 B2 9/2011 Castillo
8,074,332 B2 12/2011 Keatch et al.
8,082,996 B2 12/2011 Kocis et al.
8,091,638 B2 1/2012 Dusterhoft et al.
8,109,345 B2 2/2012 Jeffryes
8,175,433 B2 5/2012 Caldwell et al.
2002/0007945 A1 1/2002 Neuroth et al.
2002/0039465 A1 4/2002 Skinner
2002/0189806 A1 12/2002 Davidson et al.
2003/0000741 A1 1/2003 Rosa
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0145991 A1 8/2003 Olsen
2003/0159283 A1 8/2003 White
2003/0160164 A1 8/2003 Jones et al.
2003/0226826 A1 12/2003 Kobayashi et al.
2004/0006429 A1 1/2004 Brown
2004/0016295 A1 1/2004 Skinner et al.
2004/0020643 A1 2/2004 Thomeer et al.
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.

2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0137875 A1 6/2006 Dusterhoft et al.
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith, Jr.
2008/0073077 A1 3/2008 Tunc et al.
2008/0093125 A1 4/2008 Potter et al.
2008/0112760 A1 5/2008 Curlett
2008/0128123 A1 6/2008 Gold
2008/0138022 A1 6/2008 Tassone
2008/0165356 A1 7/2008 DiFoggio et al.
2008/0166132 A1 7/2008 Lynde et al.
2008/0180787 A1 7/2008 DiGiovanni et al.
2008/0245568 A1 10/2008 Jeffryes
2008/0273852 A1 11/2008 Parker et al.
2009/0020333 A1 1/2009 Marsh
2009/0031870 A1 2/2009 O'Connor
2009/0033176 A1 2/2009 Huang et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0190887 A1 7/2009 Freeland et al.
2009/0194292 A1 8/2009 Oglesby
2009/0205675 A1 8/2009 Sarkar et al.
2009/0260834 A1 10/2009 Henson et al.
2009/0266552 A1 10/2009 Barra et al.
2009/0266562 A1 10/2009 Greenaway
2009/0272424 A1 11/2009 Ortabasi
2009/0272547 A1 11/2009 Dale et al.
2009/0279835 A1 11/2009 de Montmorillon et al.
2009/0294050 A1 12/2009 Traggis et al.
2009/0308852 A1 12/2009 Alpay et al.
2009/0324183 A1 12/2009 Bringuier et al.
2010/0000790 A1 1/2010 Moeny
2010/0001179 A1 1/2010 Kobayashi et al.
2010/0008631 A1 1/2010 Herbst
2010/0013663 A1 1/2010 Cavender et al.
2010/0018703 A1 1/2010 Lovell et al.
2010/0025032 A1 2/2010 Smith et al.
2010/0032207 A1 2/2010 Potter et al.
2010/0044102 A1 2/2010 Rinzler et al.
2010/0044103 A1 2/2010 Moxley et al.
2010/0044104 A1 2/2010 Zediker et al.
2010/0044105 A1 2/2010 Faircloth et al.
2010/0044106 A1 2/2010 Zediker et al.
2010/0071794 A1 3/2010 Homan
2010/0078414 A1 4/2010 Perry et al.
2010/0084132 A1 4/2010 Noya et al.
2010/0089571 A1 4/2010 Revellat et al.
2010/0089574 A1 4/2010 Wideman et al.
2010/0089576 A1 4/2010 Wideman et al.
2010/0089577 A1 4/2010 Wideman et al.
2010/0155059 A1 6/2010 Ullah
2010/0170672 A1 7/2010 Schwoebel et al.
2010/0170680 A1 7/2010 McGregor et al.
2010/0187010 A1 7/2010 Abbasi et al.
2010/0197116 A1 8/2010 Shah et al.
2010/0218993 A1 9/2010 Wideman et al.
2010/0224408 A1 9/2010 Kocis et al.
2010/0226135 A1 9/2010 Chen
2010/0236785 A1 9/2010 Collis et al.
2010/0326659 A1 12/2010 Schultz et al.
2010/0326665 A1 12/2010 Redlinger et al.
2011/0030957 A1 2/2011 Constantz et al.
2011/0035154 A1 2/2011 Kendall et al.
2011/0048743 A1 3/2011 Stafford et al.
2011/0061869 A1 3/2011 Abass et al.
2011/0079437 A1 4/2011 Hopkins et al.
2011/0127028 A1 6/2011 Strickland
2011/0139450 A1 6/2011 Vasques et al.
2011/0147013 A1 6/2011 Kilgore
2011/0162854 A1 7/2011 Bailey et al.
2011/0168443 A1 7/2011 Smolka
2011/0174537 A1 7/2011 Potter et al.
2011/0186298 A1 8/2011 Clark et al.
2011/0198075 A1 8/2011 Okada et al.
2011/0205652 A1 8/2011 Abbasi et al.
2011/0220409 A1 9/2011 Foppe
2011/0240314 A1 10/2011 Greenaway
2011/0266062 A1 11/2011 Shuman, V et al.
2011/0278070 A1 11/2011 Hopkins et al.
2011/0290563 A1 12/2011 Kocis et al.
2011/0303460 A1 12/2011 Von Rohr et al.
2012/0000646 A1 1/2012 Liotta et al.
2012/0012392 A1 1/2012 Kumar
2012/0012393 A1 1/2012 Kumar
2012/0020631 A1 1/2012 Rinzler et al.
2012/0048550 A1 3/2012 Dusterhoft et al.
2012/0048568 A1 3/2012 Li et al.
2012/0061091 A1 3/2012 Radi
2012/0067643 A1 3/2012 DeWitt et al.
2012/0068086 A1 3/2012 DeWitt et al.
2012/0068523 A1 3/2012 Bowles
2012/0074110 A1 3/2012 Zediker et al.
2012/0103693 A1 5/2012 Jeffryes
2012/0111578 A1 5/2012 Tverlid
2012/0118568 A1 5/2012 Kleefisch et al.
2012/0118578 A1 5/2012 Skinner
2012/0217015 A1 8/2012 Zediker et al.
2012/0217017 A1 8/2012 Zediker et al.

| | | | |
|---|---|---|---|
| 2012/0217018 | A1 | 8/2012 | Zediker et al. |
| 2012/0217019 | A1 | 8/2012 | Zediker et al. |
| 2012/0248078 | A1 | 10/2012 | Zediker et al. |
| 2012/0255774 | A1 | 10/2012 | Grubb et al. |
| 2012/0255933 | A1 | 10/2012 | Mckay et al. |
| 2012/0261188 | A1 | 10/2012 | Zediker et al. |
| 2012/0266803 | A1 | 10/2012 | Zediker et al. |
| 2012/0267168 | A1 | 10/2012 | Grubb et al. |
| 2012/0273269 | A1 | 11/2012 | Rinzler et al. |
| 2012/0273470 | A1 | 11/2012 | Zediker et al. |
| 2012/0275159 | A1 | 11/2012 | Fraze et al. |

FOREIGN PATENT DOCUMENTS

| | | | |
|---|---|---|---|
| EP | 0 565 287 | A1 | 10/1993 |
| EP | 0 950 170 | B1 | 9/2002 |
| FR | 2 716 924 | | 9/1995 |
| GB | 1 284 454 | | 8/1972 |
| GB | 2420358 | B | 5/2006 |
| JP | 09072738 | A | 3/1997 |
| JP | 09-242453 | A | 9/1997 |
| JP | 2000-334590 | A | 12/2000 |
| JP | 2004-108132 | A | 4/2004 |
| JP | 2006-307481 | A | 11/2006 |
| JP | 2007-120048 | A | 5/2007 |
| WO | WO 95/32834 | A1 | 12/1995 |
| WO | WO 97/49893 | A1 | 12/1997 |
| WO | WO 98/50673 | A1 | 11/1998 |
| WO | WO 98/56534 | A1 | 12/1998 |
| WO | WO 02/057805 | A2 | 7/2002 |
| WO | WO 03/027433 | A1 | 4/2003 |
| WO | WO 03/060286 | A1 | 7/2003 |
| WO | WO 2004/009958 | A1 | 1/2004 |
| WO | WO 2004/094786 | A1 | 11/2004 |
| WO | WO 2005/001232 | A2 | 1/2005 |
| WO | WO 2005/001239 | A1 | 1/2005 |
| WO | WO 2006/008155 | A1 | 1/2006 |
| WO | WO 2006/041565 | A1 | 4/2006 |
| WO | WO 2006/054079 | A1 | 5/2006 |
| WO | WO 2007/002064 | A1 | 1/2007 |
| WO | WO 2007/112387 | A2 | 10/2007 |
| WO | WO 2007/136485 | A2 | 11/2007 |
| WO | WO 2008/016852 | A1 | 2/2008 |
| WO | WO 2008/070509 | A2 | 6/2008 |
| WO | WO 2008/085675 | A1 | 7/2008 |
| WO | WO 2009/042774 | A2 | 4/2009 |
| WO | WO 2009/042781 | A2 | 4/2009 |
| WO | WO 2009/042785 | A2 | 4/2009 |
| WO | WO 2009/131584 | A1 | 10/2009 |
| WO | WO 2010/036318 | A1 | 4/2010 |
| WO | WO 2010/060177 | A1 | 6/2010 |
| WO | WO 2010/087944 | A1 | 8/2010 |
| WO | WO 2011/008544 | A2 | 1/2011 |
| WO | WO 2011/032083 | A1 | 3/2011 |
| WO | WO 2011/041390 | A2 | 4/2011 |
| WO | WO 2011/075247 | A2 | 6/2011 |
| WO | WO 2011/106078 | A2 | 9/2011 |
| WO | WO 2012/003146 | A2 | 1/2012 |
| WO | WO 2012/012006 | A1 | 1/2012 |
| WO | WO 2012/027699 | A1 | 3/2012 |
| WO | WO 2012/064356 | A1 | 5/2012 |
| WO | WO 2012/116189 | A2 | 8/2012 |

OTHER PUBLICATIONS

Agrawal, Govind P., "Nonlinear Fiber Optics", Chap. 9, Fourth Edition, Academic Press copyright 2007, pp. 334-337.

Damzen, M. J. et al., "Stimulated Brillion Scattering", Chapter 8—SBS in Optical Fibres, OP Publishing Ltd, Published by Institute of Physics, London, England, 2003, pp. 137-153.

Eichler, H.J. et al., "Stimulated Brillouin Scattering in Multimode Fibers for Optical Phase Conjugation", *Optics Communications*, vol. 208, 2002, pp. 427-431.

Kubacki, Emily et al., "Optics for Fiber Laser Applications", *CVI Laser, LLC*, Technical Reference Document #20050415, 2005, 5 pgs.

Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.

McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.

Mocofanescu, A. et al., "SBS threshold for single mode and multimode GRIN fibers in an all fiber configuration", *Optics Express*, vol. 13, No. 6, 2005, pp. 2019-2024.

Shannon, G. J. et al., "High power laser welding in hyperbaric gas and water environments", *Journal of Laser Applications*, vol. 9, 1997, pp. 129-136.

U.S. Appl. No. 12/706,576, filed Feb. 16, 2010, 28 pgs.

U.S. Appl. No. 12/840,978, filed Jul. 21, 2009, 61 pgs.

Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.

Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.

Agrawal Dinesh et al., "Microstructural by TEM of WC/Co composites Prepared by Conventional and Microwave Processes", Materials Research Lab, The Pennsylvania State University, *15th International Plansee Seminar*, vol. 2 2001, pp. 677-684.

Ai, H.A. et al., "Simulation of dynamic response of granite: A numerical approach of shock-induced damage beneath impact craters", *International Journal of Impact Engineering*, vol. 33, 2006, pp. 1-10.

Anton, Richard J. et al., "Dynamic Vickers indentation of brittle materials", *Wear*, vol. 239, 2000, pp. 27-35.

Ashby, M. F. et al., "The Failure of Brittle Solids Containing Small Cracks Under Compressive Stress States", *Acta Metall.*, vol. 34, No. 3,1986, pp. 497-510.

Aydin, A. et al., "The Schmidt hammer in rock material characterization", *Engineering Geology*, vol. 81, 2005, pp. 1-14.

Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.

Bailo, El Tahir et al., "Spectral signatures and optic coefficients of surface and reservoir shales and limestones at COIL, $CO_2$ and Nd:YAG laser wavelengths", *Petroleum Engineering Department, Colorado School of Mines*, 2004, 13 pgs.

Baird, J. A. "GEODYN: A Geological Formation/Drillstring Dynamics Computer Program", *Society of Petroleum Engineers of AIME*, 1964, 9 pgs.

Baird, Jerold et al., Phase 1 Theoretical Description, A Geological Formation Drill String Dynamic Interaction Finite Element Program (GEODYN), *Sandia National Laboratories*, Report No. Sand-84-7101, 1984, 196 pgs.

Batarseh, S. et al. "Well Perforation Using High-Power Lasers", *Society of Petroleum Engineers*, SPE 84418, 2003, pp. 1-10.

BDM Corporation, Geothermal Completion Technology Life-Cycle Cost Model (GEOCOM), *Sandia National Laboratories*, for the U.S. Dept. of Energy, vols. 1 and 2, 1982, 222 pgs.

Beste, U. et al., "Micro-scratch evaluation of rock types-a means to comprehend rock drill wear", *Tribology International*, vol. 37, 2004, pp. 203-210.

Blackwell, B. F., "Temperature Profile in Semi-infinite Body With Exponential Source and Convective Boundary Condition", *Journal of Heat Transfer, Transactions of the ASME*, vol. 112, 1990, pp. 567-571.

Britz, Dieter, "Digital Simulation in Electrochemistry", *Lect. Notes Phys.*, vol. 666, 2005, pp. 103-117.

Browning, J. A. et al., "Recent Advances in Flame Jet Working of Minerals", *7th Symposium on Rock Mechanics*, Pennsylvania State Univ., 1965, pp. 281-313.

Cardenas, R., "Protected Polycrystalline Diamond Compact Bits for Hard Rock Drilling", Report No. DOE-99049-1381, *U.S. Department of Energy*, 2000, pp. 1-79.

Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Das, A. C. et al., "Acousto-ultrasonic study of thermal shock damage in castable refractory", *Journal of Materials Science Letters*, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", *Geothermal Research Division, Sandia National Laboratories*, 1987, pp. 1-6.
Eighmy, T. T. et al., "Microfracture Surface Charaterizations: Implications for In Situ Remedial Methods in Fractured Rock", *Bedrock Bioremediation Center, Final Report, National Risk Management Research Laboratory, Office of Research and Development, U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept., University of Southwestern Louisiana and Sandia National Laboratories*, 2000, pp. 1-10.
Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", *Gas Technology Institute, Colorado School of Mines, Halliburton Energy Services, Argonne National Laboratory*, 2002, pp. 1-13.
Finger, John T. et al., "PDC Bit Research at Sandia National Laboratories", *Sandia Report, Geothermal Research Division 6252, Sandia National Laboratories*, SAND89-0079-UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, B. C. et al., "Laser Drilling: Determination of Energy Required to Remove Rock", *Society of Petroleum Engineers International*, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", *Geothermal Technology Development Division 6241*, Sandia National Laboratories, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-Uc-66c, 1987, pp. 1-206.
Glowka, David A. et al., "Program Plan for the Development of Advanced Synthetic-Diamond Drill Bits for Hard-Rock Drilling", *Sandia National Laboratories*, SAND 93-1953, 1993, pp. 1-50.
Glowka, David A. et al., "Progress in the Advanced Synthetic-Diamond Drill Bit Program", *Sandia National Laboratories*, SAND95-2617C, 1994, pp. 1-9.
Glowka, David A., "The Use of Single—Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department, Colorado School of Mines*, 2001, pp. 1-157.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, 242 pgs.
Hareland, G. et al., "Cutting Efficiency of a Single PDC Cutter on Hard Rock", *Journal of Canadian Petroleum Technology*, vol. 48, No. 6, 2009, pp. 1-6.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for The United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Huff, C. F. et al., "Recent Developments in Polycrystalline Diamond-Drill-Bit Design", *Drilling Technology Division—4741, Sandia National Laboratories*, 1980, pp. 1-29.
Jimeno, Carlos Lopez et al., Drilling and Blasting of Rocks, *a. a. Balkema* Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.
Kelsey, James R., "Drilling Technology/GDO", *Sandia National Laboratories*, SAND-85-1866c, DE85 017231, 1985, pp. 1-7.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.

Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
Marshall, David B. et al., "Indentation of Brittle Materials", *Microindentation Techniques in Materials Science and Engineering, ASTM STP 889; American Society for Testing and Materials*, 1986, pp. 26-46.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement* (Tébessa), vol. 14, 2009, pp. 1-8.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/ Society of Petroleum Engineers Inc.*, 1996, pp. 379-389.
Palashchenko, Yuri A., "Pure Rolling of Bit Cones Doubles Performance", *I & Gas Journal*, vol. 106, 2008, 8 pgs.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Pavlina, E. J. et al., "Correlation of Yield Strength and Tensile Strength with Hardness for Steels", *Journals of Materials Engineering and Performance*, vol. 17, No. 6, 2008, pp. 888-893.
Ping, Cao et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert (ed.)*, VGE, 2004, pp. 1-6.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Pooniwala, Shahvir, "Lasers: The Next Bit", *Society of Petroleum Engineers*, No. SPE 104223, 2006, 10 pgs.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*, vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.
Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Raymond, David W., "PDC Bit Testing At Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.

Sachpazis, C. I, M. Sc., Ph. D., "Correlating Schmidt Hardness With Compressive Strength and Young's Modulus of Carbonate Rocks", *International Association of Engineering Geology*, Bulletin, No. 42, 1990, pp. 75-83.
Sano, Osam et al., "Acoustic Emission During Slow Crack Growth", *Department Mining and Mineral Engineering, NII-Electronic Library Service*, 1980, pp. 381-388.
Schormair, Nik et al., "The influence of anisotropy on hard rock drilling and cutting", *The Geological Society of London, IAEG*, Paper No. 491, 2006, pp. 1-11.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", *Sandia National Laboratories*, SAND-85-0633C, 1985, pp. 1-20.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters C and *m* of Paris' Law for Fatigue Crack Growth", *Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
U.S. Dept of Energy, "Chapter 6—Drilling Technology and Costs", from Report for the Future of Geothermal Energy, 2005, 53 pgs.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol*., vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling", *Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", *Moscow Mining Institute*. (*Translated from Fiziko-Tekhnicheskie Problemy Razrabotki Poleznykh Iskopaemykh*), 1985, pp. 363-366.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt a PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
International Search Report for PCT Application No. PCT/US09/54295, dated Apr. 26, 2010, 16 pgs. Brochures.
A Built-for-Purpose Coiled Tubing Rig, by Schulunnberger Wells,No. DE-PS26-03NT15474, 2006, 1 pg.
Diamond-Cutter Drill Bits, by Geothermal Energy Program, Office of Geothermal and Wind Technologies, 2000, 2 pgs.
Extreme Coil Drilling, by Extreme Drilling Corporation, 2009, 10 pgs.
IADC Dull Grading System for Fixed Cutter Bits, by Hughes Christensen, 1996, 14 pgs.
Percussion Drilling Manual, by Smith Tools, 2002, 67 pgs.
Simple Drilling Methods, WEDC Loughborough University, United Kingdom, 1995, 4 pgs.
International Search Report for PCT Application No. PCT/US2011/044548, dated Jan. 24, 2012, 17 pgs.
International Search Report for PCT Application No. PCT/US2011/047902, dated Jan. 17, 2012, 9 pgs.
International Search Report for PCT Application No. PCT/US2011/050044, dated Feb. 1, 2012, 26 pgs.
International Search Report for PCT Application No. PCT/US2012/026277, dated May 30, 2012, 11 pgs.
International Search Report for PCT Application No. PCT/US2012/026265, dated May 30, 2012, 14 pgs.

International Search Report for PCT Application No. PCT/US2012/026280, dated May 30, 2012, 12 pgs.
International Search Report for PCT Application No. PCT/US2012/026471, dated May 30, 2012, 13 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
International Search Report for PCT Application No. PCT/US2012/026494, dated May 31, 2012, 12 pgs.
International Search Report for PCT Application No. PCT/US2012/026337, dated Jun. 7, 2012, 21 pgs.
International Search Report for PCT Application No. PCT/US2012/020789, dated Jun. 29, 2012, 9 pgs.
International Search Report for PCT Application No. PCT/US2012/040490, dated Oct. 22, 2012, 14 pgs.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Langeveld, C. J., "PDC Bit Dynamics", a paper prepared for presentation at the 1992 IADC/SPE Drilling Conference, Feb. 1992, pp. 227-241.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42 , 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H., "Modeling Laser Beam-Rock Interaction", a report prepared for US Department of Energy (http://www.doe.gov/bridge), 8 pages.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16., 2001, pp. 107-114.
Liddle, D. et al., "Cross Sector Decommissioning Workshop", presentation, Mar. 23, 2011, 14 pages.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "Continuous Damage Model for Load-Response Estimation of Concrete", *Cement and Concrete Research*, vol. 10, 1980, pp. 395-402.
Lorenzana, H. E. et al., "Metastability of Molecular Phases of Nitrogen: Implications to the Phase Diagram", a manuscript submitted to the European Hight Pressure Research Group 39 Conference, *Advances on High Pressure*, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.
Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for Continuous Steam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of Porous Sandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Martin, C. D., "Seventeenth Canadian Geotechnical Colloquium: The Effect of Cohesion Loss and Stress Path on Brittle Rock Strength", *Canadian Geotechnical Journal*, vol. 34, 1997, pp. 698-725.
Martins, A. et al., "Modeling of Bend Losses in Single-Mode Optical Fibers", Institutu de Telecomunicacoes, Portugal, 3 pages.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly Heterogeneous Applications", a paper prepared for the 2004 SPE (Society of Petroleum Engineers) Eastern Regional Meeting, Sep. 2004, pp. 1-14.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the US Department of Transportation under Contract C-85-65, May 1968, 91 pages.
Montross, C. S. et al., "Laser-Induced Shock Wave Generation and Shock Wave Enhancement in Basalt", *International Journal of Rock Mechanics and Mining Sciences*, 1999, pp. 849-855.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.
Mostafa, M. S. et al., "Investigation of Thermal Properties of Some Basalt Samples in Egypt", *Journal of Thermal Analysis and Calorimetry*, vol. 75, 2004, pp. 178-188.

Mukhin, I. B. et al., "Experimental Study of Kilowatt-Average-Power Faraday Isolators", *OSA/ASSP*, 2007, 3 pages.
Multari, R. A. et al., "Effect of Sampling Geometry on Elemental Emissions in Laser-Induced Breakdown Spectroscopy", *Applied Spectroscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.
Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Nara, Y. et al., "Study of Subcritical Crack Growth in Andesite Using the Double Torsion Test", *International Journal of Rock Mechanics & Mining Sciences*, vol. 42, 2005, pp. 521-530.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for The American Association of Petroleum Geologists Bulletin, vol. 73, No. 6, Jun. 1989, pp. 792-793.
Oglesby, K. et al., "Advanced Ultra High Speed Motor for Drilling", a project update by Impact Technologies LLC for the US Department of Energy, Sep. 12, 2005, 36 pages.
Olsen, F. O., "Fundamental Mechanisms of Cutting Front Formation in Laser Cutting", *SPIE*, vol. 2207, pp. 402-413.
Ouyang, L. B. et al., "General Single Phase Wellbore Flow Model", a report prepared for the US COE/PETC, May 2, 1997, 51 pages.
Palchaev, D. K. et al., "Thermal Expansion of Silicon Carbide Materials", *Journal of Engineering Physics and Thermophysics*, vol. 66, No. 6, 1994, 3 pages.
Parker, R. et al., "Drilling Large Diameter Holes in Rocks Using Multiple Laser Beams (504)", while the date of the publication is unknown, it is believed to be prior to Aug. 19, 2009, 6 pages.
Patricio, M. et al., "Crack Propagation Analysis", while the date of the publication is unknown, it is believed to be prior to Aug. 19, 2009, 24 pages.
Peebler, R. P. et al., "Formation Evaluation with Logs in the Deep Anadarko Basin", *SPE of AIME*, 1972, 15 pages.
Pepper, D. W. et al., "Benchmarking COMSOL Multiphysics 3.5a—CFD Problems", a presentation, Oct. 10, 2009, 54 pages.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Porosity Dependence of Ultrasonic Velocity and Elastic Modulus in Sintered Uranium Dioxide—a discussion", *Journal of Materials Science Letters*, vol. 5, 1986, pp. 427-430.
Plinninger, R. J. et al., "Wear Prediction in Hardrock Excavation Using the CERCHAR Abrasiveness Index (CAI)", EUROCK 2004 & 53rd Geomechanics Colloquium, 2004, 6 pages.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Pooniwala, S. et al., "Lasers: The Next Bit", a paper prepared for the presentation at the 2006 SPE (Society of Petroleum Engineers) Eastern Regional Meeting, Oct. 2006, pp. 1-10.
Porter, J. A. et al., "Cutting Thin Sheet Metal with a Water Jet Guided Laser Using Various Cutting Distances, Feed Speeds and Angles of Incidence", *Int. J. Adv. Manuf. Technol.*, vol. 33, 2007, pp. 961-967.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.
Potyondy, D. O., "Simulating Stress Corrosion with a Bonded-Particle Model for Rock", *International Journal of Rock Mechanics & Mining Sciences*, vol. 44, 2007, pp. 677-691.
Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th US Symposium on Rock Mechanics, Jun. 1985, pp. 89-96.
Quinn, R. D. et al., "A Method for Calculating Transient Surface Temperatures and Surface Heating Rates for High-Speed Aircraft", NASA, Dec. 2000, 35 pages.
Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Rauenzahn, R. M. et al., "Rock Failure Mechanisms of Flame-Jet Thermal Spallation Drilling -Theory and Experimental Testing", *Int. J. Rock Mech. Min. Sci. & Geomech. Abstr.*, vol. 26, No. 5, 1989, pp. 381-399.
Ravishankar, M. K., "Some Results on Search Complexity vs Accuracy", DARPA Spoken Systems Technology Workshop, Feb. 1997, 4 pages.
Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of Igneous Rocks", *Int. J. Rock Mech. Min. Sci. & Geomech. Abstr.*, vol. 11, 1974, pp. 403-411.
Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.
Rijken, P. et al., "Role of Shale Thickness on Vertical Connectivity of Fractures: Application of Crack-Bridging Theory to the Austin Chalk, Texas", *Tectonophysics*, vol. 337 ,2001, pp. 117-133.
Author unknown, by RIO Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Rosler, M., "Generalized Hermite Polynomials and the Heat Equation for Dunkl Operators", a paper, while the date of the publication is unknown, it is believed to be prior to Aug. 19, 2009, pp. 1-24.
Rossmanith, H. P. et al., "Fracture Mechanics Applications to Drilling and Blasting", *Fatigue & Fracture Engineering Materials & Structures*, vol. 20, No. 11, 1997, pp. 1617-1636.

Rubin, A. M. et al., "Dynamic Tensile-Failure-Induced Velocity Deficits in Rock", *Geophysical Research Letters*, vol. 18, No. 2, Feb. 1991, pp. 219-222.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for The US Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, A. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", COMSOL Users Conference 2006, 38 pages.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Somerton, W. H. et al., "Thermal Expansion of Fluid Saturated Rocks Under Stress", SPWLA Twenty-Second Annual Logging Symposium, Jun. 1981, pp. 1-8.
Sousa, L. M. O. et al., "Influence of Microfractures and Porosity on the Physico-Mechanical Properties and Weathering of Ornamental Granites", *Engineering Geology*, vol. 77, 2005, pp. 153-168.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "COMSOL in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tao, Q. et al., "A Chemo-Poro-Thermoelastic Model for Stress/Pore Pressure Analysis around a Wellbore in Shale", a paper prepared for presentation at the US Symposium on Rock Mechanics (USRMS): *Rock Mechanics for Energy*, Mineral and Infrastracture Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.
Terzopoulos, D. et al., "Modeling Inelastic Deformation: Viscoelasticity, Plasticity, Fracture", *SIGGRAPH '88*, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Tovo, R. et al., "Fatigue Damage Evaluation on Mechanical Components Under Multiaxial Loadings", excerpt from the Proceedings of the COMSOL Conference, 2009, 8 pages.
Tuler, F. R. et al., "A Criterion for the Time Dependence of Dynamic Fracture", *The International Jopurnal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional-and Shear-Wave Velocities and Attenuations in Tight Gas Sandstones", *Geophysics*, vol. 59, No. 1, Jan. 1994, pp. 77-86.
Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.
Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4 Jan. 22, 2002, pp. 154-161.

Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufacture*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at , Lappeenranta University of Technology, Oct. 2010, 74 pages.
Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and Nonporous Rocks", *Natural Resources Research*, vol. 13, No. 2, Jun. 2004, pp. 97-122.
Waples, D. W. et al., "A Review and Evaluation of Specific Heat Capacities of Rocks, Minerals, and Subsurface Fluids. Part 2: Fluids and Porous Rocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wilkinson, M. A. et al., "Experimental Measurement of Surface Temperatures During Flame-Jet Induced Thermal Spallation", *Rock Mechanics and Rock Engineering*, 1993, pp. 29-62.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of the Industrial Physicist at: http://www.aip.org/tip/INPHFA/vol-9/iss-3/p24.html, on May 18, 2010, pp. 1-5.
Wu, X. Y. et al., "The Effects of Thermal Softening and Heat Conductin on the Dynamic Growth of Voids", *International Journal of Solids and Structures*, vol. 40, 2003, pp. 4461-4478.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z. et al., "Application of High Powered Lasers to Perforated Completions", *International Congress on Applications of Laser & Electro-Optics*, Oct 2003, 6 pages.
Xu, Z. et al., "Laser Rock Drilling by a Super-Pulsed CO2 Laser Beam", a manuscript created for the US Department of Energy, while the date of the publication is unknown, it is believed to be prior to Aug. 19, 2009, 9 pages.
Xu, Z. et al., "Laser Spallation of Rocks for Oil Well Drilling", Proceedings of the 23rd International Congress on Applications of Lasers and Electro-Optics, 2004, pp. 1-6.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 2004, 5 pages.
Xu, Z. et al., "Specific Energy of Pulsed Laser Rock Drilling", *Journal of Laser Applications*, vol. 15, No. 1, Feb. 2003, pp. 25-30.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yasar, E. et al., "Determination of the Thermal Conductivity from Physico-Mechanical Properties", *Bull Eng. Geol. Environ*., vol. 67, 2008, pp. 219-225.
York, J. L. et al., "The Influence of Flashing and Cavitation on Spray Formation", a progress report for UMRI Project 2815 with Delavan Manufacturing Company, Oct. 1959, 27 pages.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zehnder, A. T., "Lecture Notes on Fracture Mechanics", 2007, 227 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.
Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhu, X. et al., "High-Power ZBLAN Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.
Zuckerman, N. et al., "Jet Impingement Heat Transfer: Physics, Correlations, and Numerical Modeling", *Advances in Heat Transfer*, vol. 39, 2006, pp. 565-631.
Aptukov, V. N., "Two Stages of Spallation", publisher unknown, while the date of the publication is unknown, it is believed to be prior to Aug. 19, 2009, 6 pages.
Bechtel SAIC Company LLC, "Heat Capacity Analysis", a report prepared for US Department of Energy, Nov. 2004, 100 pages.
"Chapter 7: Energy Conversion Systems—Options and Issues", publisher ubknown, while the date of the publication is unknown, it is believed to be prior to Aug. 19, 2009, pp. 7-1 to 7-32 and table of contents page.
"Chapter I—Laser-Assisted Rock-Cutting Tests", publisher unknown, while the date of the publication is unknown, it is believed to be prior to Aug. 19, 2009, 64 pages.
"Cross Process Innovations", Obtained from the Internet at: http://www.mrl.columbia.edu/ntm/CrossProcess/CrossProcessSect5.htm, on Feb. 2, 2010, 11 pages.
"Fourier Series, Generalized Functions, Laplace Transform", publisher unknown, while the date of the publication is unknown, it is believed to be prior to Aug. 19, 2009, 6 pages.
"Silicone Fluids: Stable, Inert Media", Gelest, Inc., while the date of the publication is unknown, it is believed to be prior to Aug. 19, 2009, 27 pages.
"Introduction to Optical Liquids", Cargille-Sacher Laboratories Inc., Obtained from the Internet at: http://www.cargille.com/opticalintro.shtml, on Dec. 23, 2008, 5 pages.

"Laser Drilling", Oil & Natural Gas Projects (Exploration & Production Technologies) Technical Paper, Dept. of Energy, Jul. 2007, 3 pages.
"Leaders in Industry Luncheon", IPAA & TIPRO, Jul. 8, 2009, 19 pages.
"Measurement and Control of Abrasive Water-Jet Velocity", publisher unknown, while the date of the publication is unknown, it is believed to be prior to Aug. 19, 2009, 8 pages.
"Nonhomogeneous PDE—Heat Equation with a Forcing Term", a lecture, 2010, 6 pages.
"Performance Indicators for Geothermal Power Plants", prepared by International Geothermal Association for World Energy Council Working Group on Performance of Renewable Energy Plants, author unknown, Mar. 2011, 7 pages.
"Rock Mechanics and Rock Engineering", publisher unknown, while the date of the publication is unknown, it is believed to be prior to Aug. 19, 2009, 69 pages.
"Shock Tube", Cosmol MultiPhysics 3.5a, 2008, 5 pages.
"Stimulated Brillouin Scattering (SBS) in Optical Fibers", Centro de Pesquisa em Optica e Fotonica, Obtained from the Internet at: http://cepof.ifi.unicamp.br/index.php . . . ), on Jun. 25, 2012, 2 pages.
"Underwater Laser Cutting", TWI Ltd, May/Jun. 2011, 2 pages.
Related utility application assigned U.S. Appl. No. 13/486,795, filed Jun. 1, 2012, 166 pages.
Related utility application assigned U.S. Appl. No. 13/565,345, filed Aug. 2, 2012, 112 pages.
Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.
Abousleiman, Y. et al., "Poroelastic Solution of an Inclined Borehole in a Transversely Isotropic Medium", *Rock Mechanics*, Daemen & Schultz (eds), 1995, pp. 313-318.
Ackay, H. et al., Paper titled "Orthonormal Basis Functions for Continuous-Time Systems and Lp Convergence", date unknown but prior to Aug. 19, 2009, pp. 1-12.
Acosta, A. et al., paper from X Brazilian MRS meeting titled "Drilling Granite With Laser Light", X Encontro da SBPMat Granado-RS, Sep. 2011, 4 pages including pp. 56 and 59.
Ahmadi, M. et al., "The Effect of Interaction Time and Saturation of Rock on Specific Energy in ND:YAG Laser Perforating", *Optics and Laser Technology*, vol. 43, 2011, pp. 226-231.
Akhatov, I. et al., "Collapse and Rebound of a Laser-Induced Cavitation Bubble", *Physics of Fluids*, vol. 13, No. 10, Oct. 2001, pp. 2805-2819.
Albertson, M. L. et al., "Diffusion of Submerged Jets", a paper for the *American Society of Civil Engineers*, Nov. 5, 1852, pp. 1571-1596.
Al-Harthi, A. A. et al., "The Porosity and Engineering Properties of Vesicular Basalt in Saudi Arabia", *Engineering Geology*, vol. 54, 1999, pp. 313-320.
Anand, U. et al., "Prevention of Nozzle Wear in Abrasive Water Suspension Jets (AWSJ) Using Porous Lubricated Nozzles", *Transactions of the ASME*, vol. 125, Jan. 2003, pp. 168-181.
Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.
Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.
Antonucci, V. et al., "Numerical and Experimental Study of a Concentrated Indentation Force on Polymer Matrix Composites", an excerpt from the *Proceedings of the COMSOL Conference*, 2009, 4 pages.
ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Avar, B. B. et al., "Porosity Dependence of the Elastic Modulus of Lithophysae-rich Tuff: Numerical and Experimental Investigations", *International Journal of Rock Mechanics & Mining Sciences*, vol. 40, 2003, pp. 919-928.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.
Baek, S. Y. et al., "Simulation of the Coupled Thermal/Optical Effects for Liquid Immersion Micro-/Nanolithography", source unknown, believed to be publically available prior to 2012,13 pages.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Baird, J. A. et al., "Analyzing the Dynamic Behavior of Downhole Equipment During Drilling", US government Sandia Report, SAND-84-0758C, DE84 008840, 7 pages.
Batarseh, S. I. et al, "Innovation in Wellbore Perforation Using High-Power Laser", *International Petroleum Technology Conference*, IPTC No. 10981, Nov. 2005, 7 pages.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of Porous Building Stones", *Eur. J. Mineral*, vol. 20, Aug. 2008, pp. 673-685.
Bieniawski, Z. T., "Mechanism of Brittle Fracture of Rock: Part I—Theory of the Fracture Process", *Int. J. Rock Mech. Min. Sci*., vol. 4, 1967, pp. 395-406.
Bilotsky, Y. et al., "Modelling Multilayers Systems with Time-Depended Heaviside and New Transition Functions", excerpt from the Proceedings of the 2006 Nordic COMSOL Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/full/5/2/657, May 26, 2006, 27 pages.
Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci*., vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics*., vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Brown, G., "Development, Testing and Track Record of Fiber-Optic, Wet-Mate, Connectors", *IEEE*, 2003, pp. 83-88.

Brujan, E. A. et al., "Dynamics of Laser-Induced Cavitation Bubbles Near an Elastic Boundar", *J. Fluid Mech*., vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pp. 62-63.
Bybee, Karen, highlight of "Drilling a Hole in Granite Submerged in Water by Use of CO2 Laser", an SPE available at www.spe.org/jpt, *JPT*, Feb. 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Carstens, J. P. et al., "Rock Cutting by Laser", a paper of *Society of Petroleum Engineers of AIME*, 1971, 11 pages.
Caruso, C. et al., "Dynamic Crack Propagation in Fiber Reinforced Composites", Excerpt from the Proceedings of the COMSOL Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct. 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 additional pages.
Cimetiere, A. et al., "A Damage Model for Concrete Beams in Compression", *Mechanics Research Communications*, vol. 34, 2007, pp. 91-96.
Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.
Cohen, J. H., "High-Power Slim-Hole Drilling System", a paper presented at the conference entitled Natural Gas RD&D Contractor's Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr*., vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
de Castro Lima, J. J. et al., "Linear Thermal Expansion of Granitic Rocks: Influence of Apparent Porosity, Grain Size and Quartz Content", *Bull Eng Geol Env*., 2004, vol. 63, pp. 215-220.
Degallaix, J. et al., "Simulation of Bulk-Absorption Thermal Lensing in Transmissive Optics of Gravitational Waves Detector", *Appl. Phys*., B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr*., vol. 18, 1981, pp. 199-209.
Dimotakis, P. E. et al., "Flow Structure and Optical Beam Propagation in High-Reynolds-Number Gas-Phase Shear Layers and Jets", *J. Fluid Mech*., vol. 433, 2001, pp. 105-134.
Dole, L. et al., "Cost-Effective Cementitious Material Compatible with Yucca Mountain Repository Geochemistry", a paper prepared by Oak Ridge National Laboratory for the US Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.
Dutton, S. P. et al., "Evolution of Porosity and Permeability in the Lower Cretaceous Travis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Ersoy, A., "Wear Characteristics of PDC Pin and Hybrid Core Bits in Rock Drilling", *Wear*, vol. 188, 1995, pp. 150-165.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.
Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Finger, J. T. et al., "PDC Bit Research at Sandia National Laboratories", Sandia Report No. SAND89-0079-UC-253, a report prepared for US Department of Energy, Jun. 1989, 88 pages.
Freeman, T. T. et al., "THM Modeling for Reservoir Geomechanical Applications", presented at the COMSOL Conference, Oct. 2008, 22 pages.
Friant, J. E. et al., "Disc Cutter Technology Applied to Drill Bits", a paper prepared by Exacavation Engineering Associates, Inc. for the US Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.

Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gahan, B. C. et al., "Laser Drilling: Drilling with the Power of Light, Phase 1: Feasibility Study", a Topical Report by the *Gas Technology Institute*, for the US Government under Cooperative Agreement No. DE-FC26-00NT40917, Sep. 30, 2001, 107 pages.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Gonthier, F. "High-power All-Fiber® components: The missing link for high power fiber fasers", source unknown, 11 pages.
Graves, R. M. et al., "Comparison of Specific Energy Between Drilling With High Power Lasers and Other Drilling Methods", *SPE*, No. SPE 77627, a paper presented at the Spe (Society of Petroleum Engineers) Annual Technical Conference and Exhibiton, Sep. 2002, pp. 1-8.
Graves, R. M. et al., "Spectral signatures and optic coeffecients of surface and reservoir rocks at COIL, CO2 and Nd:YAG laser wavelenghts", source unknown, 13 pages.
Graves, R. M. et al., "StarWars Laser Technology Applied to Drilling and Completing Gas Wells", *SPE*, No. 49259, a paper prepared for presentation at the 1998 SPE Annual Technical Conference and Exhibition, 1998, pp. 761-770.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "Inhomogeneous Boundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.
Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hammer, D. X. et al., "Shielding Properties of Laser-Induced Breakdown in Water for Pulse Durations from 5 ns to 125 fs", *Applied Optics*, vol. 36, No. 22, Aug. 1, 1997, pp. 5630-5640.
Hancock, M. J., "The 1-D Heat Equation: 18.303 Linear Partial Differential Equations", source unknown, 2004, pp. 1-41.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.
Hashida, T. et al., "Numerical Simulation with Experimental Verification of the Fracture Behavior in Granite Under Confining Pressures based on the Tension-Softening Model", *International Journal of Fracture*, vol. 59, 1993, pp. 227-244.
Hasting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Hood, M., "Waterjet-Assisted Rock Cutting Systems—The Present State of the Art", *International Journal of Mining Engineering*, vol. 3, 1985, pp. 91-111.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the 10$^{th}$ American Waterjet Confeence in Houston, Texas, 1999, 25 pages.
Hu, H. et al., "Simultaneous Velocity and Concentration Measurements of a Turbulent Jet Mixing Flow", *Ann. N.Y. Acad. Sci.*, vol. 972, 2002, pp. 254-259.
Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", *Proceedings, Twenty-Ninth Workshop on Geothermal Reservoir Engineering*, Stanford University, Stanford, California, Jan. 26-28, 2004, 4 pages.
Hutchinson, J. W., "Mixed Mode Cracking in Layered Materials", *Advances in Applied Mechanics*, vol. 29, 1992, pp. 63-191.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.
Judzis, A. et al., "Investigation of Smaller Footprint Drilling System; Ultra-High Rotary Speed Diamond Drilling Has Potential for Reduced Energy Requirements", IADC/SPE No. 99020, 33 pages.
Jurewicz, B. R., "Rock Excavation with Laser Assistance", *Int. J. Rock Mech. Min. Sci. & Geomech. Abstr.*, vol. 13, 1976, pp. 207-219.
Karakas, M., "Semianalytical Productivity Models for Perforated Completions", *SPE*, No. 18247, a paper for SPE (Society of Petroleum Engineers) Production Engineering, Feb. 1991, pp. 73-82.

Karasawa, H. et al., "Development of PDC Bits for Downhole Motors", *Proceedings 17th NZ Geothermal Workshop*, 1995, pp. 145-150.
Kemeny, J. M., "A Model for Non-linear Rock Deformation Under Compression Due to Sub-critical Crack Growth", *Int. J. Rock Mech. Min. Sci. & Geomech. Abstr.*, vol. 28 No. 6, 1991, pp. 459-467.
Khandelwal, M., "Prediction of Thermal Conductivity of Rocks by Soft Computing", *Int. J. Earth Sci.* (*Geol. Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol.*,vol. 5, 2004, pp. 1683-1686.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobyakov, A. et al., "Design Concept for Optical Fibers with Enhanced SBS Threshold", *Optics Express*, vol. 13, No. 14, Jul. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kollé, J. J., "A Comparison of Water Jet, Abrasive Jet and Rotary Diamond Drilling in Hard Rock", *Tempress Technologies Inc.*, 1999, pp. 1-8.
Kolle, J. J., "HydroPulse Drilling", a Final Report for US Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", *IEEE*, Jun. 3, 2010, pp. 56-57.
Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
International Search Report for related application case No. PCT/US2012/049338, dated Jan. 22. 2013, 14 pgs.

METHODS AND APPARATUS FOR DELIVERING HIGH POWER LASER ENERGY TO A SURFACE

This application claims the benefit of priority of provisional applications: Ser. No. 61/090,384 filed Aug. 20, 2008, titled System and Methods for Borehole Drilling: Ser. No. 61/102,730 filed Oct. 3, 2008, titled Systems and Methods to Optically Pattern Rock to Chip Rock Formations; Ser. No. 61/106,472 filed Oct. 17, 2008, titled Transmission of High Optical Power Levels via Optical Fibers for Applications such as Rock Drilling and Power Transmission; and, Ser. No. 61/153,271 filed Feb. 17, 2009, title Method and Apparatus for an Armored High Power Optical Fiber for Providing Boreholes in the Earth, the disclosures of which are incorporated herein by reference.

This invention was made with Government support under Award DE-AR0000044 awarded by the Office of ARPA-E U.S. Department of Energy. The Government has certain rights in this invention.

BACKGROUND OF THE INVENTION

The present invention relates to methods, apparatus and systems for delivering high power laser energy over long distances, while maintaining the power of the laser energy to perform desired tasks. In a particular, the present invention relates to optics, beam profiles and laser spot patterns for use in and delivery from a laser bottom hole assembly (LBHA) for delivering high power laser energy to the bottom of a borehole to create and advance a borehole in the earth.

In general, boreholes have been formed in the earth's surface and the earth, i.e., the ground, to access resources that are located at and below the surface. Such resources would include hydrocarbons, such as oil and natural gas, water, and geothermal energy sources, including hydrothermal wells. Boreholes have also been formed in the ground to study, sample and explore materials and formations that are located below the surface. They have also been formed in the ground to create passageways for the placement of cables and other such items below the surface of the earth.

The term borehole includes any opening that is created in the ground that is substantially longer than it is wide, such as a well, a well bore, a well hole, and other terms commonly used or known in the art to define these types of narrow long passages in the earth. Although boreholes are generally oriented substantially vertically, they may also be oriented on an angle from vertical, to and including horizontal. Thus, using a level line as representing the horizontal orientation, a borehole can range in orientation from 0° i.e., a vertical borehole, to 90°, i.e., a horizontal borehole and greater than 90° e.g., such as a heel and toe. Boreholes may further have segments or sections that have different orientations, they may be arcuate, and they may be of the shapes commonly found when directional drilling is employed. Thus, as used herein unless expressly provided otherwise, the "bottom" of the borehole, the "bottom" surface of the borehole and similar terms refer to the end of the borehole, i.e., that portion of the borehole farthest along the path of the borehole from the borehole's opening, the surface of the earth, or the borehole's beginning.

Advancing a borehole means to increase the length of the borehole. Thus, by advancing a borehole, other than a horizontal one, the depth of the borehole is also increased. Boreholes are generally formed and advanced by using mechanical drilling equipment having a rotating drilling bit. The drilling bit is extending to and into the earth and rotated to create a hole in the earth. In general, to perform the drilling operation a diamond tip tool is used. That tool must be forced against the rock or earth to be cut with a sufficient force to exceed the shear strength of that material. Thus, in conventional drilling activity mechanical forces exceeding the shear strength of the rock or earth must be applied to that material. The material that is cut from the earth is generally known as cuttings, i.e., waste, which may be chips of rock, dust, rock fibers, and other types of materials and structures that may be created by thermal or mechanical interactions with the earth. These cuttings are typically removed from the borehole by the use of fluids, which fluids can be liquids, foams or gases.

In addition to advancing the borehole, other types of activities are performed in or related to forming a borehole, such as, work over and completion activities. These types of activities would include for example the cutting and perforating of casing and the removal of a well plug. Well casing, or casing, refers to the tubulars or other material that are used to line a wellbore. A well plug is a structure, or material that is placed in a borehole to fill and block the borehole. A well plug is intended to prevent or restrict materials from flowing in the borehole.

Typically, perforating, i.e., the perforation activity, involves the use of a perforating tool to create openings, e.g. windows, or a porosity in the casing and borehole to permit the sought after resource to flow into the borehole. Thus, perforating tools may use an explosive charge to create, or drive projectiles into the casing and the sides of the borehole to create such openings or porosities.

The above mentioned conventional ways to form and advance a borehole are referred to as mechanical techniques, or mechanical drilling techniques, because they require a mechanical interaction between the drilling equipment, e.g., the drill bit or perforation tool, and the earth or casing to transmit the force needed to cut the earth or casing.

It has been theorized that lasers could be adapted for use to form and advance a borehole. Thus, it has been theorized that laser energy from a laser source could be used to cut rock and earth through spalling, thermal dissociation, melting, vaporization and combinations of these phenomena. Melting involves the transition of rock and earth from a solid to a liquid state. Vaporization involves the transition of rock and earth from either a solid or liquid state to a gaseous state. Spalling involves the fragmentation of rock from localized heat induced stress effects. Thermal dissociation involves the breaking of chemical bonds at the molecular level.

To date it is believed that no one has succeeded in developing and implementing these laser drilling theories to provide an apparatus, method or system that can advance a borehole through the earth using a laser, or perform perforations in a well using a laser. Moreover, to date it is believed that no one has developed the parameters, and the equipment needed to meet those parameters, for the effective cutting and removal of rock and earth from the bottom of a borehole using a laser, nor has anyone developed the parameters and equipment need to meet those parameters for the effective perforation of a well using a laser. Further is it believed that no one has developed the parameters, equipment or methods need to advance a borehole deep into the earth, to depths exceeding about 300 ft (0.09 km), 500 ft (0.15 km), 1000 ft, (0.30 km), 3,280 ft (1 km), 9,840 ft (3 km) and 16,400 ft (5 km), using a laser. In particular, it is believed that no one has developed parameters, equipments, or methods nor implemented the delivery of high power laser energy, i.e., in excess of 1 kW or more to advance a borehole within the earth.

While mechanical drilling has advanced and is efficient in many types of geological formations, it is believed that a highly efficient means to create boreholes through harder geologic formations, such as basalt and granite has yet to be developed. Thus, the present invention provides solutions to this need by providing parameters, equipment and techniques for using a laser for advancing a borehole in a highly efficient manner through harder rock formations, such as basalt and granite.

The environment and great distances that are present inside of a borehole in the earth can be very harsh and demanding upon optical fibers, optics, and packaging. Thus, there is a need for methods and an apparatus for the deployment of optical fibers, optics, and packaging into a borehole, and in particular very deep boreholes, that will enable these and all associated components to withstand and resist the dirt, pressure and temperature present in the borehole and overcome or mitigate the power losses that occur when transmitting high power laser beams over long distances. The present inventions address these needs by providing a long distance high powered laser beam transmission means.

It has been desirable, but prior to the present invention believed to have never been obtained, to deliver a high power laser beam over a distance within a borehole greater than about 300 ft (0.90 km), about 500 ft (0.15 km), about 1000 ft, (0.30 km), about 3,280 ft (1 km), about 9,8430 ft (3 km) and about 16,400 ft (5 km) down an optical fiber in a borehole, to minimize the optical power losses due to non-linear phenomenon, and to enable the efficient delivery of high power at the end of the optical fiber. Thus, the efficient transmission of high power from point A to point B where the distance between point A and point B within a borehole greater than about 1,640 ft (0.5 km) has long been desirable, but prior to the present invention is believed to have never been obtainable and specifically believed to have never been obtained in a borehole drilling activity. The present invention addresses this need by providing an LBHA and laser optics to deliver a high powered laser beam to downhole surfaces in a borehole.

A conventional drilling rig, which delivers power from the surface by mechanical means, must create a force on the rock that exceeds the shear strength of the rock being drilled. Although a laser has been shown to effectively spall and chip such hard rocks in the laboratory under laboratory conditions, and it has been theorized that a laser could cut such hard rocks at superior net rates than mechanical drilling, to date it is believed that no one has developed the apparatus systems or methods that would enable the delivery of the laser beam to the bottom of a borehole that is greater than about 1,640 ft (0.5 km) in depth with sufficient power to cut such hard rocks, let alone cut such hard rocks at rates that were equivalent to and faster than conventional mechanical drilling. It is believed that this failure of the art was a fundamental and long standing problem for which the present invention provides a solution.

The environment and great distances that are present inside of a borehole in the earth can be harsh and demanding upon optics and optical fibers. Thus, there is a need for methods and an apparatus for the delivery of high power laser energy very deep in boreholes that will enable the delivery device to withstand and resist the dirt, pressure and temperature present in the borehole. The present invention addresses this need by providing an LBHA and laser optics to deliver a high powered laser beam to downhole surfaces of a borehole.

Thus the present invention addresses and provides solutions to these and other needs in the drilling arts by providing, among other things optics, beam profiles and laser spot patterns for use in and delivery from an LBHA to provide the delivery of high powered laser beam energy to the surfaces of a borehole.

SUMMARY

It is desirable to develop systems and methods that provide for the delivery of high power laser energy to the bottom of a deep borehole to advance that borehole at a cost effect rate, and in particular, to be able to deliver such high power laser energy to drill through rock layer formations including granite, basalt, sandstone, dolomite, sand, salt, limestone, rhyolite, quartzite and shale rock at a cost effective rate. More particularly, it is desirable to develop systems and methods that provide for the ability to be able to deliver such high power laser energy to drill through hard rock layer formations, such as granite and basalt, at a rate that is superior to prior conventional mechanical drilling operations. The present invention, among other things, solves these needs by providing the system, apparatus and methods taught herein.

Thus, there is provided a system for creating a borehole in the earth having a high power laser source, a bottom hole assembly and, a fiber optically connecting the laser source with the bottom hole assembly, such that a laser beam from the laser source is transmitted to the bottom hole assembly the bottom hole assembly comprising: a means for providing the laser beam to a bottom surface of the borehole; the providing means comprising beam power deposition optics; wherein, the laser beam as delivered from the bottom hole assembly illuminates the bottom surface of the borehole with a substantially even energy deposition profile.

There is further provided a system for creating a borehole in the earth comprising: a high power laser source; a bottom hole assembly; an optical fiber, having a first and a second end, having a length between the first and second ends, the first end being optically associated with the laser source and the fiber having a length of at least about 1000 ft; a means for delivering a laser beam from the laser source to a surface of the borehole; the laser delivery means connected to and optically associated with the second end of the optical fiber; and, a means for providing a substantially uniform energy deposition.

There is additionally provided a system and method for creating a borehole in the earth wherein the system and method employ means for providing the laser beam to the bottom surface in a predetermined energy deposition profile, including having the laser beam as delivered from the bottom hole assembly illuminating the bottom surface of the borehole with a predetermined energy deposition profile, illuminating the bottom surface with an any one of or combination of: a predetermined energy deposition profile biased toward the outside area of the borehole surface; a predetermined energy deposition profile biased toward the inside area of the borehole surface; a predetermined energy deposition profile comprising at least two concentric areas having different energy deposition profiles; a predetermined energy deposition profile provided by a scattered laser shot pattern; a predetermined energy deposition profile based upon the mechanical stresses applied by a mechanical removal means; a predetermined energy deposition profile having at least two areas of differing energy and the energies in the areas correspond inversely to the mechanical forces applied by a mechanical means.

There is yet further provided a method of advancing a borehole using a laser, the method comprising: advancing a high power laser beam transmission means into a borehole; the borehole having a bottom surface, a top opening, and a length extending between the bottom surface and the top opening of at least about 1000 feet; the transmission means comprising a distal end, a proximal end, and a length extending between the distal and proximal ends, the distal end being advanced down the borehole; the transmission means comprising a means for transmitting high power laser energy; providing a high power laser beam to the proximal end of the transmission means; transmitting substantially all of the power of the laser beam down the length of the transmission means so that the beam exits the distal end; transmitting the laser beam from the distal end to an optical assembly in a laser bottom hole assembly, the laser bottom hole assembly directing the laser beam to the bottom surface of the borehole; and, providing a predetermined energy deposition profile to the bottom of the borehole; whereby the length of the borehole is increased, in part, based upon the interaction of the laser beam with the bottom of the borehole.

Moreover there is provided a method of advancing a borehole using a laser, wherein the laser beam is directed to the bottom surface of the borehole in a substantially uniform energy deposition profile and thereby the length of the borehole is increased, in part, based upon the interaction of the laser beam with the bottom of the borehole.

Still further there is provided a method of advancing a borehole using a laser, wherein the laser beam is directed in a predetermined pattern to provide a predetermined energy deposition profile to the bottom surface of the borehole whereby the length of the borehole is increased, in part, based upon the interaction of the laser beam with the bottom of the borehole.

The foregoing systems and methods may further employ more than one laser beams, a plurality of laser beams, a laser beam with a Gaussian profile at the fiber bottom hole assembly connection, a substantially Gaussian profile at the fiber bottom hole assembly connection, a super-Gaussian profile at the fiber bottom hole assembly connection, or a laser beam with substantially uniform profile at the fiber bottom hole assembly connection.

The forgoing systems and methods may also employ a laser delivery means comprising an optical assembly, a rotating optical assembly, a mud motor, a micro-optics array, or an axicon lens.

The forgoing systems and methods may further employ a laser beam having at least about 1 kW, 3 kW, 5 kW, 10 kW, or 15 kW at the down hole end of the fiber. These systems and methods may employ laser sources from at least about 5 kW to about 20 kW, at least about 15 kW, at least about 5 kW.

One of ordinary skill in the art will recognize, based on the teachings set forth in these specifications and drawings, that there are various embodiments and implementations of these teachings to practice the present invention. Accordingly, the embodiments in this summary are not meant to limit these teachings in any way.

DESCRIPTION OF THE DRAWINGS AND THE PREFERRED EMBODIMENTS

Figure 1A:
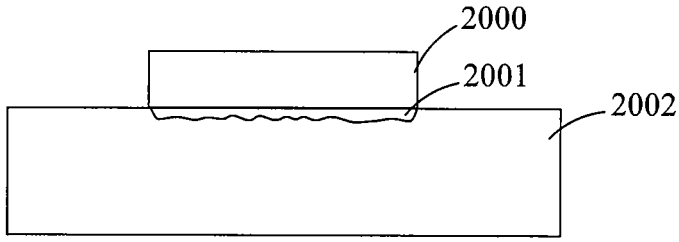
FIGS. 1A and 1B, is a graphic representation of an example of a laser beam basalt illumination.

In general, the present inventions relate to methods, apparatus and systems for use in laser drilling of a borehole in the earth, and further, relate to equipment, methods and systems for the laser advancing of such boreholes deep into the earth and at highly efficient advancement rates. These highly efficient advancement rates are obtainable in part because the present invention provides for optics, beam profiles and laser spot patterns for use in and delivery from a laser bottom hole assembly (LBHA) that shapes and delivers the high power laser energy to the surfaces of the borehole. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

In general, one or more laser beams generated or illuminated by one or more lasers may spall, vaporize or melt material such as rock or earth. The laser beam may be pulsed by one or a plurality of waveforms or it may be continuous. The laser beam may generally induce thermal stress in a rock formation due to characteristics of the rock including, for example, the thermal conductivity. The laser beam may also induce mechanical stress via superheated steam explosions of moisture in the subsurface of the rock formation. Mechanical stress may also be induced by thermal decomposition and sublimation of part of the in situ minerals of the material. Thermal and/or mechanical stress at or below a laser-material interface may promote spallation of the material, such as rock. Likewise, the laser may be used to effect well casings, cement or other bodies of material as desired. A laser beam may generally act on a surface at a location where the laser beam contacts the surface, which may be referred to as a region of laser illumination. The region of laser illumination may have any preselected shape and intensity distribution that is required to accomplish the desired outcome, the laser illumination region may also be referred to as a laser beam spot. Boreholes of any depth and/or diameter may be formed, such as by spalling multiple points or layers. Thus, by way of example, consecutive points may be targeted or a strategic pattern of points may be targeted to enhance laser/rock interaction. The position or orientation of the laser or laser beam may be moved or directed so as to intelligently act across a desired area such that the laser/material interactions are most efficient at causing rock removal.

Generally in downhole operations including drilling, completion, and workover, the bottom hole assembly is an assembly of equipment that typically is positioned at the end of a cable, wireline, umbilical, string of tubulars, string of drill pipe, or coiled tubing and is lower into and out of a borehole. It is this assembly that typically is directly involved with the drilling, completion, or workover operation and facilitates an interaction with the surfaces of the borehole, casing, or formation to advance or otherwise enhance the borehole as desired.

In general, the LBHA may contain an outer housing that is capable of withstanding the conditions of a downhole environment, a source of a high power laser beam, and optics for the shaping and directing a laser beam on the desired surfaces of the borehole, casing, or formation. The high power laser beam may be greater than about 1 kW, from about 2 kW to about 20 kW, greater than about 5 kW, from about 5 kW to about 10 kW, at least about 10 kW, preferably at least about 15 kW, and more preferably at least about 20 kW. The assembly may further contain or be associated with a system for delivering and directing fluid to the desired location in the borehole, a system for reducing or controlling or managing debris in the laser beam path to the material surface, a means to control or manage the temperature of the optics, a means to control or manage the pressure surrounding the optics, and other components of the assembly, and monitoring and measuring equipment and apparatus, as well as, other types of downhole equipment that are used in conventional mechanical drilling operations. Further, the LBHA may incorporate a means to enable the optics to shape and propagate the beam which for example would include a means to control the index of refraction of the environment through which the laser is propagating. Thus, as used herein the terms control and manage are understood to be used in their broadest sense and would include active and passive measures as well as design choices and materials choices.

The LBHA should be construed to withstand the conditions found in boreholes including boreholes having depths of about 1,640 ft (0.5 km) or more, about 3,280 ft (1 km) or more, about 9,830 ft (3 km) or more, about 16,400 ft (5 km) or more, and up to and including about 22,970 ft (7 km) or more. While drilling, i.e. advancement of the borehole, is taking place the desired location in the borehole may have dust, drilling fluid, and/or cuttings present. Thus, the LBHA should be constructed of materials that can withstand these pressures, temperatures, flows, and conditions, and protect the laser optics that are contained in the LBHA. Further, the LBHA should be designed and engineered to withstand the downhole temperatures, pressures, and flows and conditions while managing the adverse effects of the conditions on the operation of the laser optics and the delivery of the laser beam.

The LBHA should also be constructed to handle and deliver high power laser energy at these depths and under the extreme conditions present in these deep downhole environments. Thus, the LBHA and its laser optics should be capable of handling and delivering laser beams having energies of 1 kW or more, 5 kW or more, 10 kW or more and 20 kW or more. This assembly and optics should also be capable of delivering such laser beams at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more.

The LBHA should also be able to operate in these extreme downhole environments for extended periods of time. The lowering and raising of a bottom hole assembly has been referred to as tripping in and tripping out. While the bottom hole assembling is being tripped in or out the borehole is not being advanced. Thus, reducing the number of times that the bottom hole assembly needs to be tripped in and out will reduce the critical path for advancing the borehole, i.e., drilling the well, and thus will reduce the cost of such drilling. (As used herein the critical path referrers to the least number of steps that must be performed in serial to complete the well.) This cost savings equates to an increase in the drilling rate efficiency. Thus, reducing the number of times that the bottom hole assembly needs to be removed from the borehole directly corresponds to reductions in the time it takes to drill the well and the cost for such drilling. Moreover, since most drilling activities are based upon day rates for drilling rigs, reducing the number of days to complete a borehole will provided a substantial commercial benefit. Thus, the LBHA and its laser optics should be capable of handling and delivering laser beams having energies of 1 kW or more, 5 kW or more, 10 kW or more and 20 kW or more at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more, for at least about ½ hr or more, at least about 1 hr or more, at least about 2 hours or more, at least about 5 hours or more, and at least about 10 hours or more, and preferably longer than any other limiting factor in the advancement of a borehole. In this way using the LBHA of the present invention could reduce tripping activities to only those that are related to casing and completion activities, greatly reducing the cost for drilling the well.

By way of example, and without limitation to other spot and beam parameters and combinations thereof, the LBHA and optics should be capable of creating and maintain the laser beam parameters set out in Table 1 in deep downhole environments.

TABLE 1

| Example | Laser Beam Parameters | |
|---|---|---|
| 1 | Beam Spot Size (circular or (elliptical)) | 0.3585", (0.0625", (12.5 mm-0.5 mm), 0.1", |
| | Exposure Times | 0.05 s, 0.1 s, 0.2 s, 0.5 s, 1 s |
| | Time-average Power | 0.25 kW, 0.5 kW, 1.6 kW, 3 kW, 5 kW |
| 2 | Beam Type | CW/Collimated |
| | Beam Spot Size (circular or (elliptical)) | 0.0625" (12.5 mm × 0.5 mm), 0.1" |
| | Power | 0.25 kW, 0.5 kW, 1.6 kW, 3 kW, 5 kW |
| 3 | Beam Type | CW/Collimated and Pulsed at Spallation Zones |
| | Specific Power | Spallation zones (920 W/cm2 at ~2.6 kJ/cc for Sandstone &4 kW/cm2 at ~0.52 kJ/cc for Limestone) |
| | Beam Size | 12.5 mm × 0.5 mm |
| 4 | Beam Type | CW/Collimated or Pulsed at Spallation Zones |
| | Specific Power | Spallation zones (~920 W/cm2 at ~2.6 kJ/cc for Sandstone &4 kW/cm2 at ~0.52 kJ/cc for Limestone) |
| | Beam Size | 12.5 mm × 0.5 mm |

TABLE 1-continued

| Example | | Laser Beam Parameters |
|---|---|---|
| 5 | Beam Type | CW/Collimated or Pulsed at Spallation Zones |
| | Specific Power | Spallation zones {~920 W/cm2 at ~2.6 kJ/cc for Sandstone &4 kW/cm2 at ~0.52 kJ/cc for Limestone) |
| | Beam Size | 12.5 mm × 0.5 mm |
| 6 | Beam Type | CW/Collimated or Pulsed at Spallation Zones |
| | Specific Power | illumination zones {~10,000 W/cm2 at ~1 kJ/cc for Sandstone & 10,000 W/cm2 at ~5 kJ/cc for Limestone) |
| | Beam Size | 50 mm × 10 mm; 50 mm × 0.5 mm; 150 mm × 0.5 mm |

In general, the energy distribution of the laser beam when it illuminates the material in the borehole to be removed, such as rock or casing, is important to maximizing the efficiency and rate of removal of material and the advancement of the borehole. The most desirable beam energy distribution is dependent upon, among other facts, the downhole conditions, the beam profile at the bottom of the borehole, the spot shape and whether the spot is rotated, scanned, fixed or a combination of these. Thus, various optical systems and combination of optics are provide herein to take a particular laser beam profile from the downhole end of a fiber and provided a desired output and energy profile on the borehole surface.

Figure 1B:
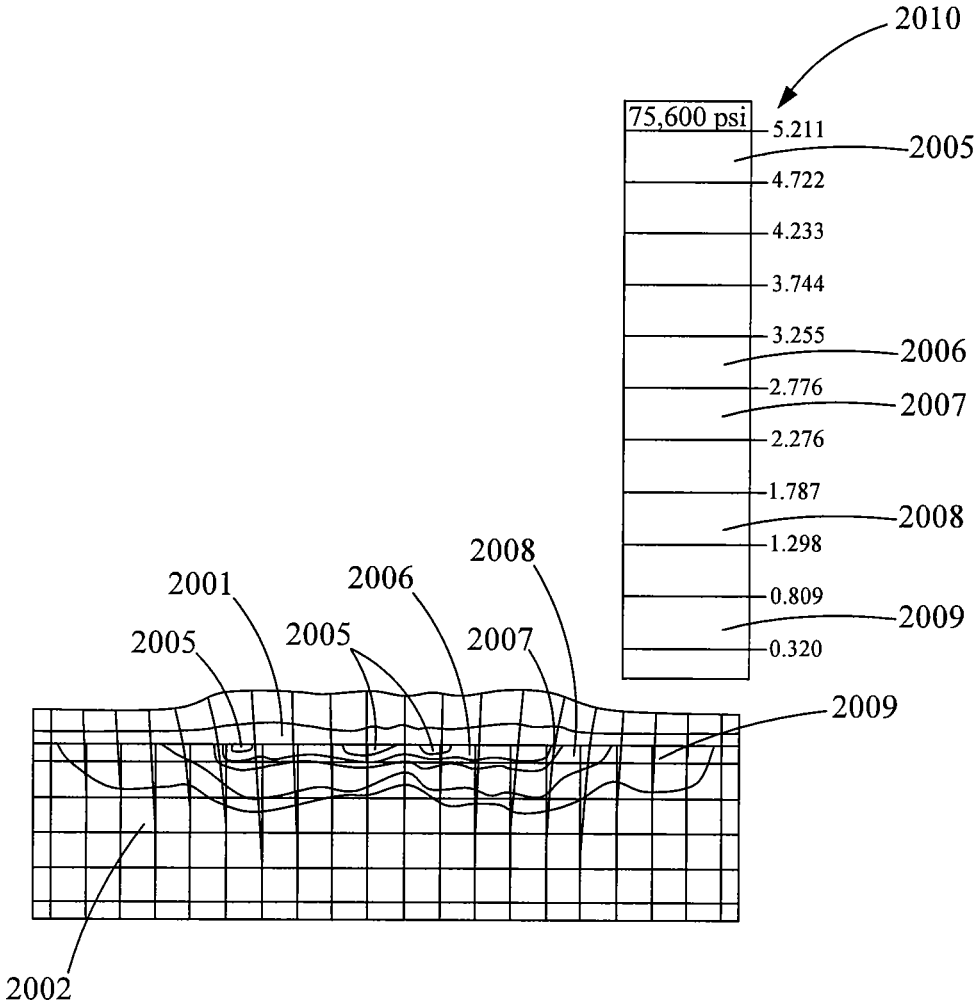

In FIGS. 1A and 1B, there is provided a graphic representation of an example of a laser beam—borehole surface interaction. Thus, there is shown a laser beam 1000, an area of beam illumination 1001, i.e., a spot (as used herein unless expressly provided otherwise the term "spot" is not limited to a circle), on a borehole wall or bottom 1002. There is further provided in FIG. 1B a more detailed representation of the interaction and a corresponding chart 1010 categorizing the stress created in the area of illumination. Chart 1010 provides von Mises Stress in $\sigma_M$ $10^8$ N/m$^2$ wherein the cross hatching and shading correspond to the stress that is created in the illuminated area for a 30 mill-second illumination period, under down hole conditions of 2000 psi and a temperature of 150 F, with a beam having a fluence of 2 kW/cm$^2$. Under these conditions the compressive strength of basalt is about 2.6×$10^8$ N/m$^2$, and the cohesive strength is about 0.66×$10^8$ N/m$^2$. Thus, there is shown a first area 1005 of relative high stress, from about 4.722 to 5.211×$10^8$ N/m$^2$, a second area 1006 of relative stress at or exceeding the compressive stress of basalt under the downhole conditions, from about 2.766 to 3.255×$10^8$ N/m$^2$, a third area 1007 of relative stress about equal to the compressive stress of basalt under the downhole conditions, from about 2.276 to 2.766×$10^8$ N/m$^2$, a fourth area 1008 of relative lower stress that is below the compressive stress of basalt under the downhole conditions yet greater than the cohesive strength, from about 2.276 to 2.766×$10^8$ N/m$^2$, and a fifth area 1009 of relative stress that is at or about the cohesive strength of basalt under the downhole conditions, from about 0.320 to 0.899×$10^8$ N/m$^2$.

Figure 2A:
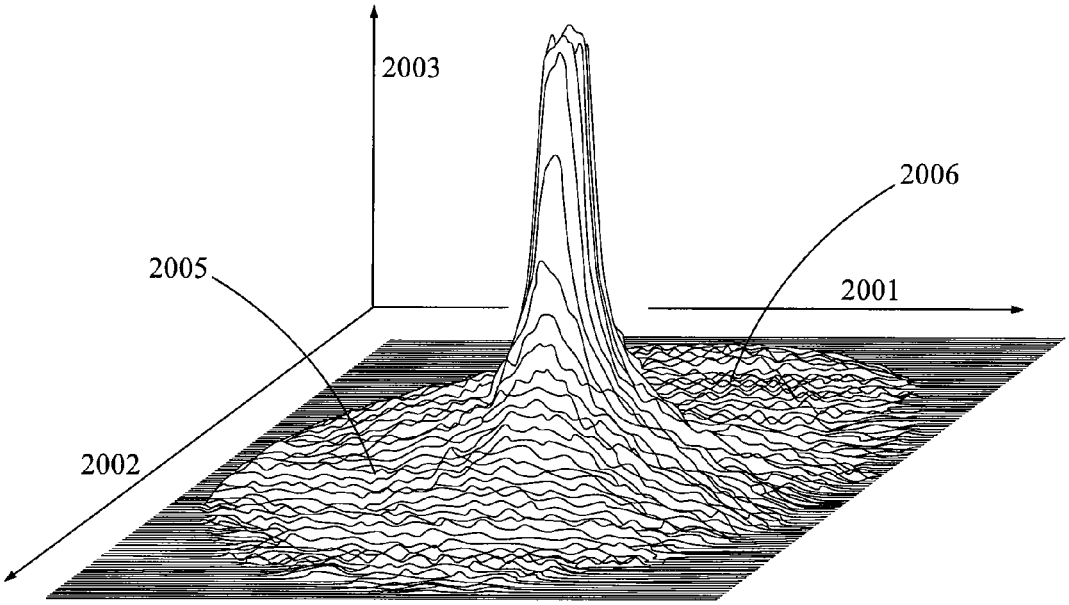
FIGS. 2A and 2B illustrate the energy deposition profile of an elliptical spot rotated about its center point for a beam that is either uniform or Gaussian.
Figure 2B:
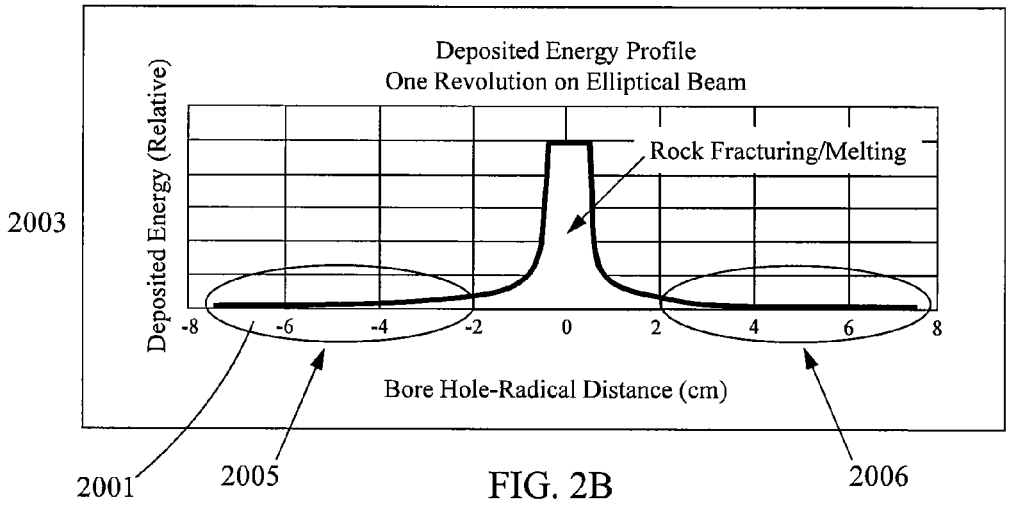

Accordingly, the profiles of the beam interaction with the borehole to obtain a maximum amount of stress in the borehole in an efficient manner, and thus, increase the rate of advancement of the borehole can be obtained. Thus, for example if an elliptical spot is rotated about its center point for a beam that is either uniform or Gaussian the energy deposition profile is illustrated in FIGS. 2A and 2B. Where the area of the borehole from the center point of the beam is shown as x and y axes 2001 and 2002 and the amount of energy deposited is shown on the z axis 2003. From this it is seen that inefficiencies are present in the deposition of energy to the borehole, with the outer sections of the borehole 2005 and 2006 being the limiting factor in the rate of advancement.

Figure 3A:
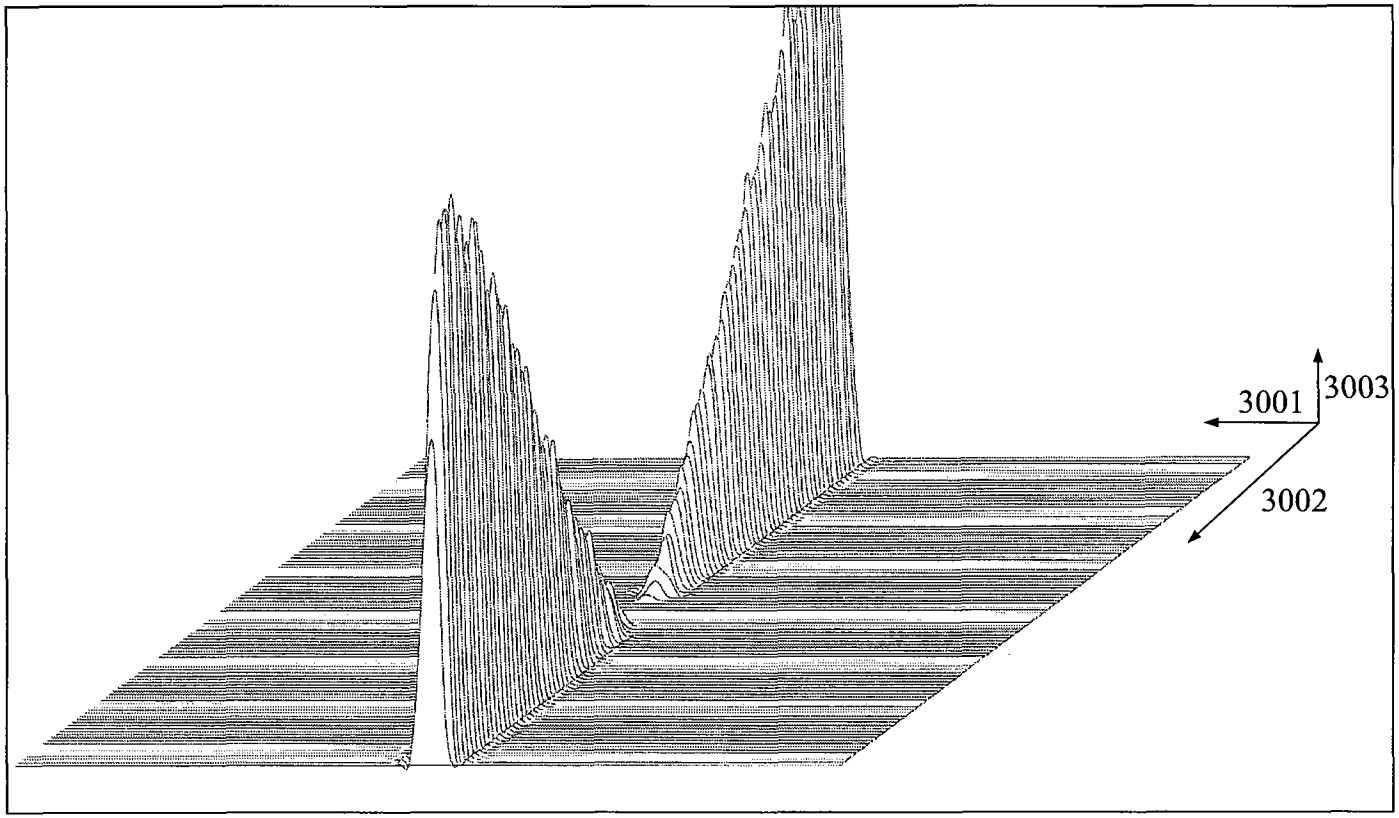
FIG. 3A shows the energy deposition profile with no rotation.
Figure 3B:
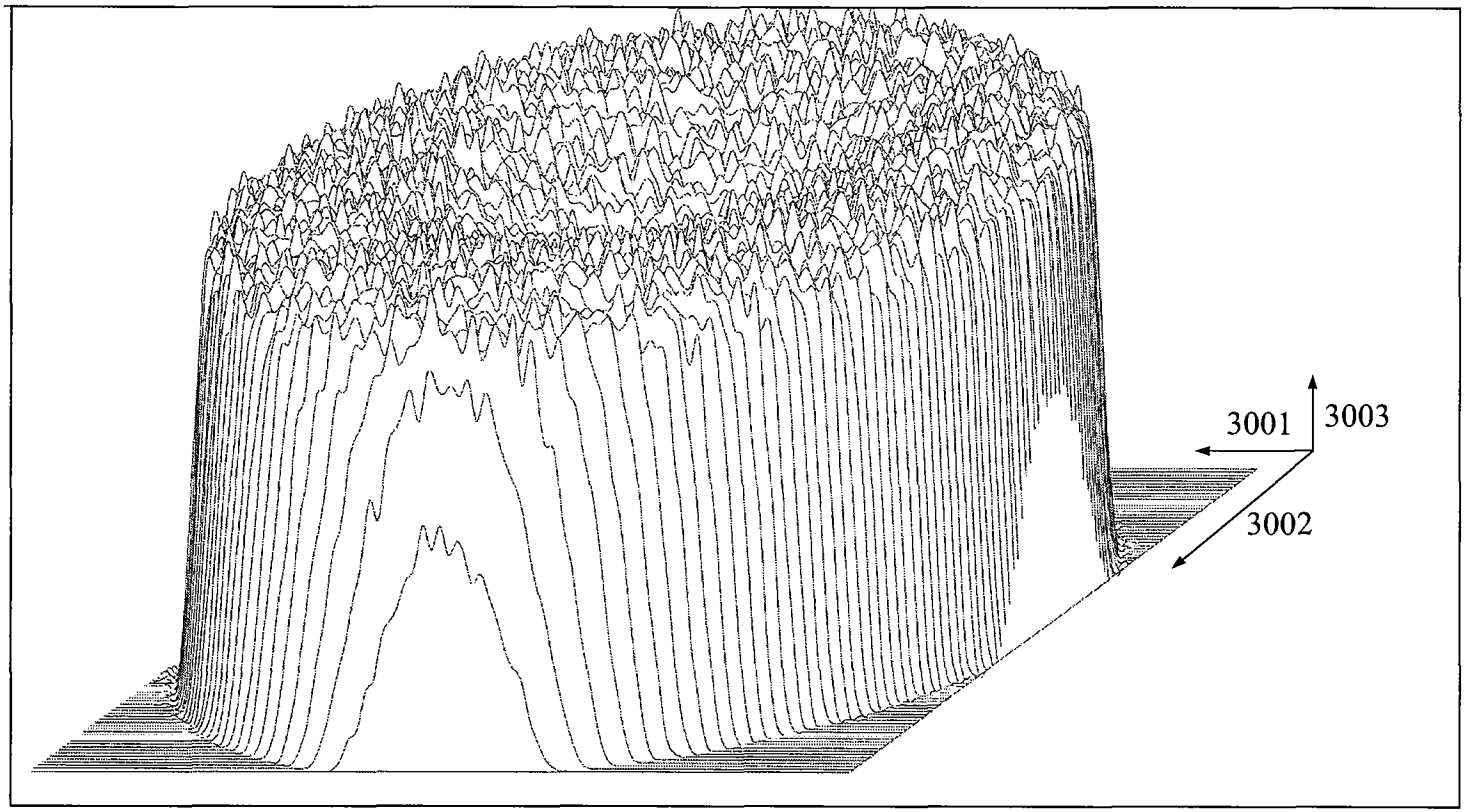
FIG. 3B shows the substantially even and uniform energy deposition profile upon rotation of the beam that provides the energy deposition profile of FIG. 3A.
Figure 4A:
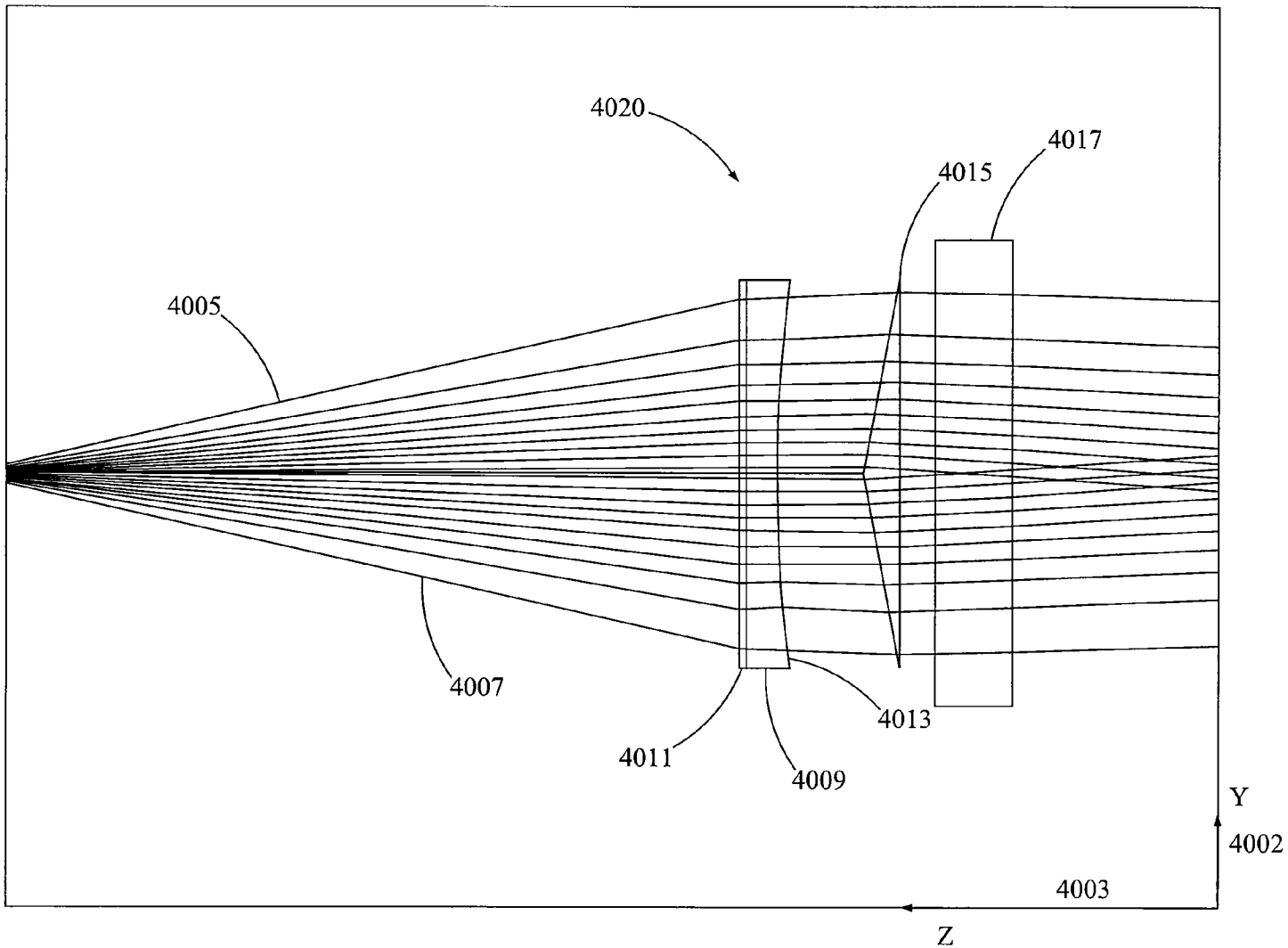
FIGS. 4A to 4D illustrate an optical assembly.
Figure 4B:
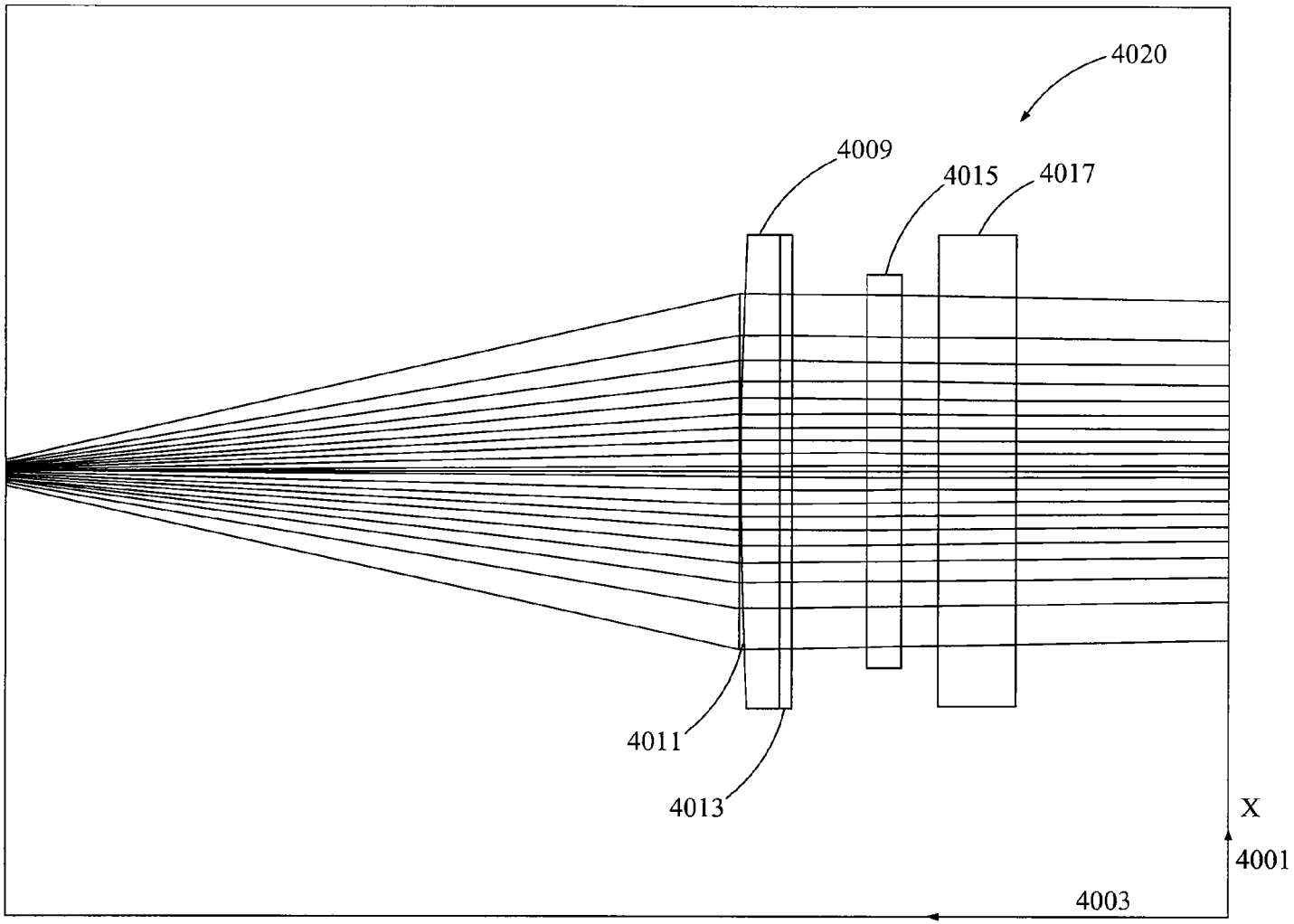
Figure 4C:
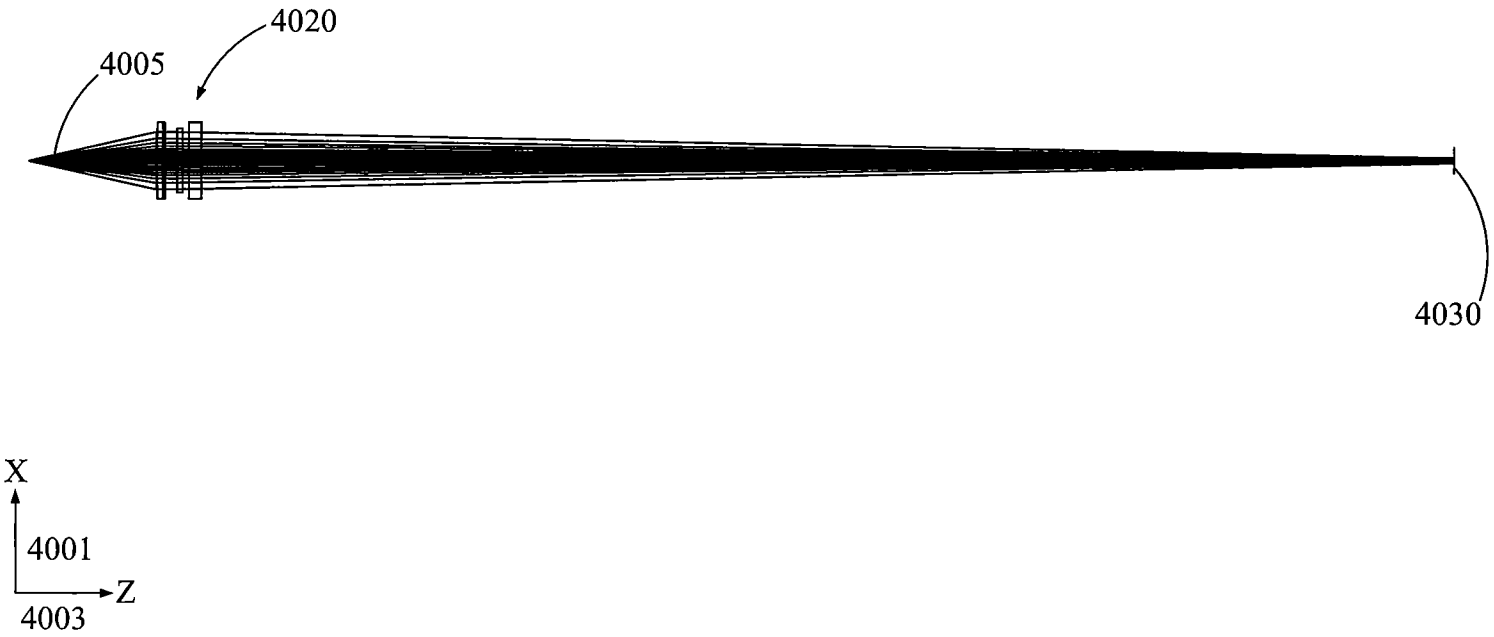
Figure 4D:
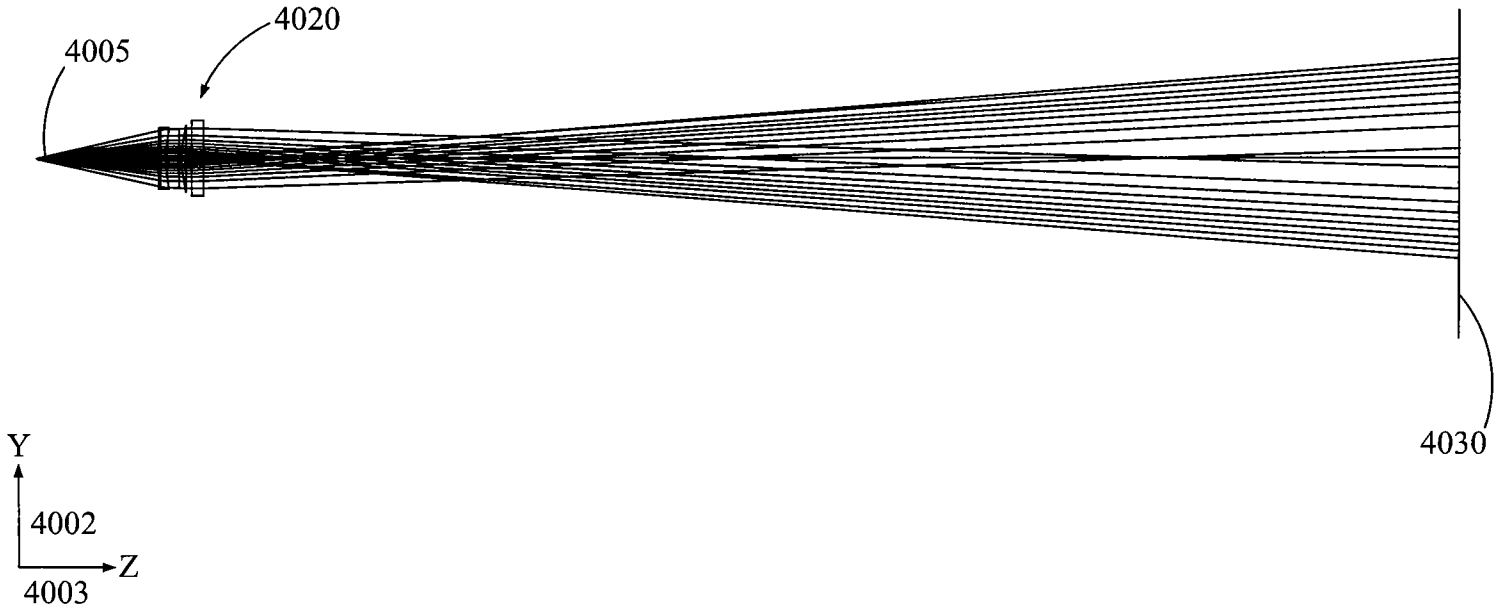

Thus, it is desirable to modify the beam deposition profile to obtain a substantially even and uniform deposition profile upon rotation of the beam. An example of such a preferred beam deposition profile is provided in FIGS. 3A and 3B, where FIG. 3A shows the energy deposition profile with no rotation, and FIG. 3B shows the energy deposition profile when the beam profile of 3A is rotated through one rotation, i.e., 360 degrees; having x and y axes 3001 and 3002 and energy on z axis 3003. This energy deposition distribution would be considered substantially uniform.

To obtain this preferable beam energy profile there are provided examples of optical assemblies that may be used with a LBHA. Thus, Example 1 is illustrated in FIGS. 4A to 4D, having x and y axes 4001 and 4002 and z axis 4003, wherein there is provided a laser beam 4005 having a plurality of rays 4007. The laser beam 4005 enters an optical assembly 4020, having a collimating lens 4009, having input curvature 4011 and an output curvature 4013. There is further provided an axicon lens 4015 and a window 4017. The optical assembly of Example 1 would provide a desired beam intensity profile from an input beam having a substantially Gaussian, Gaussian, or super-Gaussian distribution for applying the beam spot to a borehole surface 4030.

Figure 5:
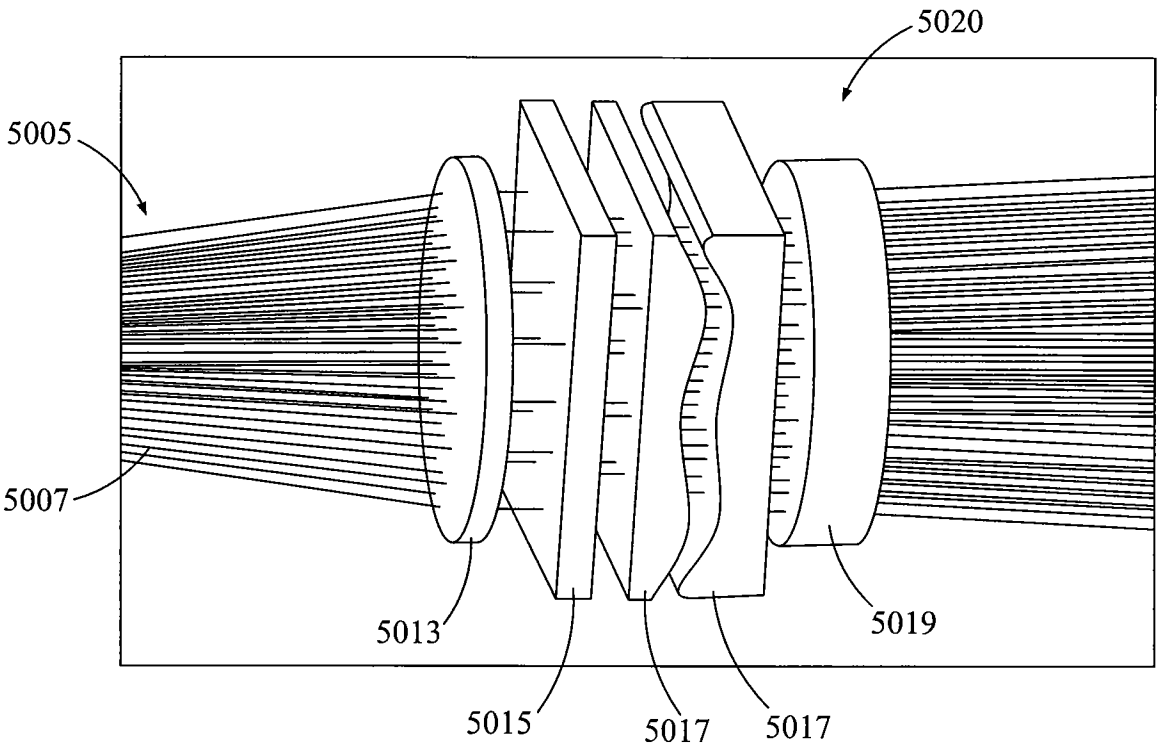
FIG. 5 illustrates an optical assembly.

Example 2 is illustrated in FIG. 5 and has an optical assembly 5020 for providing the desired beam intensity profile of FIG. 3A and energy deposition of FIG. 3B to a borehole surface from a laser beam having a uniform distribution. Thus, there is provided in Example 2 a laser beam 5005 having a uniform profile and rays 5007, that enters a spherical lens 5013, which collimates the output of the laser from the downhole end of the fiber, the beam then exits 5013 and enters a toroidal lens 5015, which has power in the x-axis to form the minor-axis of the elliptical beam. The beam then exits 5015 and enters a pair of aspherical toroidal lens 5017, which has power in the y-axis to map the y-axis intensity profiles form the pupil plane to the image plane. The beam then exits the lens 5017 and enters flat window 5019, which protects the optics from the outside environment.

Figure 6:
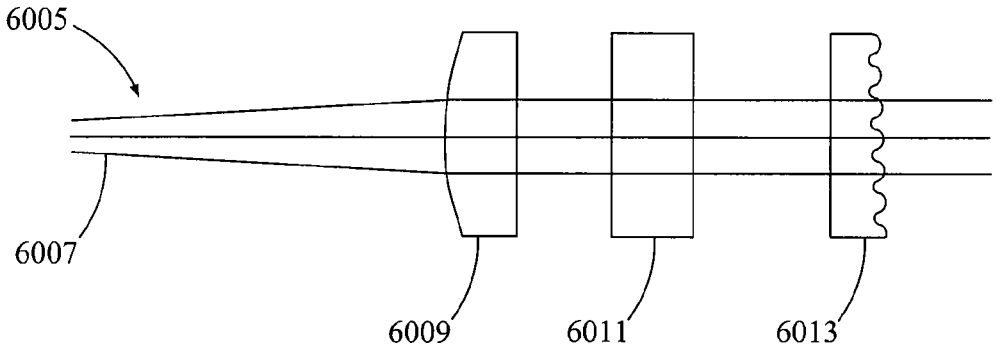
FIG. 6 illustrates an optical assembly.

Example 3 is illustrated in FIG. 6, which provides a further optical assembly for providing predetermined beam energy profiles. Thus, there is provided a laser beam 6005 having rays 6007, which enters collimating lens 6009, spot shape forming lens 6011, which is preferably an ellipse, and a micro optic array 6013. The micro optic array 6013 may be a microprism array, or a micro lens array. Further the micro optic array may be specifically designed to provide a predetermined energy deposition profile, such as the profile of FIG. 3.

Figure 7A:
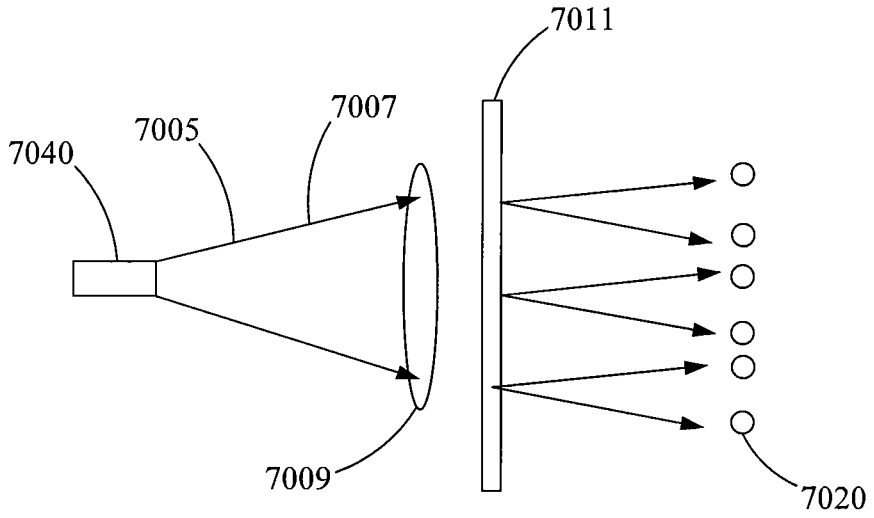
FIGS. 7A and 7B illustrate optical assemblies.
Figure 7B:
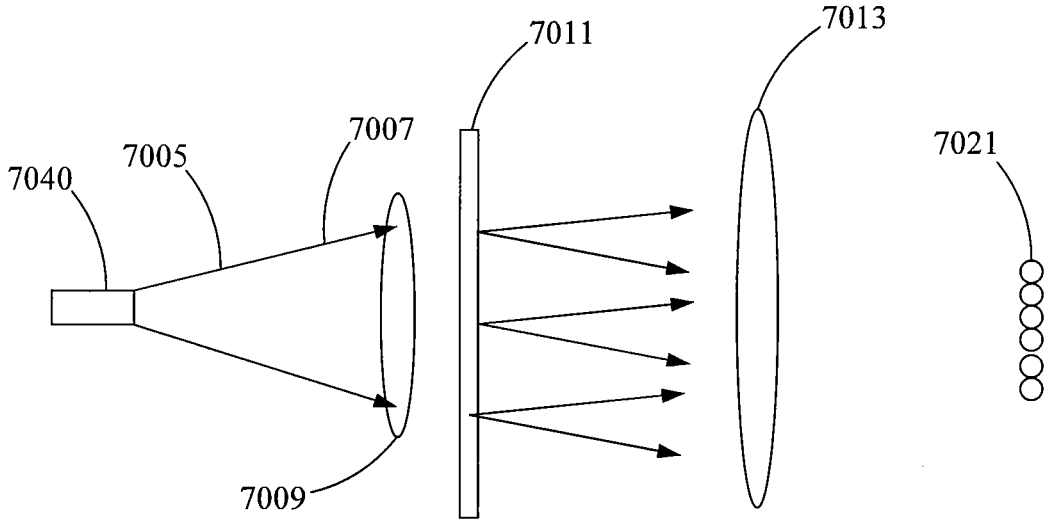

Example 4 is illustrated in FIG. 7, which provides an optical assembly for providing a predetermined beam pattern. Thus, there is provided a laser beam 7005, exiting the downhole end of fiber 7040, having rays 6007, which enters collimating lens 6009, a diffractive optic 7011, which could be a micro optic, or a corrective optic to a micro optic, that provides pattern 7020, which may but not necessary pass through reimaging lens 7013, which provides pattern 7021.

Figure 8:
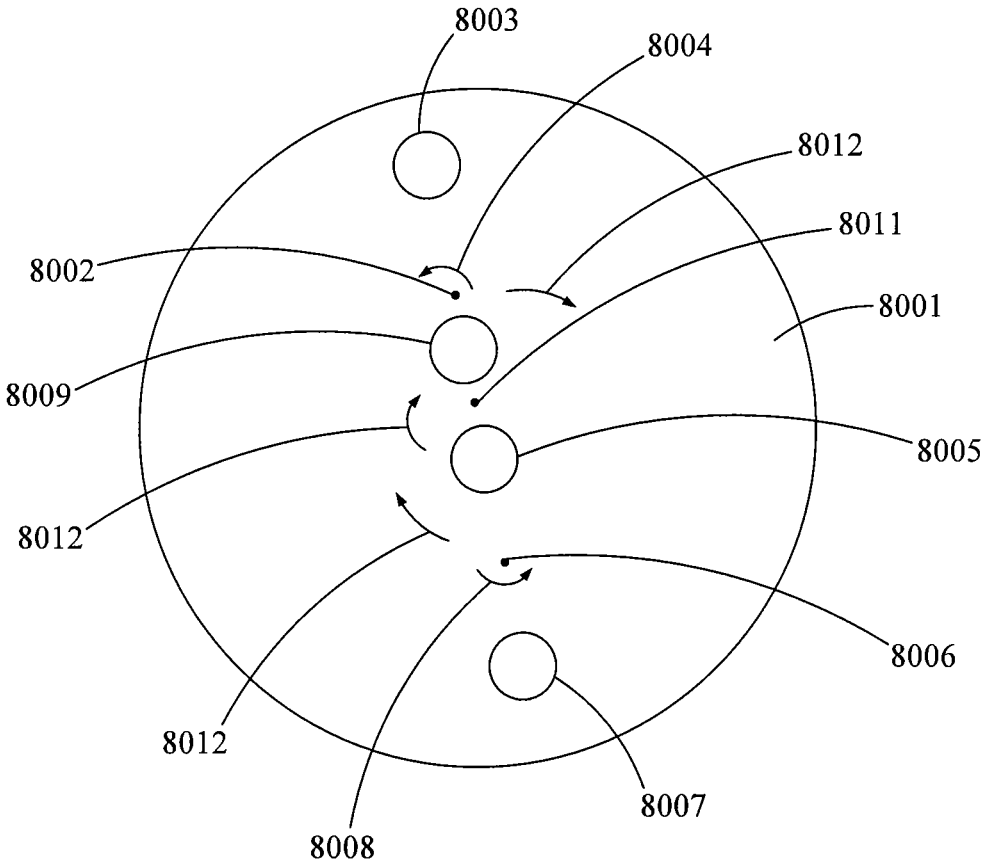
FIG. 8 illustrates a multi-rotating laser shot pattern.

There is further provided shot patterns for illuminating a borehole surface with a plurality of spots in a multi-rotating pattern. Accordingly in FIG. 8 there is provided a first pair of spots 8003, 8005, which illuminate the bottom surface 8001 of the borehole. The first pair of spots rotate about a first axis of rotation 8002 in the direction of rotation shown by arrow 8004 (the opposite direction of rotation is also contemplated herein). There is provided a second pair of spots 8007, 8009, which illuminate the bottom surface 8001 of the borehole. The second pair of shots rotate about axis 8006 in the direction of rotation shown by arrow 8008 (the opposite direction of rotation is also contemplated herein). The distance between the spots in each pair of spots may be the same or different. The first and second axis of rotation simultaneously rotate around the center of the borehole 8012 in a rotational direction, shown by arrows 8012, that is preferably in counter-rotation to the direction of rotation 8008, 8004. Thus, preferably although not necessarily, if 8008 and 8004 are clockwise, then 8012 should be counter-clockwise. This shot pattern provides for a substantially uniform energy deposition.

Figure 9:
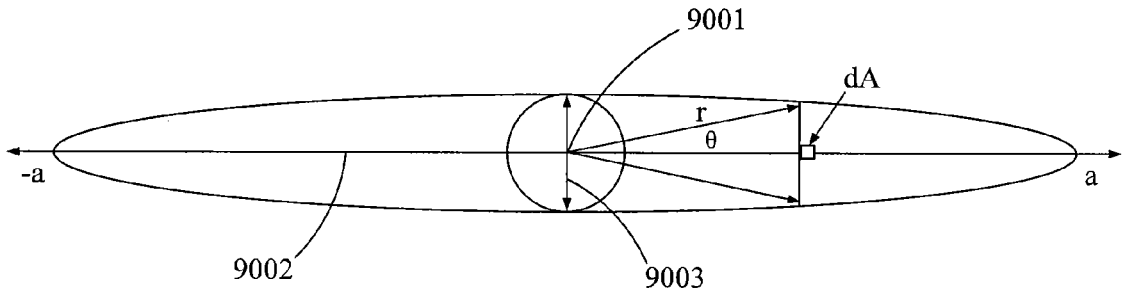
FIG. 9 illustrates an elliptical shaped shot.

There is illustrated in FIG. 9 an elliptical shot pattern of the general type discussed with respect to Examples 1 to 3 having a center 9001, a major axis 9002, a minor axis 9003 and is rotated about the center. In this way the major axis of the spot would generally correspond to the diameter of the borehole, ranging from any known or contemplated diameters such as about 30, 20, 17½, 13⅜, 12¼, 9⅝, 8½, 7, and 6¼ inches.

Figure 10:
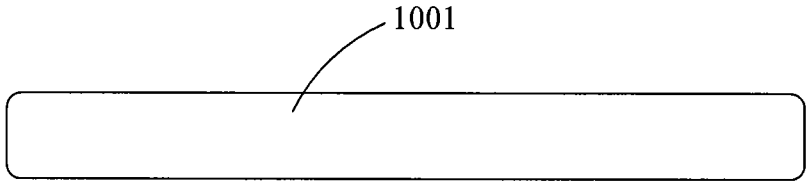
FIG. 10 illustrates a rectangular shaped spot.
Figure 11:
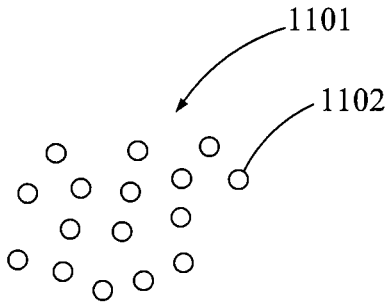
FIG. 11 illustrates a multi-shot shot pattern.
Figure 12:
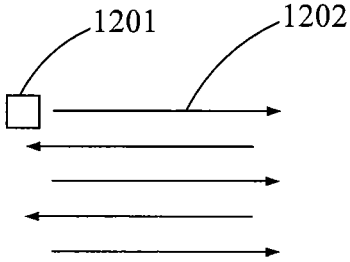
FIG. 12 illustrates a shot pattern.

There is further illustrated in FIG. 10 a rectangular shaped spot 1001 that would be rotated around the center of the borehole. There is illustrated in FIG. 11 a pattern 1101 that has a plurality of individual shots 1102 that may be rotated, scanned or moved with respect to the borehole to provide the desired energy deposition profile. The is further illustrated in FIG. 12 a squared shot 1201 that is scanned 1201 in a raster scan matter along the bottom of the borehole, further a circle, square or other shape shot may be scanned.

The LBHA, by way of example, may include one or more optical manipulators. An optical manipulator may generally control a laser beam, such as by directing or positioning the laser beam to remove material, such as rock. In some configurations, an optical manipulator may strategically guide a laser beam to remove material, such as rock. For example, spatial distance from a borehole wall or rock may be controlled, as well as impact angle. In some configurations, one or more steerable optical manipulators may control the direction and spatial width of the one or more laser beams by one or more reflective mirrors or crystal reflectors. In other configurations, the optical manipulator can be steered by, but steering means not being limited to, an electro-optic switch, electroactive polymers, galvanometers, piezoelectrics, rotary/linear motors, and/or active-phase control of an array of sources for electronic beam steering. In at least one configuration, an infrared diode laser or fiber laser optical head may generally rotate about a vertical axis to increase aperture contact length. Various programmable values such as specific energy, specific power, pulse rate, duration and the like may be implemented as a function of time. Thus, where to apply energy may be strategically determined, programmed and executed so as to enhance a rate of penetration, the efficiency of borehole advancement, and/or laser/rock interaction. One or more algorithms may be used to control the optical manipulator.

The LBHA and optics, in at least one aspect, provide that a beam spot pattern and continuous beam shape may be formed by a refractive, reflective, diffractive or transmissive grating optical element. refractive, reflective, diffractive or transmissive grating optical elements may be made, but are not limited to being made, of fused silica, quartz, ZnSe, Si, GaAs, polished metal, sapphire, and/or diamond. These may be, but are not limited to being, optically coated with the said materials to reduce or enhance the reflectivity.

In accordance with one or more aspects, one or more fiber optic distal fiber ends may be arranged in a pattern. The multiplexed beam shape may comprise a cross, an x shape, a viewfinder, a rectangle, a hexagon, lines in an array, or a related shape where lines, squares, and cylinders are connected or spaced at different distances.

In accordance with one or more aspects, one or more refractive lenses, diffractive elements, transmissive gratings, and/or reflective lenses may be added to focus, scan, and/or change the beam spot pattern from the beam spots emitting from the fiber optics that are positioned in a pattern. One or more refractive lenses, diffractive elements, transmissive gratings, and/or reflective lenses may be added to focus, scan, and/or change the one or more continuous beam shapes from the light emitted from the beam shaping optics. A collimator may be positioned after the beam spot shaper lens in the transversing optical path plane. The collimator may be an aspheric lens, spherical lens system composed of a convex lens, thick convex lens, negative meniscus, and bi-convex lens, gradient refractive lens with an aspheric profile and achromatic doublets. The collimator may be made of the said materials, fused silica, ZnSe, SF glass, or a related material. The collimator may be coated to reduce or enhance reflectivity or transmission. Said optical elements may be cooled by a purging liquid or gas.

In some aspects, the one or more fiber optics with one or more said optical elements and beam shaping optics may be steered in the z-direction to keep the focal path constant and rotated by a stepper motor, servo motors, piezoelectric motors, liquid or gas actuator motor, and electro-optics switches. The z-axis may be controlled by the drill string or mechanical standoff. The steering may be mounted to one or more stepper rails, gantry's, gimbals, hydraulic line, elevators, pistons, springs. The one or more fiber optics with one or more fiber optics with one or more said beam shaping optics and one or more collimator's may be rotated by a stepper motor, servo motors, piezoelectric motors, liquid or gas actuator motor, and electro-optic switch. The steering may be mounted to one or more stepper rails, gantry's, gimbals, hydraulic line, elevators, pistons, springs.

In some aspects, the fiber optics and said one or more optical elements lenses and beam shaping optics may be encased in a protective optical head made of, for example, the materials steel, chrome-moly steel, steel cladded with hardface materials such as an alloy of chromium-nickel-cobalt, titanium, tungsten carbide, diamond, sapphire, or other suitable materials known to those in the art which may have a transmissive window cut out to emit the light through the optical head.

In accordance with one or more aspects, a laser source may be coupled to a plurality of optical fiber bundles with the distal end of the fiber arranged to combine fibers together to form bundle pairs, such that the power density through one fiber bundle pair is within the material removal zone and one or more beam spots illuminate the material, such as rock with the bundle pairs arranged in a pattern to remove or displace the rock formation.

In accordance with one or more aspects, the pattern of the bundle pairs may be spaced in such a way that the light from the fiber bundle pairs emerge in one or more beam spot patterns that comprise the geometry of a rectangular grid, a circle, a hexagon, a cross, a star, a bowtie, a triangle, multiple lines in an array, multiple lines spaced a distance apart non-linearly, an ellipse, two or more lines at an angle, or a related shape. The pattern of the bundle pairs may be spaced in such a way that the light from the fiber bundles emerge as one or more continuous beam shapes that comprise above geometries. A collimator may be positioned at a said distance in the same plane below the distal end of the fiber bundle pairs. One or more beam shaping optics may be positioned at a distance in the same plane below the distal end of the fiber bundle pairs. An optical element such as a non-axis-symmetric lens may be positioned at a said distance in the same plane below the distal end of the fiber bundle pairs. Said optical elements may be positioned at an angle to the rock formation and rotated on an axis.

In accordance with one or more aspects, the distal fiber end made up of fiber bundle pairs may be steered in the X,Y,Z, planes and rotationally using a stepper motor, servo motors, piezoelectric motors, liquid or gas actuator motor. The distal fiber end may be made up of fiber bundle pairs being steered with a collimator or other optical element, which could be an objective, such as a non-axis-symmetric optical element. The steering may be mounted to one or more mechanical, hydraulic, or electro-mechanical element to move the optical element. The distal end of fiber bundle pairs, and optics may be protected as described above. The optical fibers may be single-mode and/or multimode. The optical fiber bundles may be composed of single-mode and/or multimode fibers.

In some aspects, the optical fibers may be entirely constructed of glass, hollow core photonic crystals, and/or solid core photonic crystals. The optical fibers may be jacketed with materials such as, polyimide, acrylate, carbon polyamide, or carbon/dual acrylate. Light may be sourced from a diode laser, disk laser, chemical laser, fiber laser, or fiber optic source is focused by one or more positive refractive lenses. Further, examples of fibers useful for the transmission of high powered laser energy over long distance in conjunction with the present invention are provided in patent application Ser. No. 12/544,136 filed contemporaneously herewith the disclosure of which is incorporated herein.

In at least one aspect, the positive refractive lens types may include, a non-axis-symmetric optic such as a plano-convex lens, a biconvex lens, a positive meniscus lens, or a gradient refractive index lens with a plano-convex gradient profile, a biconvex gradient profile, or positive meniscus gradient profile to focus one or more beams spots to the rock formation. A positive refractive lens may be comprised of the materials, fused silica, sapphire, ZnSe, or diamond. Said refractive lens optical elements can be steered in the light propagating plane to increase/decrease the focal length. The light output from the fiber optic source may originate from a plurality of one or more optical fiber bundle pairs forming a beam shape or beam spot pattern and propagating the light to the one or more positive refractive lenses.

It is readily understood in the art that the terms lens and optic(al) elements, as used herein is used in its broadest terms and thus may also refer to any optical elements with power, such as reflective, transmissive or refractive elements, In some aspects, the refractive positive lens may be a microlens. The microlens can be steered in the light propagating plane to increase/decrease the focal length as well as perpendicular to the light propagating plane to translate the beam. The microlens may receive incident light to focus to multiple foci from one or more optical fibers, optical fiber bundle pairs, fiber lasers, diode lasers; and receive and send light from one or more collimators, positive refractive lenses, negative refractive lenses, one or more mirrors, diffractive and reflective optical beam expanders, and prisms.

In some aspects, a diffractive optical element beam splitter could be used in conjunction with a refractive lens. The diffractive optical element beam splitter may form double beam spots or a pattern of beam spots comprising the shapes and patterns set forth above.

In at least one aspect, the positive refractive lens may focus the multiple beam spots to multiple foci. To remove or displace the rock formation.

In accordance with one or more aspects, a collimator lens may be positioned in the same plane and in front of a refractive or reflective diffraction beam splitter to form a beam spot pattern or beam shape; where a beam expander feeds the light into the collimator. The optical elements may be positioned in the X,Y,Z plane and rotated mechanically.

In accordance with one or more aspects, the laser beam spot to the transversing mirror may be controlled by a beam expander. The beam expander may expand the size of the beam and send the beam to a collimator and then to a scanner of two mirrors positioning the laser beam in the XY, YZ, or XZ axis. A beam expander may expand the size of the beam and sends the beam to a collimator, then to a diffractive or reflective optical element, and then to a scanner of two mirrors positioning the laser beam in the XY, YZ, or XZ axis. A beam expander may expand the size of the beam and send the beam to a beam splitter attached behind a positive refractive lens, that splits the beam and focuses is, to a scanner of two mirrors positioning the laser beam in the XY, YZ, or XZ axis.

In some aspects, the material, such as a rock surface may be imaged by a camera downhole. Data received by the camera may be used to remove or displace the rock. Further spectroscopy may be used to determine the rock morphology, which information may be used to determine process parameters for removal of material.

In at least one aspect, a gas or liquid purge is employed. The purge gas or liquid may remove or displace the cuttings, rock, or other debris from the borehole. The fluid temperature may be varied to enhance rock removal, and provide cooling.

In accordance with some embodiments, one or more beam shaping optics may generate one or more beam spot lines, circles or squares from the light emitted by one or more fiber optics or fiber optic bundles. The beam shapes generated by a beam shaper may comprise of being Gaussian, a circular top-hat ring, or line, or rectangle, a polynomial towards the edge ring, or line, or rectangle, a polynomial towards the center ring, or line, or rectangle, a X or Y axis polynomial in a ring, or line, or rectangle, or a asymmetric beam shape beams. One or more beam shaping optics can be positioned in a pattern to form beam shapes. In another embodiment, an optic can be positioned to refocus light from one or more fiber optics or plurality of fiber optics. The optic can be positioned after the beam spot shaper lens to increase the working distance. In another embodiment, diffractive or reflective optical element may be positioned in front of one or more fiber optics or plurality of fiber optics. A positive refractive lens may be added after the diffractive or reflective optical element to focus the beam pattern or shape to multiple foci.

Refractive optics that are useful and may be employed with the present invention include but are not limited to: (i) negative lenses, such as biconcave, plano-concave, negative meniscus, or a gradient refractive index with a plano-concave profile, biconvex, or negative meniscus; and, positive lenses such as one or more positive refractive lens profiles may comprise of biconvex, positive meniscus, or gradient refractive index lens with a plano-convex gradient profile, a biconvex gradient profile, or positive meniscus, such refractive lenses may be flat, cylindrical, spherical, aspherical, or a molded shape. The refractive lens material may be made of any desired material, such as fused silica, ZnSe, sapphire, quartz or diamond.

One or more embodiments may generally include one or more features to protect the optical element system and/or fiber laser downhole. In accordance with one or more embodiments, reflective and refractive lenses may include a cooling system, such as a fluid jet associated with the optics.

In accordance with one or more embodiments, the one or more lasers, fibers, or plurality of fiber bundles and the optical element systems to generate one or more beam spots, shape, or patterns from the above light emitting sources forming an optical head may be protected from downhole pressure and environments by being encased in an appropriate material. Such materials may include steel, titanium, diamond, tungsten carbide, composites and the like as well as the other materials provided herein and known to those skilled in the art. A transmissive window may be made of a material that can withstand the downhole environment, while retaining transmissive qualities. One such material may be sapphire or other materials with similar qualities. An optical head may be entirely encased by sapphire. In at least one embodiment, the optical head may be made of diamond, tungsten carbide, steel, and titanium other than part where the laser beam is emitted.

In accordance with one or more embodiments, the fiber optics forming a pattern can send any desired amount of power. In some non-limiting embodiments, fiber optics may send up to 10 kW or more per a fiber. The fibers may transmit any desired wavelength. In some embodiments, the range of wavelengths the fiber can transmit may preferably be between about 800 nm and 2100 nm. The fiber can be connected by a connector to another fiber to maintain the proper fixed distance between one fiber and neighboring fibers. For example, fibers can be connected such that the beam spot from neighboring optical fibers when irradiating the material, such as a rock surface are non-overlapping to the particular optical fiber. The fiber may have any desired core size. In some embodiments, the core size may range from about 50 microns to 600 microns. The fiber can be single mode or multimode. If multimode, the numerical aperture of some embodiments may range from 0.1 to 0.6. A lower numerical aperture may be preferred for beam quality, and a higher numerical aperture may be easier to transmit higher powers with lower interface losses. In some embodiments, a fiber laser emitted light at wavelengths comprised of 1060 nm to 1080 nm, 1530 nm to 1600 nm, 1800 nm to 2100 nm, diode lasers from 400 nm to 1600 nm, $C0_2$ Laser at 110,600 nm, or Nd:YAG Laser emitting at 1064 nm can couple to the optical fibers. In some embodiments, the fiber can have a low water content. The fiber can be jacketed, such as with polyimide, acrylate, carbon polyamide, and carbon/dual acrylate or other material. If requiring high temperatures, a polyimide or a derivative material may be used to operate at temperatures over 300 degrees Celsius. By way of example, the fibers may be a fused silica step index fiber, a hollow core fiber, such as a hollow core photonic crystal, or solid core fiber, such as a solid core photonic crystal, or combinations of these. In some embodiments, using hollow core photonic crystal fibers at wavelengths of 1500 nm or higher may minimize absorption losses.

The use of the plurality of optical fibers can be bundled into a number of configurations to improve power density. The optical fibers forming a bundle may range from two fibers at hundreds of watts to kilowatt powers in each fiber to millions of fibers at milliwatts or microwatts of power.

In accordance with one or more embodiments, one or more diode lasers can be sent downhole with an optical element system to form one or more beam spots, shapes, or patterns. In some embodiments, more than one diode laser may couple to fiber optics, where the fiber optics or a plurality of, fiber optic bundles form a pattern of beam spots irradiating the material, such as a rock surface.

Figure 13A:
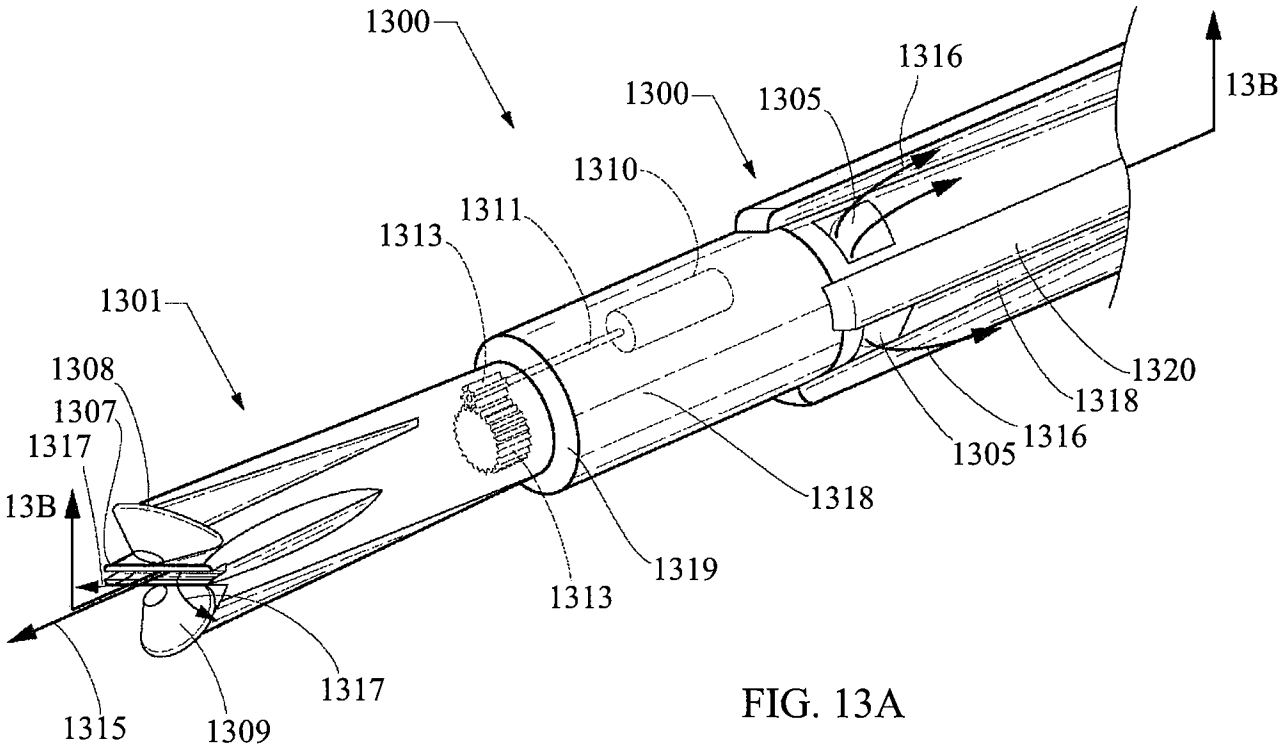
FIG. 13A is a perspective view of an LBHA.

Thus, by way of example, an LBHA that may employ the optical assemblies of the present invention or provide a laser beam with energy profiles of the present invention is illustrated in FIGS. 13A and B, which are collectively referred as FIG. 1. Thus, there is provided a LBHA 1340, which has an upper part 1300 and a lower part 1301. The upper part 1300 has housing 1318 and the lower part 1301 has housing 1319. The LBHA 1340, the upper part 1300, the lower part 1301 and in particular the housings 1318, 1319 should be constructed of materials and designed structurally to withstand the extreme conditions of the deep downhole environment and protect any of the components that are contained within them.

The upper part 1300 may be connected to the lower end of the coiled tubing, drill pipe, or other means to lower and retrieve the LBHA 1340 from the borehole. Further, it may be connected to stabilizers, drill collars, or other types of downhole assemblies (not shown in the figure), which in turn are connected to the lower end of the coiled tubing, drill pipe, or other means to lower and retrieve the LBHA 1340 from the borehole. The upper part 1300 further contains, is connect to, or otherwise optically associated with the means 1302 that transmitted the high power laser beam down the borehole so that the beam exits the lower end 1303 of the means 1302 and ultimately exist the LBHA 1340 to strike the intended surface of the borehole. The beam path of the high power laser beam is shown by arrow 1315. In FIG. 1 the means 1302 is shown as a single optical fiber. The upper part 1300 may also have air amplification nozzles 1305 that discharge the drilling fluid, for example $N_2$, to among other things assist in the removal of cuttings up the borehole.

The upper part 1300 further is attached to, connected to or otherwise associated with a means to provide rotational movement 1310. Such means, for example, would be a downhole motor, an electric motor or a mud motor. The motor may be connected by way of an axle, drive shaft, drive train, gear, or other such means to transfer rotational motion 1311, to the lower part 1301 of the LBHA 1340. It is understood, as shown in the drawings for purposes of illustrating the underlying apparatus, that a housing or protective cowling may be placed over the drive means or otherwise associated with it and the motor to protect it form debris and harsh downhole conditions. In this manner the motor would enable the lower part 1301 of the LBHA 1340 to rotate. An example of a mud motor is the CAVO 1.7" diameter mud motor. This motor is about 7 ft long and has the following specifications: 7 horsepower@110 ft-lbs full torque; motor speed 0-700 rpm; motor can run on mud, air, $N_2$, mist, or foam; 180 SCFM, 500-800 psig drop; support equipment extends length to 12 ft; 10:1 gear ratio provides 0-70 rpm capability; and has the capability to rotate the lower part 1301 of the LBHA through potential stall conditions.

Figure 13B:
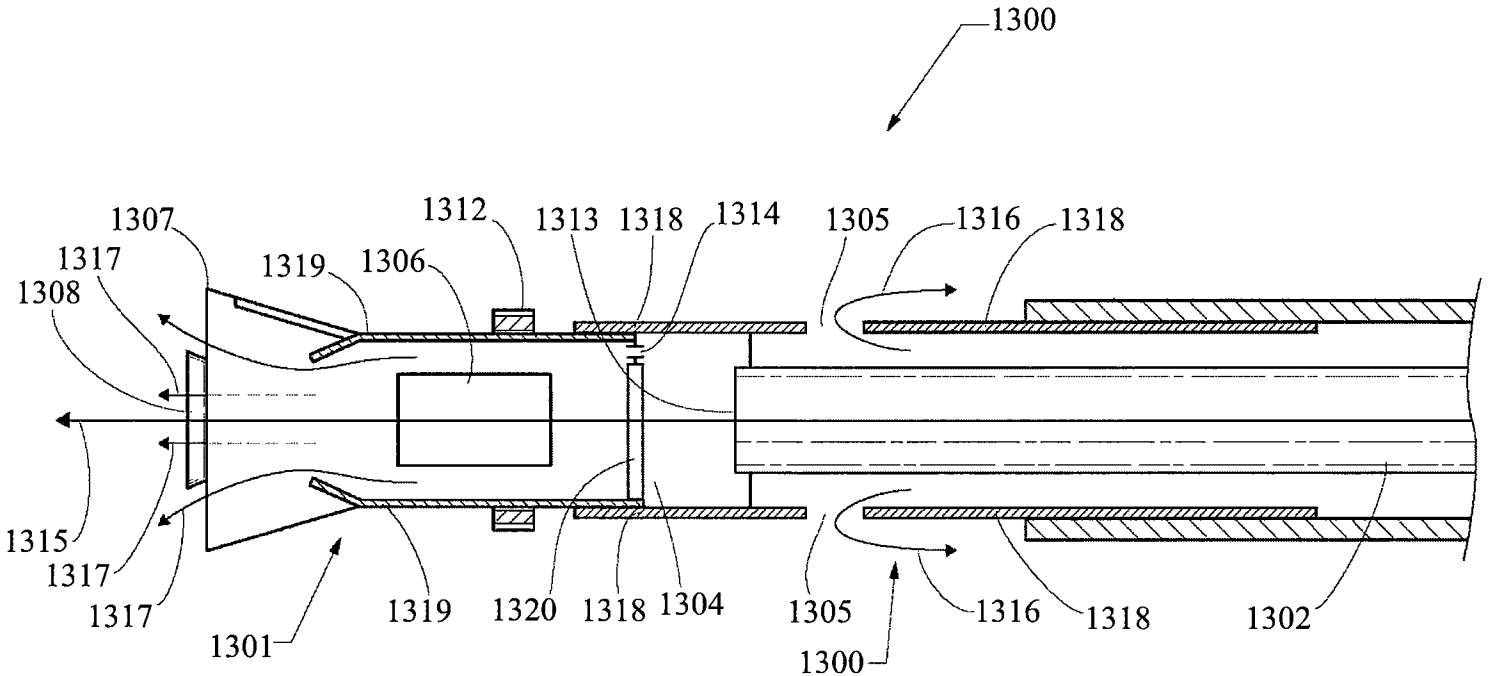
FIG. 13B is a cross sectional view of the LBHA of FIG. 13A taken along B-B.

The upper part 1300 of the LBHA 1340 is joined to the lower part 1301 with a sealed chamber 1304 that is transparent to the laser beam and forms a pupil plane 1320 to permit unobstructed transmission of the laser beam to the beam shaping optics 1306 in the lower part 1301. The lower part 1301 is designed to rotate. The sealed chamber 1304 is in fluid communication with the lower chamber 1301 through port 1314. Port 1314 may be a one way valve that permits clean transmissive fluid and preferably gas to flow from the upper part 1300 to the lower part 1301, but does not permit reverse flow, or if may be another type of pressure and/or flow regulating value that meets the particular requirements of desired flow and distribution of fluid in the downhole environment. Thus, for example there is provided in FIG. 1 a first fluid flow path, shown by arrows 1316, and a second fluid flow path, shown by arrows 1317. In the example of FIG. 13 the second fluid flow path is a laminar flow, however, other non-laminar flows and low turbulent flows are permissible.

The lower part 1301 has a means for receiving rotational force from the motor 1310, which in the example of the figure is a gear 1312 located around the lower part housing 1319 and a drive gear 1313 located at the lower end of the axle 1311. Other means for transferring rotational power may be employed or the motor may be positioned directly on the lower part. It being understood that an equivalent apparatus may be employed which provide for the rotation of the portion of the LBHA to facilitate rotation or movement of the laser beam spot while that he same time not providing undue rotation, or twisting forces, to the optical fiber or other means transmitting the high power laser beam down the hole to the LBHA. In his way laser beam spot can be rotated around the bottom of the borehole. The lower part 1301 has a laminar flow outlet 1307 for the fluid to exit the LBHA 1300, and two hardened rollers 1308, 1309 at its lower end.

The two hardened rollers may be made of a stainless steel or a steel with a hard face coating such as tungsten carbide, chromium-cobalt-nickel alloy, or other similar materials. They may also contain a means for mechanically cutting rock that has been thermally degraded by the laser. They may range in length from about 1 in to about 4 inches and preferably are about 2-3 inches and may be as large as or larger than 6 inches. (Length as used herein refers to the longest dimension of the roller.) Moreover in LBHAs for drilling larger diameter boreholes they may be in the range of 6 to 10-20 to 30 inches in diameter.

Thus, FIG. 13 provides for a high power laser beam path 1315 that enters the LBHA 1340, travels through beam spot shaping optics 1306, and then exits the LBHA to strike its intended target on the surface of a borehole. Further, although it is not required, the beam spot shaping optics may also provide a rotational element to the spot, and if so, would be considered to be beam rotational and shaping spot optics.

In use the high energy laser beam, for example greater than 15 kW, would enter the LBHA 1300, travel down fiber 1302, exit the end of the fiber 1303 and travel through the sealed chamber 1304 and pupil plane 1320 into the optics 1306, where it would be shaped and focused into a spot, the optics 1306 would further rotate the spot. The laser beam would then illuminate, in a potentially rotating manner, the bottom of the borehole spalling, chipping melting and/or vaporizing the rock and earth illuminated and thus advance the borehole. The lower part would be rotating and this rotation would further cause the rollers 1308, 1309 to physically dislodge any material that was effected by the laser or otherwise sufficiently fixed to not be able to be removed by the flow of the drilling fluid alone.

The cuttings would be cleared from the laser path by the flow of the fluid along the path 1317, as well as, by the action of the rollers 2008, 2009 and the cuttings would then be carried up the borehole by the action of the drilling fluid from the air amplifiers 1305, as well as, the laminar flow opening 1307.

It is understood that the configuration of the LBHA is FIG. 13 is by way of example and that other configurations of its components are available to accomplish the same results. Thus, the motor may be located in the lower part rather than the upper part, the motor may be located in the upper part but only turn the optics in the lower part and not the housing. The optics may further be located in both the upper and lower parts, which the optics for rotation being positioned in that part which rotates. The motor may be located in the lower part but only rotate the optics and the rollers. In this later configuration the upper and lower parts could be the same, i.e., there would only be one part to the LBHA. Thus, for example the inner portion of the LBHA may rotate while the outer portion is stationary or vice versa, similarly the top and/or bottom portions may rotate or various combinations of rotating and non-rotating components may be employed, to provide for a means for the laser beam spot to be moved around the bottom of the borehole.

In general, and by way of further example, the LBHA may comprise a housing, which may by way of example, be made up of sub-housings. These sub-housings may be integral, they may be separable, they may be removably fixedly connected, they may be rotatable, or there may be any combination of one or more of these types of relationships between the sub-housings. The LBHA may be connected to the lower end of the coiled tubing, drill pipe, or other means to lower and retrieve the LBHA from the borehole. Further, it may be connected to stabilizers, drill collars, or other types of downhole assemblies, which in turn are connected to the lower end of the coiled tubing, drill pipe, or other means to lower and retrieve the bottom hole assembly from the borehole. The LBHA has associated therewith a means that transmitted the high power energy from down the borehole.

The LBHA may also have associated with, or in, it means to handle and deliver drilling fluids. These means may be associated with some or all of the sub-housings. There are further provided mechanical scraping means, e.g. a PDC bit, to remove and/or direct material in the borehole, although other types of known bits and/or mechanical drilling heads by also be employed in conjunction with the laser beam. These scrapers or bits may be mechanically interacted with the surface or parts of the borehole to loosen, remove, scrap or manipulate such borehole material as needed. These scrapers may be from less than about 1 inch to about 20 inches or more in length. These types of mechanical means which may be crushing, cutting, gouging scraping, grinding, pulverizing, and shearing tools, or other tools used for mechanical removal of material from a borehole, may be employed in conjunction with or association with a LBHA. As used herein the "length" of such tools refers to its longest dimension. In use the high energy laser beam, for example greater than 15 kW, would travel down the fibers through optics and then out the lower end of the LBHA to illuminate the intended part of the borehole, or structure contained therein, spalling, chipping, melting and/or vaporizing the material so illuminated and thus advance the borehole or otherwise facilitating the removal of the material so illuminated.

The optics 1306 should be selected to avoid or at least minimize the loss of power as the laser beam travels through them. The optics should further be designed to handle the extreme conditions present in the downhole environment, at least to the extent that those conditions are not mitigated by the housing 1319. The optics may provide laser beam spots of differing power distributions and shapes as set forth herein above. The optics may further provide a single spot or multiple spots as set forth herein above. Further examples and teaching of LBHAs are disclosed in greater detail in co-pending U.S. patent application Ser. No. 12/544,038, and Ser. No. 12/543,968, filed contemporaneously herewith, the disclosures of which are incorporate herein by reference in their entirety.

In general, the output at the end of the fiber cable may consist of one or many optical fibers. The beam shape at the rock once determined can be created by either reimaging the fiber (bundle), collimating the fiber (bundle) and then transforming it to the Fourier plane to provide a homogeneous illumination of the rock surface, or after collimation a diffractive optic, micro-optic or axicon array could be used to create the beam patterned desired. This beam pattern can be applied directly to the rock surface or reimaged, or Fourier transformed to the rock surface to achieve the desired pattern. The processing head may include a dichroic splitter to allow the integration of a camera or a fiber optic imaging system monitoring system into the processing head to allow progress to be monitored and problem to be diagnosed.

Drilling may be conducted in a dry environment or a wet environment. An important factor is that the path from the laser to the rock surface should be kept as clear as practical of debris and dust particles or other material that would interfere with the delivery of the laser beam to the rock surface. The use of high brightness lasers provides another advantage at the process head, where long standoff distances from the last optic to the work piece are important to keeping the high pressure optical window clean and intact through the drilling process. The beam can either be positioned statically or moved mechanically, opto-mechanically, electro-optically, electromechanically, or any combination of the above to illuminate the earth region of interest.

Figure 14:
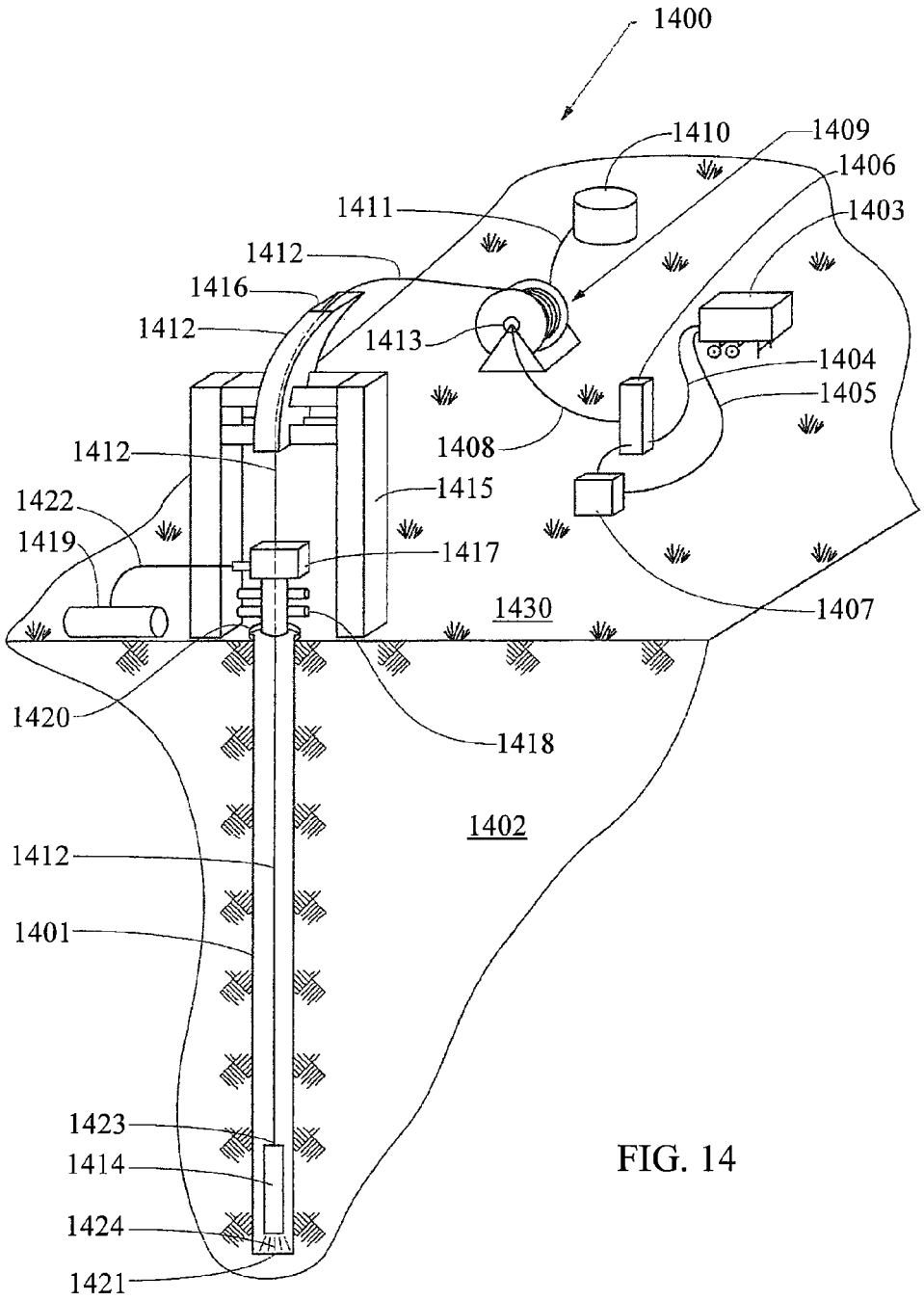
FIG. 14 is a laser drilling system.

Thus, in general, and by way of example, there is provided in FIG. 14 a high efficiency laser drilling system, including an LBHA, which may use the optics of the present invention and which may employ the laser shot patterns, and energy deposition profiles of the present invention. Such systems are disclosed in greater detail in co-pending U.S. patent application Ser. No. 12/544,136, filed contemporaneously herewith, the disclosure of which is incorporate herein by reference in its entirety.

Thus, in general, and by way of example, there is provided in FIG. 14 a high efficiency laser drilling system 1400 for creating a borehole 1401 in the earth 1402. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

FIG. 14 provides a cut away perspective view showing the surface of the earth 1430 and a cut away of the earth below the surface 1402. In general and by way of example, there is provided a source of electrical power 1403, which provides electrical power by cables 1404 and 1405 to a laser 1406 and a chiller 1407 for the laser 1406. The laser provides a laser beam, i.e., laser energy, that can be conveyed by a laser beam transmission means 1408 to a spool of coiled tubing 1409. A source of fluid 1410 is provided. The fluid is conveyed by fluid conveyance means 1411 to the spool of coiled tubing 1409.

The spool of coiled tubing 1409 is rotated to advance and retract the coiled tubing 1412. Thus, the laser beam transmission means 1408 and the fluid conveyance means 1411 are attached to the spool of coiled tubing 1409 by means of rotating coupling means 1413. The coiled tubing 1412 contains a means to transmit the laser beam along the entire length of the coiled tubing, i.e., "long distance high power laser beam transmission means," to the bottom hole assembly, 1414. The coiled tubing 1412 also contains a means to convey the fluid along the entire length of the coiled tubing 1412 to the bottom hole assembly 1414.

Additionally, there is provided a support structure 1415, which for example could be derrick, crane, mast, tripod, or other similar type of structure. The support structure holds an injector 1416, to facilitate movement of the coiled tubing 1412 in the borehole 1401. As the borehole is advance to greater depths from the surface 1430, the use of a diverter 1417, a blow out preventer (BOP) 1418, and a fluid and/or cutting handling system 1419 may become necessary. The coiled tubing 1412 is passed from the injector 1416 through the diverter 1417, the BOP 1418, a wellhead 1420 and into the borehole 1401.

The fluid is conveyed to the bottom 1421 of the borehole 1401. At that point the fluid exits at or near the bottom hole assembly 1414 and is used, among other things, to carry the cuttings, which are created from advancing a borehole, back up and out of the borehole. Thus, the diverter 1417 directs the fluid as it returns carrying the cuttings to the fluid and/or cuttings handling system 1419 through connector 1422. This handling system 1419 is intended to prevent waste products from escaping into the environment and either vents the fluid to the air, if permissible environmentally and economically, as would be the case if the fluid was nitrogen, returns the cleaned fluid to the source of fluid 1410, or otherwise contains the used fluid for later treatment and/or disposal.

The BOP 1418 serves to provide multiple levels of emergency shutoff and/or containment of the borehole should a high-pressure event occur in the borehole, such as a potential blow-out of the well. The BOP is affixed to the wellhead 1420. The wellhead in turn may be attached to casing. For the purposes of simplification the structural components of a borehole such as casing, hangers, and cement are not shown. It is understood that these components may be used and will vary based upon the depth, type, and geology of the borehole, as well as, other factors.

The downhole end 1423 of the coiled tubing 1412 is connect to the bottom hole assembly 1414. The bottom hole assemble 1414 contains optics for delivering the laser beam 1424 to its intended target, in the case of FIG. 4, the bottom 1421 of the borehole 1401. The bottom hole assemble 1414, for example, also contains means for delivering the fluid.

Thus, in general this system operates to create and/or advance a borehole by having the laser create laser energy in the form of a laser beam. The laser beam is then transmitted from the laser through the spool and into the coiled tubing. At which point, the laser beam is then transmitted to the bottom hole assembly where it is directed toward the surfaces of the earth and/or borehole. Upon contacting the surface of the earth and/or borehole the laser beam has sufficient power to cut, or otherwise effect, the rock and earth creating and/or advancing the borehole. The laser beam at the point of contact has sufficient power and is directed to the rock and earth in such a manner that it is capable of borehole creation that is comparable to or superior to a conventional mechanical drilling operation. Depending upon the type of earth and rock and the properties of the laser beam this cutting occurs through spalling, thermal dissociation, melting, vaporization and combinations of these phenomena.

Although not being bound by the present theory, it is presently believed that the laser material interaction entails the interaction of the laser and a fluid or media to clear the area of laser illumination. Thus the laser illumination creates a surface event and the fluid impinging on the surface rapidly transports the debris, i.e. cuttings and waste, out of the illumination region. The fluid is further believed to remove heat either on the macro or micro scale from the area of illumination, the area of post-illumination, as well as the borehole, or other media being cut, such as in the case of perforation.

The fluid then carries the cuttings up and out of the borehole. As the borehole is advanced the coiled tubing is unspooled and lowered further into the borehole. In this way the appropriate distance between the bottom hole assembly and the bottom of the borehole can be maintained. If the bottom hole assembly needs to be removed from the borehole, for example to case the well, the spool is wound up, resulting in the coiled tubing being pulled from the borehole. Additionally, the laser beam may be directed by the bottom hole assembly or other laser directing tool that is placed down the borehole to perform operations such as perforating, controlled perforating, cutting of casing, and removal of plugs. This system may be mounted on readily mobile trailers or trucks, because its size and weight are substantially less than conventional mechanical rigs.

There is provided byway of examples illustrative and simplified plans of potential drilling scenarios using the laser drilling systems and apparatus of the present invention.

Drilling Plan Example 1

| | Depth | Rock type | Drilling type/Laser power down hole |
|---|---|---|---|
| Drill 17½ inch hole | Surface - 3000 ft | Sand and shale | Conventional mechanical drilling |
| Run 13⅜ inch casing | Length 3000 ft | | |
| Drill 12¼ inch hole | 3000 ft-8,000 ft | basalt | 40 kW (minimum) |
| Run 9⅝ inch casing | Length 8,000 ft | | |
| Drill 8½ inch hole | 8,000 ft-11,000 ft | limestone | Conventional mechanical drilling |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

Drilling Plan Example 2

| | Depth | Rock type | Drilling type/Laser power down hole |
|---|---|---|---|
| Drill 17½ inch hole | Surface - 500 ft | Sand and shale | Conventional mechanical drilling |

-continued

Drilling Plan Example 2

| | Depth | Rock type | Drilling type/Laser power down hole |
|---|---|---|---|
| Run 13⅜ casing | Length 500 ft | | |
| Drill 12¼ hole | 500 ft-4,000 ft | granite | 40 kW (minimum) |
| Run 9⅝ inch casing | Length 4,000 ft | | |
| Drill 8½ inch hole | 4,000 ft-11,000 ft | basalt | 20 kW (mimimum) |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

In accordance with one or more aspects, a method for laser drilling using an optical pattern to chip rock formations is disclosed. The method may comprise irradiating the rock to spall, melt, or vaporize with one or more lasing beam spots, beam spot patterns and beam shapes at non-overlapping distances and timing patterns to induce overlapping thermal rock fractures that cause rock chipping of rock fragments. Single or multiple beam spots and beam patterns and shapes may be formed by refractive and reflective optics or fiber optics. The optical pattern, the pattern's timing, and spatial distance between non-overlapping beam spots and beam shapes may be controlled by the rock type thermal absorption at specific wavelength, relaxation time to position the optics, and interference from rock removal.

In some aspects, the lasing beam spot's power is either not reduced, reduced moderately, or fully during relaxation time when repositioning the beam spot on the rock surface. To chip the rock formation, two lasing beam spots may scan the rock surface and be separated by a fixed position of less than 2" and non-overlapping in some aspects. Each of the two beam spots may have a beam spot area in the range between 0.1 $cm^2$ and 25 $cm^2$. The relaxation times when moving the two lasing beam spots to their next subsequent lasing locations on the rock surface may range between 0.05 ms and 2 s. When moving the two lasing beam spots to their next position, their power may either be not reduced, reduced moderately, or fully during relaxation time.

In accordance with one or more aspects, a beam spot pattern may comprise three or more beam spots in a grid pattern, a rectangular grid pattern, a hexagonal grid pattern, lines in an array pattern, a circular pattern, a triangular grid pattern, a cross grid pattern, a star grid pattern, a swivel grid pattern, a viewfinder grid pattern or a related geometrically shaped pattern. In some aspects, each lasing beam spot in the beam spot pattern has an area in the range of 0.1 $cm^2$ and 25 $cm^2$. To chip the rock formation all the neighboring lasing beam spots to each lasing beam spot in the beam spot pattern may be less than a fixed position of 2" and non-overlapping in one or more aspects.

In some aspects, more than one beam spot pattern to chip the rock surface may be used. The relaxation times when positioning one or more beam spot patterns to their next subsequent lasing location may range between 0.05 ms and 2 s. The power of one or more beam spot patterns may either be not reduced, reduced moderately, or fully during relaxation time. A beam shape may be a continuous optical beam spot forming a geometrical shape that comprises of, a cross shape, hexagonal shape, a spiral shape, a circular shape, a triangular shape, a star shape, a line shape, a rectangular shape, or a related continuous beam spot shape.

In some aspects, positioning one line either linear or non-linear to one or more neighboring lines either linear or non-linear at a fixed distance less than 2" and non-overlapping may be used to chip the rock formation. Lasing the rock surface with two or more beam shapes may be used to chip the rock formation. The relaxation times when moving the one or more beam spot shapes to their next subsequent lasing location may range between 0.05 ms and 2 s.

In accordance with one or more aspects, the one or more continuous beam shapes powers are either not reduced, reduced moderately, or fully during relaxation time. The rock surface may be irradiated by one or more lasing beam spot patterns together with one or more beam spot shapes, or one or two beam spots with one or more beam spot patterns. In some aspects, the maximum diameter and circumference of one or more beam shapes and beam spot patterns is the size of the borehole being chipped when drilling the rock formation to well completion.

In accordance with one or more aspects, rock fractures may be created to promote chipping away of rock segments for efficient borehole drilling. In some aspects, beam spots, shapes, and patterns may be used to create the rock fractures so as to enable multiple rock segments to be chipped away. The rock fractures may be strategically patterned. In at least some aspects, drilling rock formations may comprise applying one or more non-overlapping beam spots, shapes, or patterns to create the rock fractures. Selection of one or more beam spots, shapes, and patterns may generally be based on the intended application or desired operating parameters. Average power, specific power, timing pattern, beam spot size, exposure time, associated specific energy, and optical generator elements may be considerations when selecting one or more beam spots, a shape, or a pattern. The material to be drilled, such as rock formation type, may also influence the one or more beam spot, a shape, or a pattern selected to chip the rock formation. For example, shale will absorb light and convert to heat at different rates than sandstone.

In accordance with one or more aspects, rock may be patterned with one or more beam spots. In at least one embodiment, beam spots may be considered one or more beam spots moving from one location to the next subsequent location lasing the rock surface in a timing pattern. Beam spots may be spaced apart at any desired distance. In some non-limiting aspects, the fixed position between one beam spot and neighboring beam spots may be non-overlapping. In at least one non-limiting embodiment, the distance between neighboring beam spots may be less than 2".

In accordance with one or more aspects, rock may be patterned with one or more beam shapes. In some aspects, beam shapes may be continuous optical shapes forming one or more geometric patterns. A pattern may comprise the geometric shapes of a line, cross, viewfinder, swivel, star, rectangle, hexagon, circular, ellipse, squiggly line, or any other desired shape or pattern. Elements of a beam shape may be spaced apart at any desired distance. In some non-limiting aspects, the fixed position between each line linear or non-linear and the neighboring lines linear or non-linear are in a fixed position may be less than 2" and non-overlapping.

In accordance with one or more aspects, rock may be patterned with a beam pattern. Beam patterns may comprise a grid or array of beam spots that may comprise the geometric patterns of line, cross, viewfinder, swivel, star, rectangle, hexagon, circular, ellipse, squiggly line. Beam spots of a beam pattern may be spaced apart at any desired distance. In some non-limiting aspects, the fixed position between each beam spot and the neighboring beam spots in the beam spot pattern may be less than 2" and non-overlapping.

In accordance with one or more aspects, the beam spot being scanned may have any desired area. For example, in some non-limiting aspects the area may be in a range between about 0.1 $cm^2$ and about 25 $cm^2$. The beam line, either linear or non-linear, may have any desired specific diameter and any specific and predetermined power distribution. For example, the specific diameter of some non-limiting aspects may be in a range between about 0.05 $cm^2$ and about 25 $cm^2$. In some non-limiting aspects, the maximum length of a line, either linear or non-linear, may generally be the diameter of a borehole to be drilled. Any desired wavelength may be used. In some aspects, for example, the wavelength of one or more beam spots, a shape, or pattern, may range from 800 nm to 2000 nm. Combinations of one or more beam spots, shapes, and patterns are possible and may be implemented.

In accordance with one or more aspects, the timing patterns and location to chip the rock may vary based on known rock chipping speeds and/or rock removal systems. In one embodiment, relaxation scanning times when positioning one or more beam spot patterns to their next subsequent lasing location may range between 0.05 ms and 2 s. In another embodiment, a camera using fiber optics or spectroscopy techniques can image the rock height to determine the peak rock areas to be chipped. The timing pattern can be calibrated to then chip the highest peaks of the rock surface to lowest or peaks above a defined height using signal processing, software recognition, and numeric control to the optical lens system. In another embodiment, timing patterns can be defined by a rock removal system. For example, if the fluid sweeps from the left side the rock formation to the right side to clear the optical head and raise the cuttings, the timing should be chipping the rock from left to right to avoid rock removal interference to the one or more beam spots, shape, or pattern lasing the rock formation or vice-a-versa. For another example, if the rocks are cleared by a jet nozzle of a gas or liquid, the rock at the center should be chipped first and the direction of rock chipping should move then away from the center. In some aspects, the speed of rock removal will define the relaxation times.

In accordance with one or more aspects, the rock surface may be affected by the gas or fluids used to clear the head and raise the cuttings downhole. In one embodiment, heat from the optical elements and losses from the fiber optics downhole or diode laser can be used to increase the temperature of the borehole. This could lower the required temperature to induce spallation making it easier to spall rocks. In another embodiment, a liquid may saturate the chipping location, in this situation the liquid would be turned to steam and expand rapidly, this rapid expansion would thus create thermal shocks improving the growth of fractures in the rock. In another embodiment, an organic, volatile components, minerals or other materials subject to rapid and differential heating from the laser energy, may expand rapidly, this rapid expansion would thus create thermal shocks improving the growth of fractures in the rock. In another embodiment, the fluids of higher index of refraction may be sandwiched between two streams of liquid with lower index of refraction. The fluids used to clear the rock can act as a wavelength to guide the light. A gas may be used with a particular index of refraction lower than a fluid or another gas.

By way of example and to further illustrate the teachings of the present inventions, the thermal shocks can range from lasing powers between one and another beam spot, shape, or pattern. In some non-limiting aspects, the thermal shocks may reach 10 kW/cm$^2$ of continuous lasing power density. In some non-limiting aspects, the thermal shocks may reach up to 10 MW/cm$^2$ of pulsed lasing power density, for instance, at 10 nanoseconds per pulse. In some aspects, two or more beam spots, shapes, and patterns may have different power levels to thermally shock the rock. In this way, a temperature gradient may be formed between lasing of the rock surface.

Figure 15:
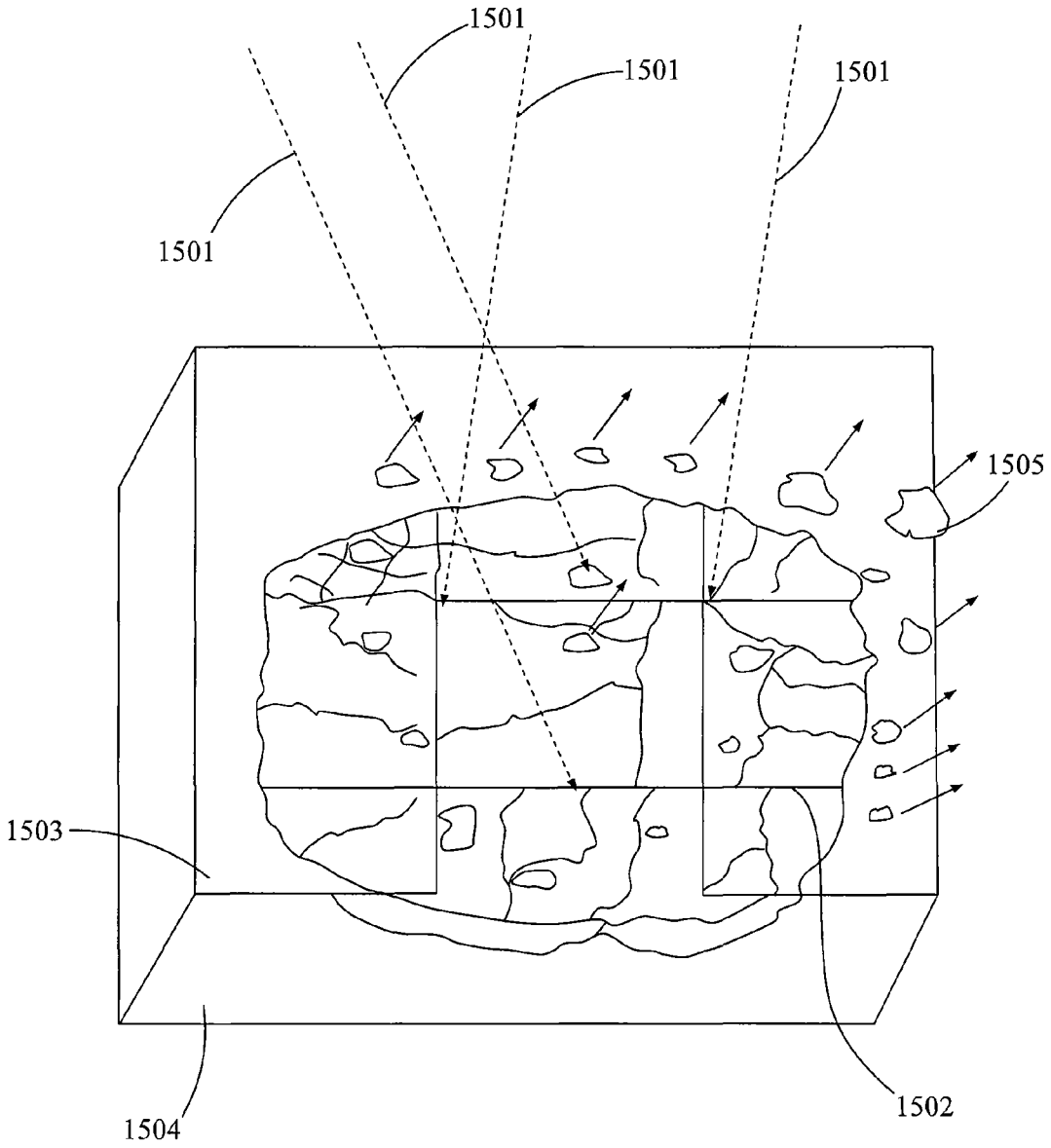
FIGS. 15 to 25 illustrate LBHAs.

By way of example and to further demonstrate the present teachings of the inventions, there are provided examples of optical heads, i.e., optical assemblies, and beam shot patterns, i.e., illumination patterns, that may be utilized with, as a part of, or provided by an LBHA. FIG. 15 illustrates chipping a rock formation using a lasing beam shape pattern. An optical beam 1501 shape lasing pattern forming a checkerboard of lines 1502 irradiates the rock surface 1503 of a rock 1504. The distance between the beam spots shapes are non-overlapping because stress and heat absorption cause natural rock fractures to overlap inducing chipping of rock segments. These rock segments 1505 may peel or explode from the rock formation.

Figure 16:
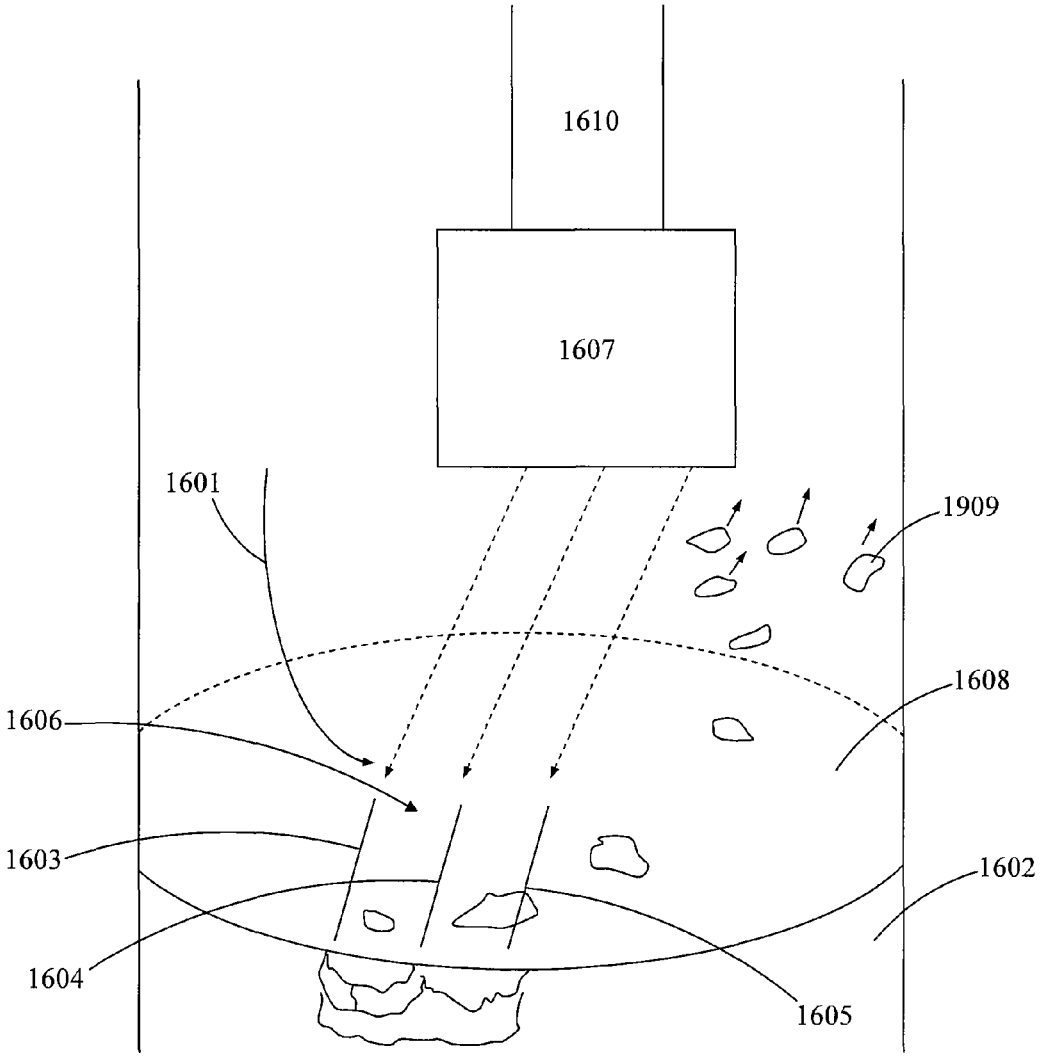

By way of example and to further demonstrate the present teachings, FIG. 16 illustrates removing rock segments by sweeping liquid or gas flow 1601 when chipping a rock formation 1602. The rock segments are chipped by a pattern 1606 of non-overlapping beam spot shaped lines 1603, 1604, 1605. The optical head 1607, optically associated with an optical fiber bundle, the optical head 1607 having an optical element system irradiates the rock surface 1608. A sweeping from left to right with gas or liquid flow 1601 raises the rock fragments 1609 chipped by the thermal shocks to the surface.

Figure 17:
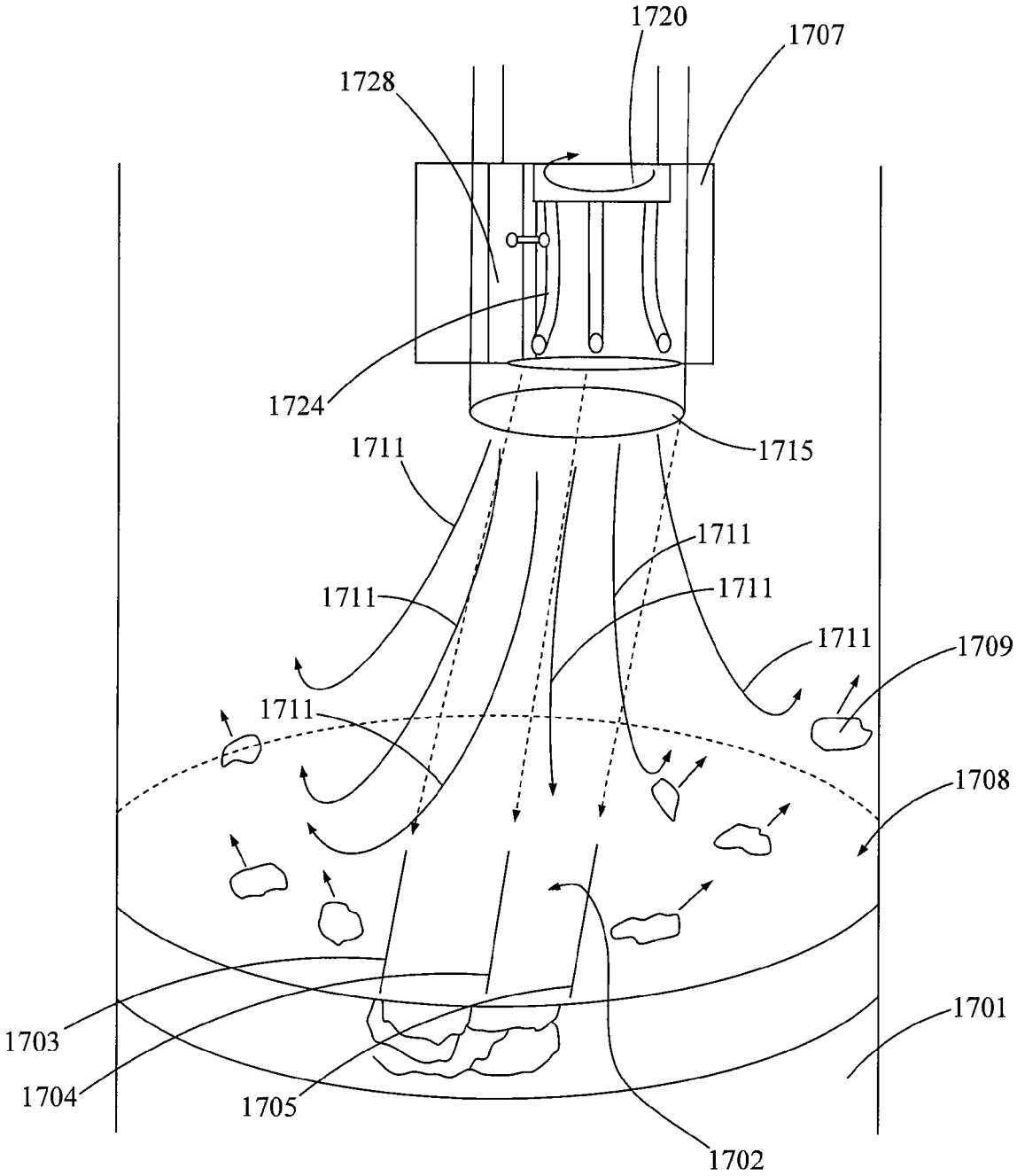

By way of example and to further demonstrate the present teachings, FIG. 17 illustrates removing rock segments by liquid or gas flow directed from the optical head when chipping a rock formation 1701. The rock segments are chipped by a pattern 1702 of non-overlapping beam spot shaped lines 1703, 1704, 1705. The optical head 1707 with an optical element system irradiates the rock surface 1708. Rock segment debris 1709 is swept from a nozzle 1715 flowing a gas or liquid 1711 from the center of the rock formation and away. The optical head 1707 is shown attached to a rotating motor 1720 and fiber optics 1724 spaced in a pattern. The optical head also has rails 1728 for z-axis motion if necessary to focus. The optical refractive and reflective optical elements form the beam path.

Figure 18:
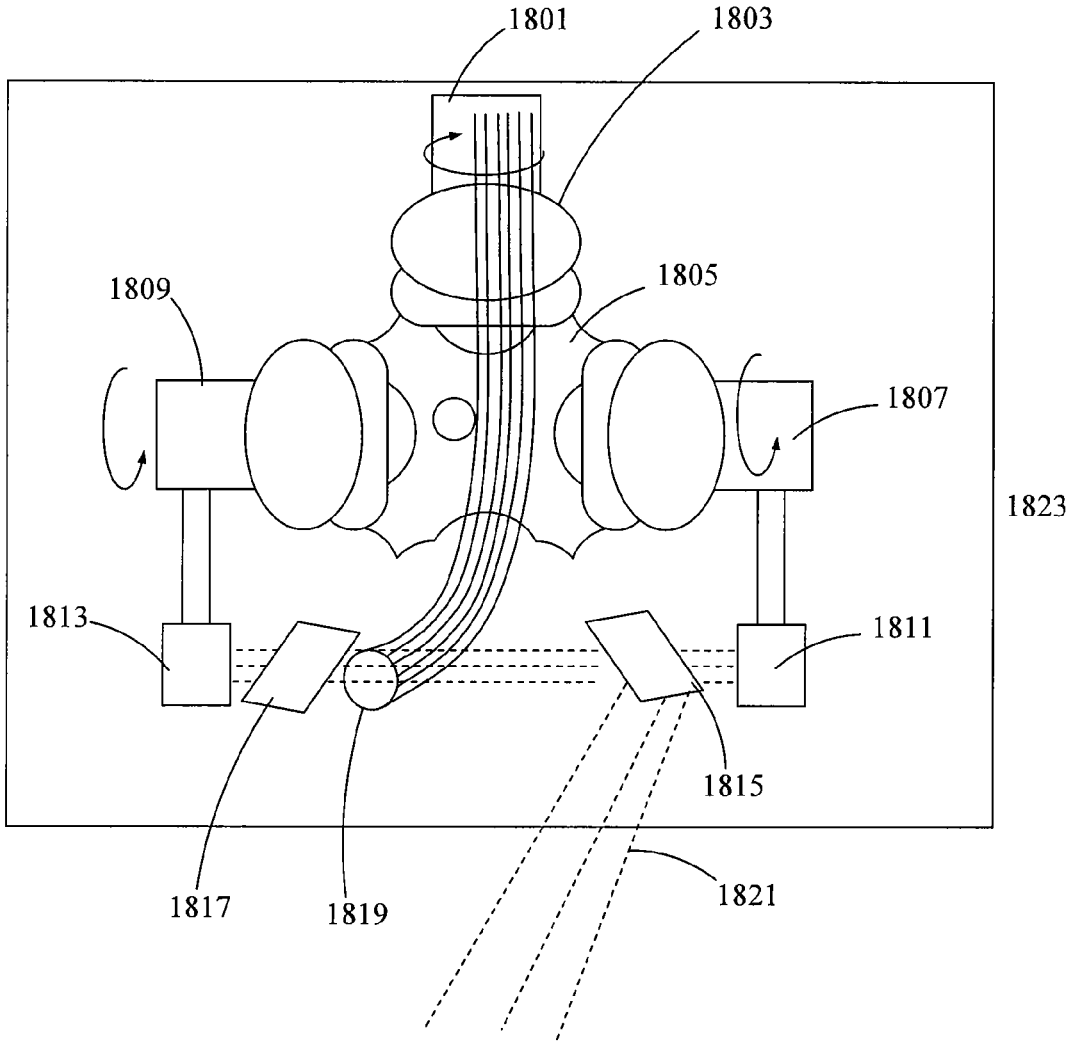

By way of example and to further demonstrate the present teachings, FIG. 18 illustrates optical mirrors scanning a lasing beam spot or shape to chip a rock formation in the XY-plane. Thus, there is shown, with respect to a casing 1823 in a borehole, a first motor of rotating 1801, a plurality of fiber optics in a pattern 1803, a gimbal 1805, a second rotational motor 1807 and a third rotational motor 1809. The second rotational motor 1807 having a stepper motor 1811 and a mirror 1815 associated therewith. The third rotational motor 1809 having a stepper motor 1813 and a mirror 1817 associated therewith. The optical elements 1819 optically associated with optical fibers 1803 and capable of providing laser beam along optical path 1821. As the gimbal rotates around the z-axis and repositions the mirrors in the XY-plane. The mirrors are attached to a stepper motor to rotate stepper motors and mirrors in the XY-plane. In this embodiment, fiber optics are spaced in a pattern forming three beam spots manipulated by optical elements that scan the rock formation a distance apart and non-overlapping to cause rock chipping. Other fiber optic patterns, shapes, or a diode laser can be used.

Figure 19:
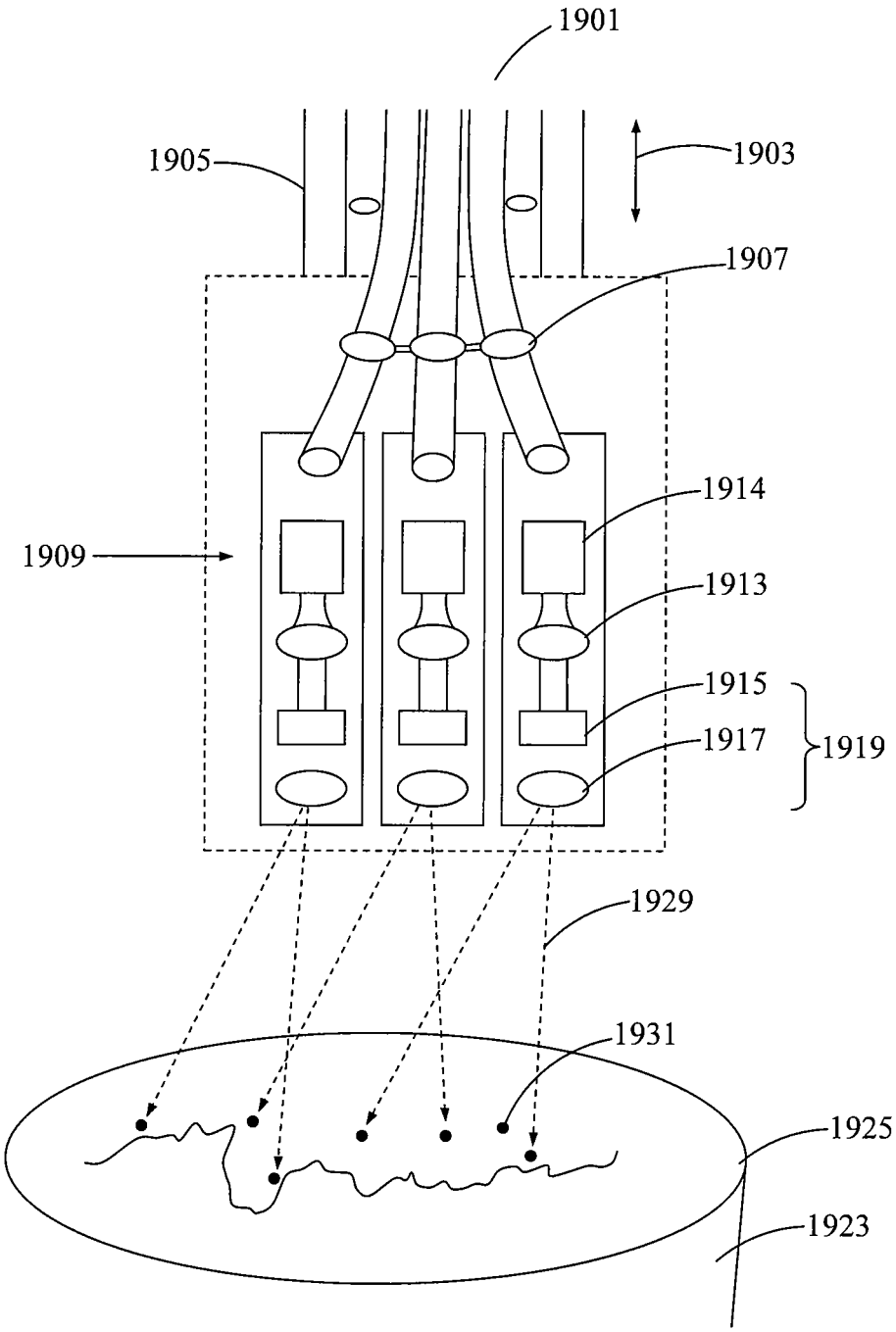

By way of example and to further demonstrate the present teachings, FIG. 19 illustrates using a beam splitter lens to form multiple beam foci to chip a rock formation. There is shown fibers 1901 in a pattern, a rail 1905 for providing z direction movement shown by arrow 1903, a fiber connector 1907, an optical head 1909, having a beam expander 1919, which comprises a DOE/ROE 1915, a positive lens 1917, a collimator 1913, a beam expander 1911. This assembly is capable of delivering one or more laser beams, as spots 1931 in a pattern, along optical paths 1929 to a rock formation 1923 having a surface 1925. Fiber optics are spaced a distance apart in a pattern. An optical element system composed of a beam expander and collimator feed a diffractive optical element attached to a positive lens to focus multiple beam spots to multiple foci. The distance between beam spots are non-overlapping and will cause chipping. In this figure, rails move in the z-axis to focus the optical path. The fibers are connected by a connector. Also, an optical element can be attached to each fiber optic as shown in this figure to more than one fiber optics.

Figure 20:
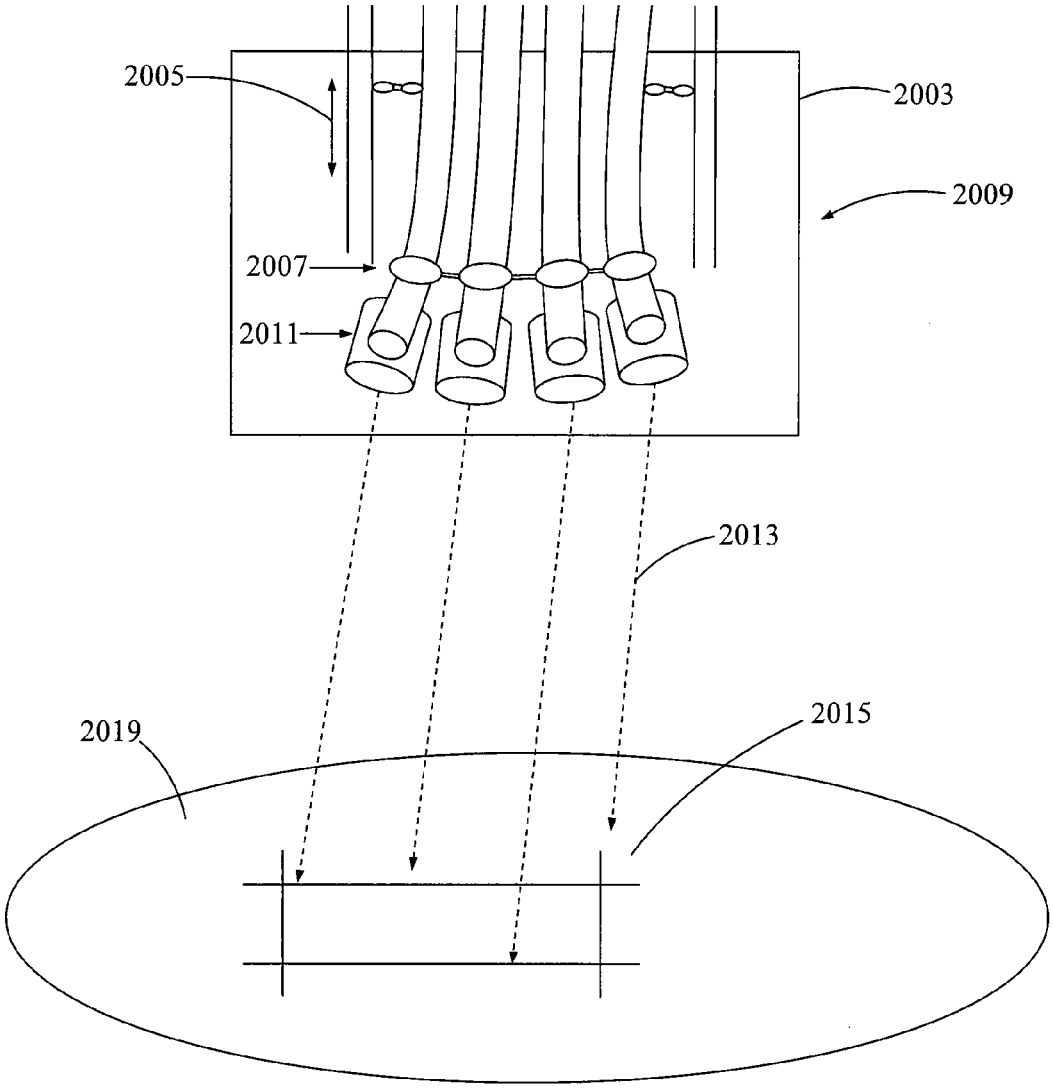

By way of example and to further demonstrate the present teachings, FIG. 20 illustrates using a beam spot shaper lens to shape a pattern to chip a rock formation. There is provided an array of optical fibers 2001, an optical head 2009. The optical head having a rail 2003 for facilitating movement in the z direction, shown by arrow 2005, a fiber connector 2007, an optics assembly 2001 for shaping the laser beam that is transmitted by the fibers 2001. The optical head capable of transmitting a laser beam along optical path 2013 to illuminate a surface 2019 with a laser beam shot pattern 2021 that has separate, but intersection lines in a grid like pattern. Fiber optics are spaced a distance apart in a pattern connected by a connector. The fiber optics emit a beam spot to a beam spot shaper lens attached to the fiber optic. The beam spot shaper lens forms a line in this figure overlapping to form a tick-tack-toe laser pattern on the rock surface. The optical fiber bundle wires are attached to rails moving in the z-axis to focus the beam spots.

Figure 21:
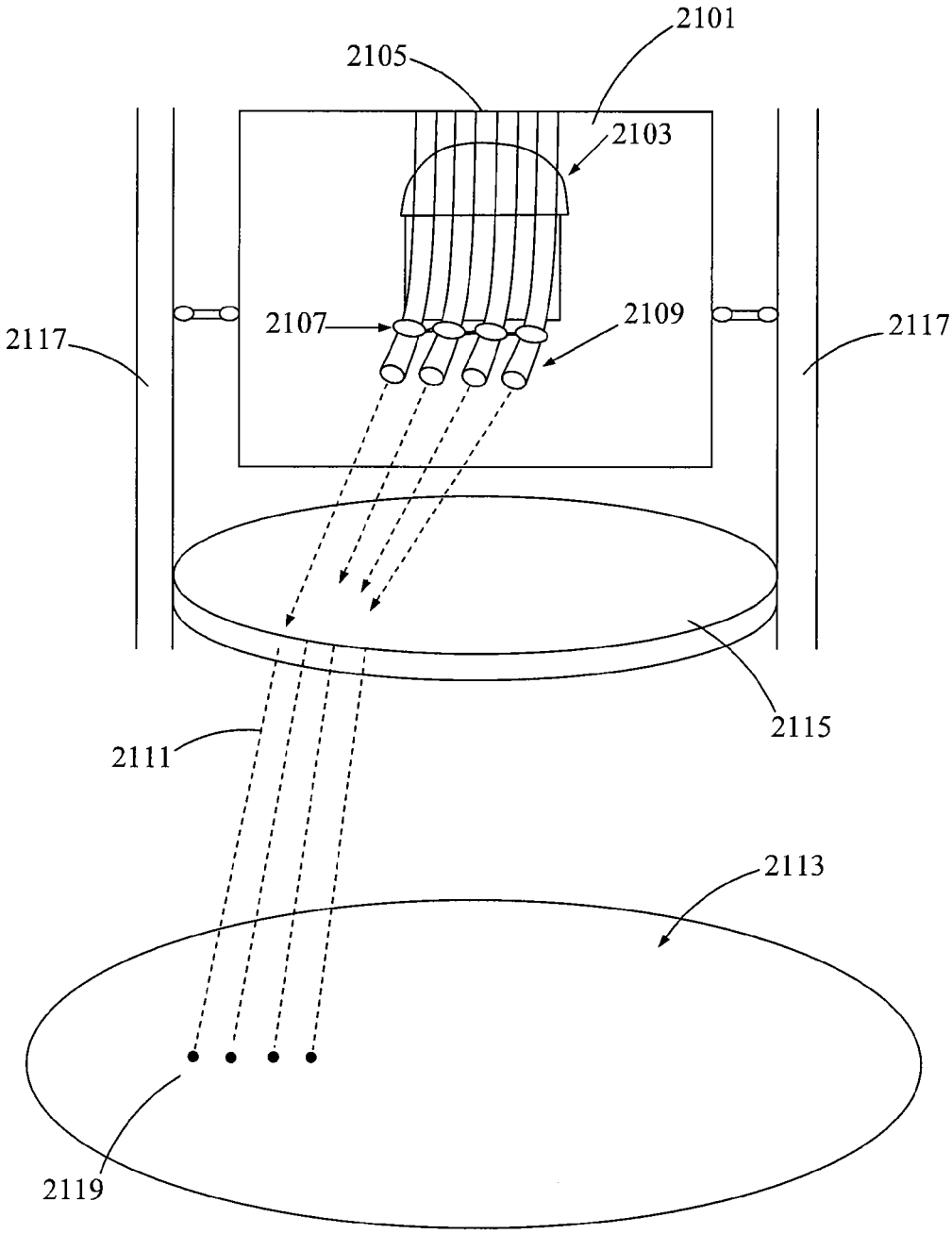

By way of example and to further demonstrate the present teachings, FIG. 21 illustrates using a F-theta objective to focus a laser beam pattern to a rock formation to cause chipping. There is provided an optical head 2101, a first motor for providing rotation 2103, a plurality of optical fibers 2105, a connector 2107, which positions the fibers in a predetermined pattern 2109. The laser beam exits the fibers and travels along optical path 2111 through F-Theta optics 2115 and illuminates rock surface 2113 in shot pattern 2110. There is further shown rails 2117 for providing z-direction movement. Fiber optics connected by connectors in a pattern are rotated in the z-axis by a gimbal attached to the optical casing head. The beam path is then refocused by an F-theta objective to the rock formation. The beam spots are a distance apart and non-overlapping to induce rock chipping in the rock formation. A rail is attached to the optical fibers and F-theta objective moving in the z-axis to focus the beam spot size.

It is understood that the rails in these examples for providing z-direction movement are provided by way of illustration and that z-direction movement, i.e. movement toward or away from the bottom of the borehole may be obtained by other means, for example winding and unwinding the spool or raising and lowering the drill string that is used to advance the LBHA into or remove the LBHA from the borehole.

Figure 22:
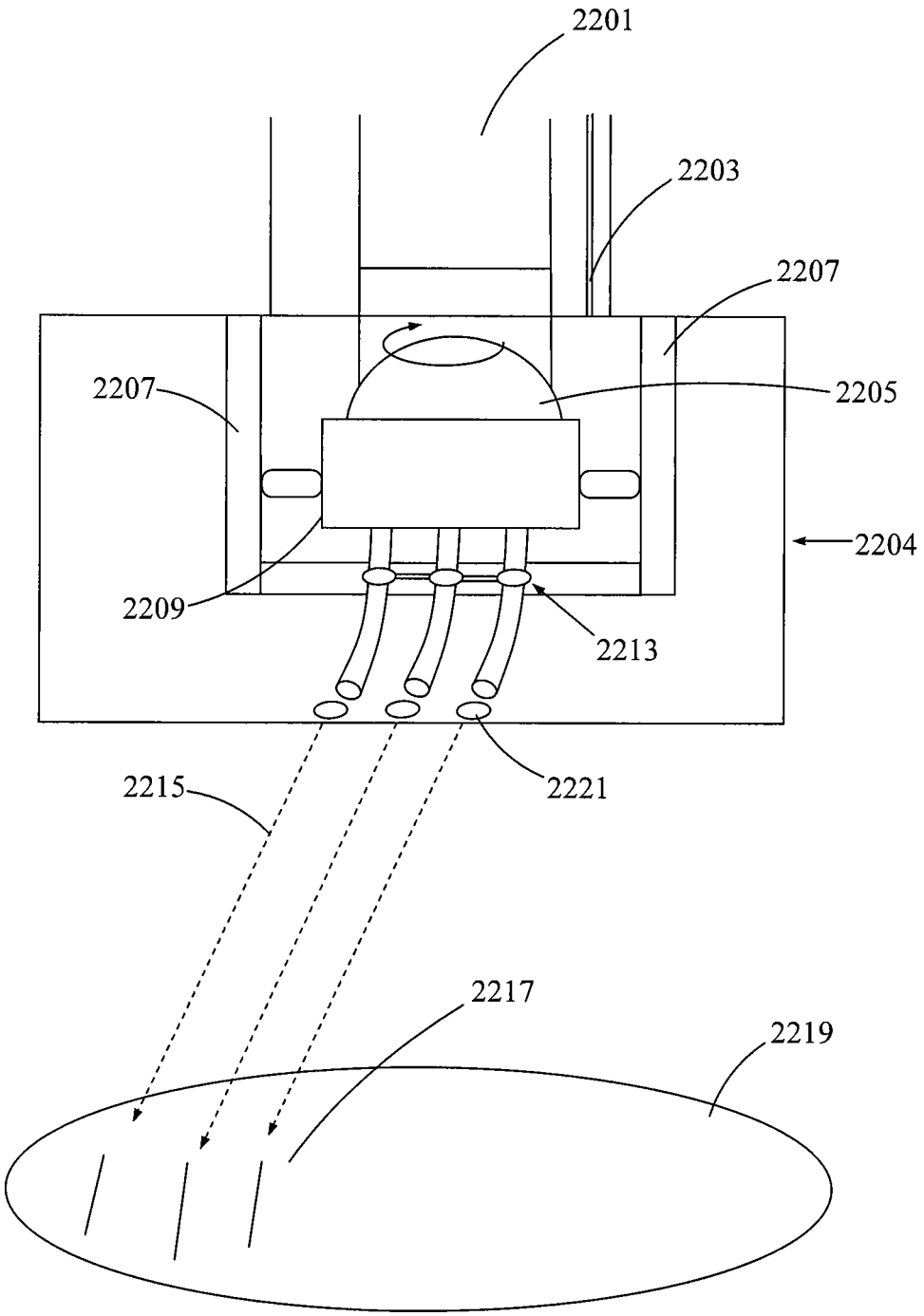

By way of example and to further demonstrate the present teachings, FIG. 22 illustrates mechanical control of fiber optics attached to beam shaping optics to cause rock chipping. There is provided a bundle of a plurality of fibers 2201 first motor 2205 for providing rotational movement a power cable 2203, an optical head 2206, and rails 2207. There is further provided a second motor 2209, a fiber connector 2213 and a lens 2221 for each fiber to shape the beam. The laser beams exit the fibers and travel along optical paths 2215 and illumate the rock surface 2219 in a plurality of individual line shaped shot patterns 2217. Fiber optics are connected by connectors in a pattern and are attached to a rotating gimbal motor around the z-axis. Rails are attached to the motor moving in the z-axis. The rails are structurally attached to the optical head casing and a support rail. A power cable powers the motors. In this figure, the fiber optics emit a beam spot to a beam spot shaper lens forming three non-overlapping lines to the rock formation to induce rock chipping.

Figure 23:
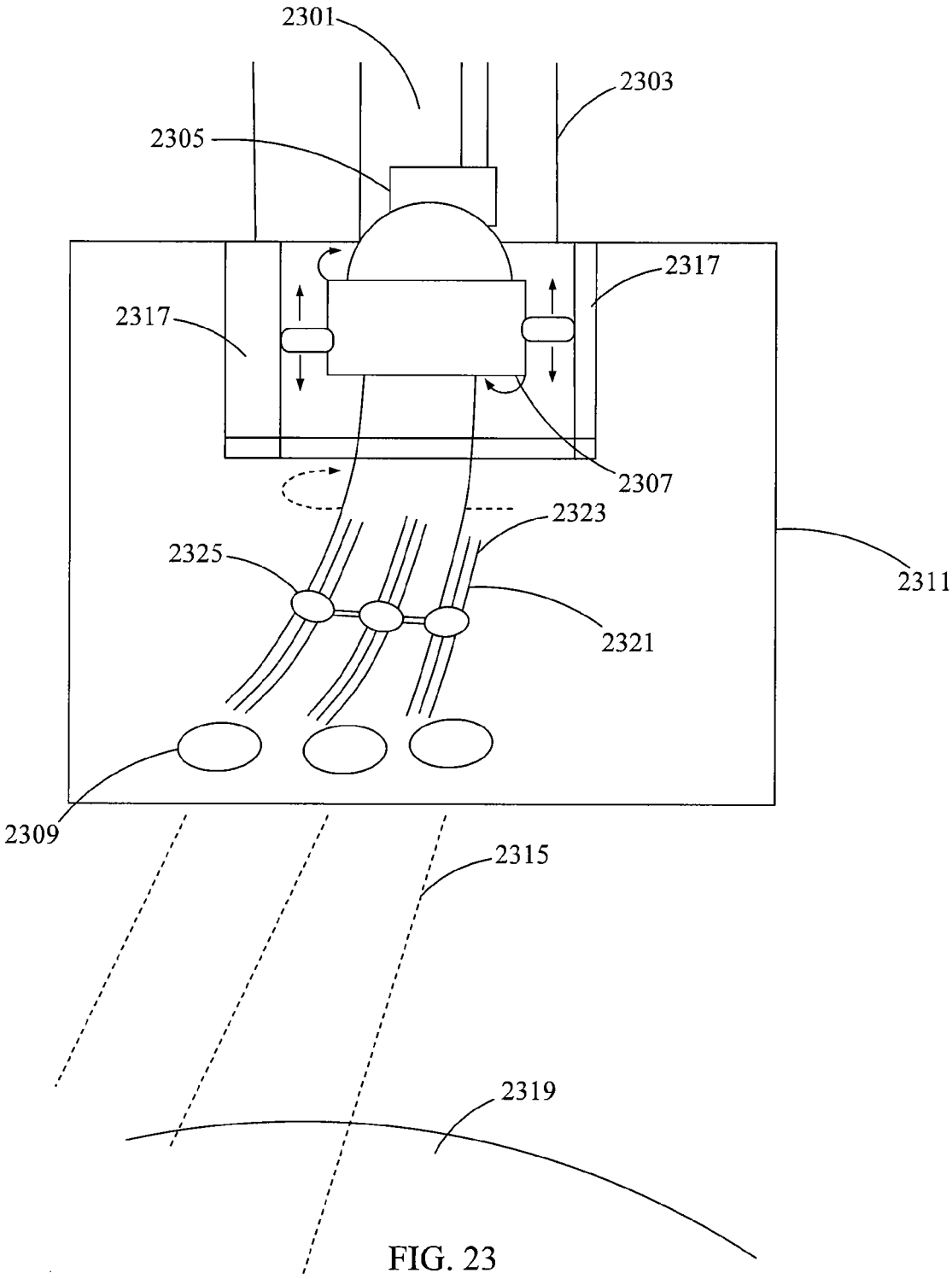

By way of example and to further demonstrate the present teachings, FIG. 23 illustrates using a plurality of fiber optics to form a beam shape line. There is provided an optical assembly 2311 having a source of laser energy 2301, a power cable 2303, a first rotational motor 2305, which is mounted as a gimbal, a second motor 2307, and rails 2317 for z-direction movement. There is also provided a plurality of fiber bundles 2321, with each bundle containing a plurality of individual fibers 2323. The bundles 2321 are held in a predetermined position by connector 2325. Each bundle 2321 is optically associated with a beam shaping optics 2309. The laser beams exit the beam shaping optics 2309 and travel along optical path 2315 to illuminate surface 2319. The motors 2307, 2305 provide for the ability to move the plurality of beam spots in a plurality of predetermined and desired patterns on the surface 2319, which may be the surface the borehole, such as the bottom surface, side surface, or casing in the borehole. A plurality of fiber optics are connected by connectors in a pattern and are attached to a rotating gimbal motor around the z-axis. Rails are attached to the motor moving in the z-axis. The rails are structurally attached to the optical head casing and a support rail. A power cable powers the motors. In this figure, the plurality of fiber optics emits a beam spot to a beam spot shaper lens forming three lines that are non-overlapping to the rock formation. The beam shapes induce rock chipping.

Figure 24:
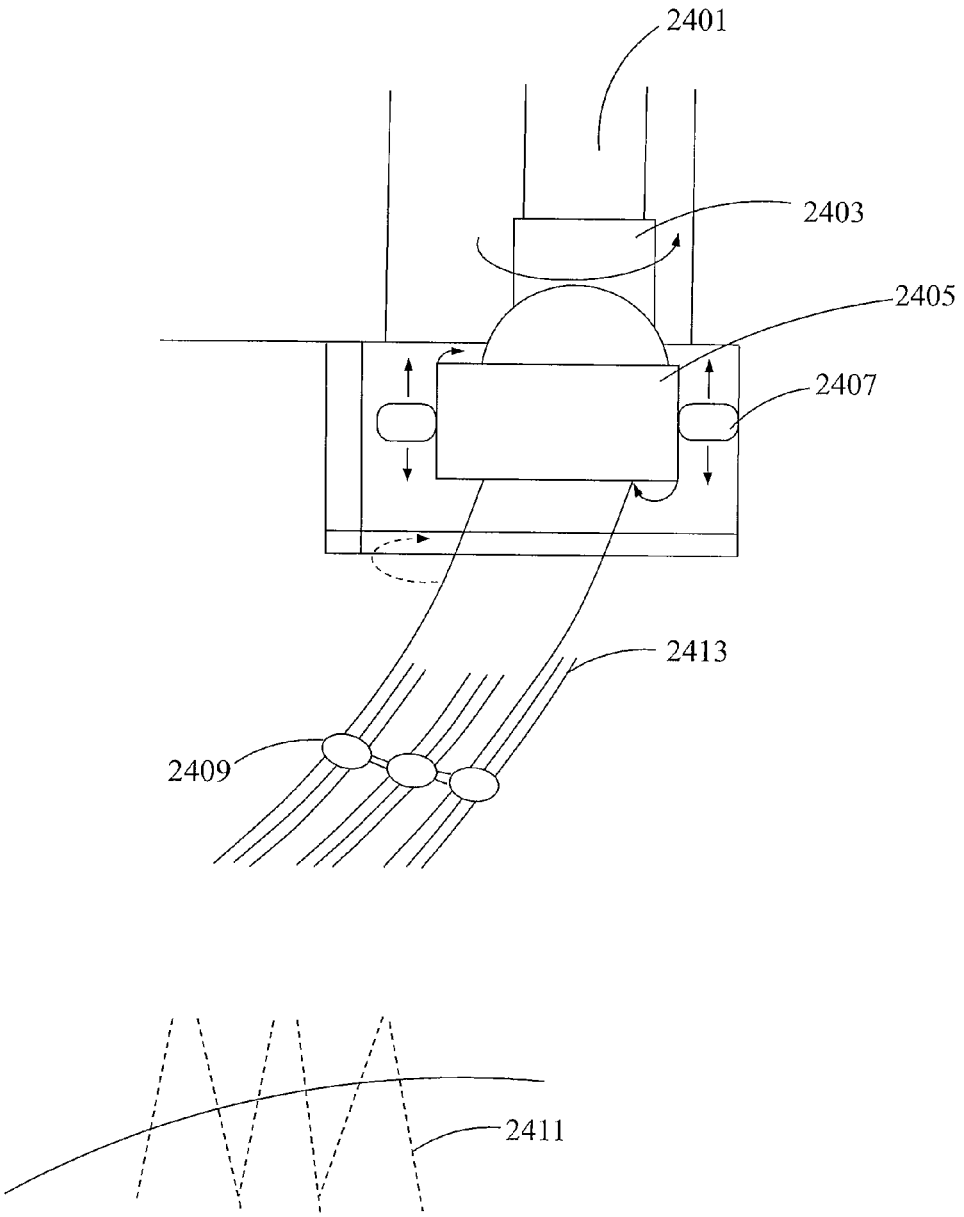

By way of example and to further demonstrate the present teachings, FIG. 24 illustrates using a plurality of fiber optics to form multiple beam spot foci being rotated on an axis. There is provided a laser source 2401, a first motor 2403, which is gimbal mounted, a second motor 2405 and a means for z-direction movement 2407. There is further provided a plurality of fiber bundles 2413 and a connector 2409 for positioning the plurality of bundles 2413, the laser beam exits the fibers and illuminates a surface in a diverging and crossing laser shot pattern. The fiber optics are connected by connectors at an angle being rotated by a motor attached to a gimbal that is attached to a second motor moving in the z-axis on rails. The motors receive power by a power cable. The rails are attached to the optical casing head and support rail beam. In this figure, a collimator sends the beam spot originating from the plurality of optical fibers to a beam splitter. The beam splitter is a diffractive optical element that is attached to positive refractive lens. The beam splitter forms multiple beam spot foci to the rock formation at non-overlapping distances to chip the rock formation. The foci is repositioned in the z-axis by the rails.

Figure 25:
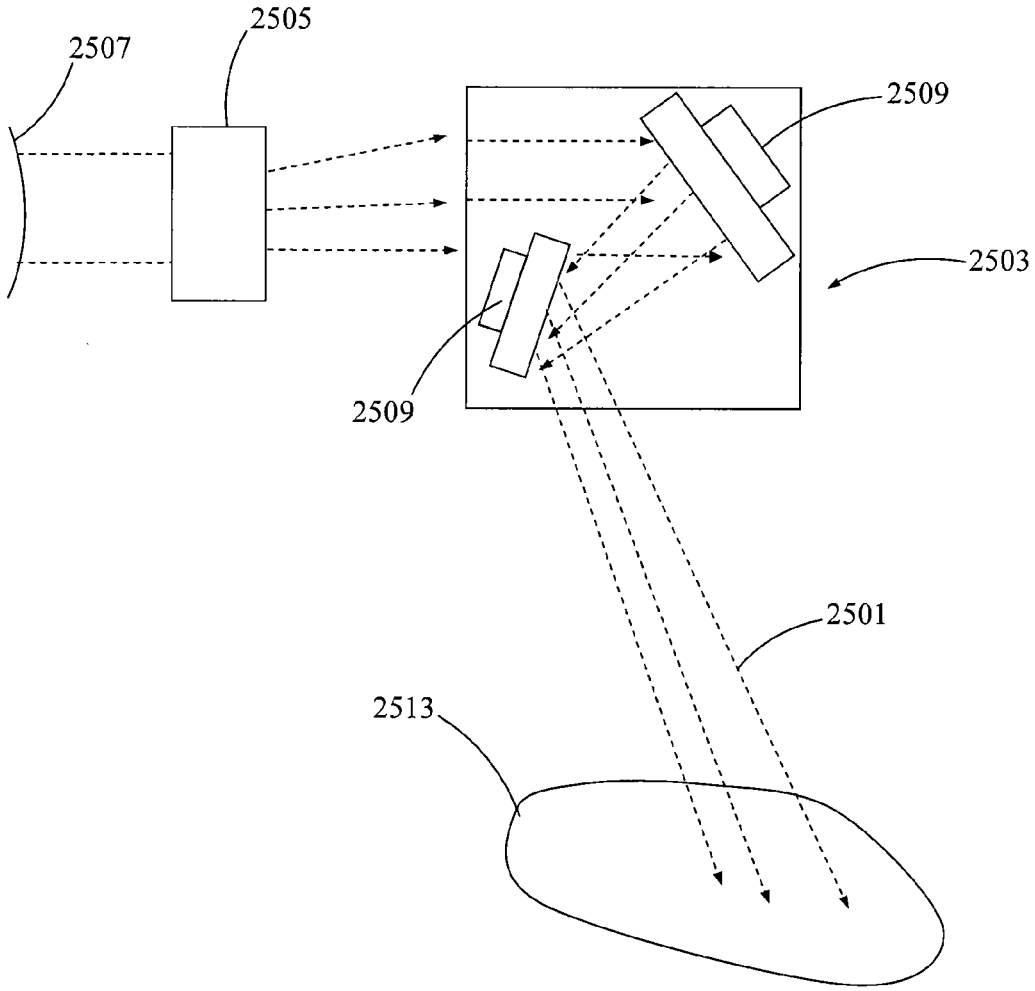

By way of example and to further demonstrate the present teachings, FIG. 25 illustrates scanning the rock surface with a beam pattern and XY scanner system. There is provided an optical path 2501 for a laser beam, a scanner 2503, a diffractive optics 2505 and a collimator optics 2507. An optical fiber emits a beam spot that is expanded by a beam expander unit and focused by a collimator to a refractive optical element. The refractive optical element is positioned in front of an XY scanner unit to form a beam spot pattern or shape. The XY scanner composed of two mirrors controlled by galvanometer mirrors 2509 irradiate the rock surface 2513 to induce chipping.

The novel and innovative apparatus of the present invention, as set forth herein, may be used with conventional drilling rigs and apparatus for drilling, completion and related and associated operations. The apparatus and methods of the present invention may be used with drilling rigs and equipment such as in exploration and field development activities. Thus, they may be used with, by way of example and without limitation, land based rigs, mobile land based rigs, fixed tower rigs, barge rigs, drill ships, jack-up platforms, and semi-submersible rigs. They may be used in operations for advancing the well bore, finishing the well bore and work over activities, including perforating the production casing. They may further be used in window cutting and pipe cutting and in any application where the delivery of the laser beam to a location, apparatus or component that is located deep in the well bore may be beneficial or useful.

From the foregoing description, one skilled in the art can readily ascertain the essential characteristics of this invention, and without departing from the spirit and scope thereof, can make various changes and/or modifications of the invention to adapt it to various usages and conditions.

What is claimed:

1. A system for creating a borehole in the earth comprising:

a. a high power laser source;

b. a bottom hole assembly;

c. a fiber optically connecting the laser source with the bottom hole assembly, such that a laser beam from the laser source is transmitted to the bottom hole assembly, wherein the laser beam has a Gaussian profile at the fiber bottom hole assembly connection;

d. a means for providing the laser beam to a bottom surface of the borehole;

e. a beam power deposition optic having a property of changing an energy distribution profile within the laser beam; and, f. the bottom hole assembly comprising:

i. the means for providing the laser beam to the bottom surface of the borehole; and, ii. the providing means comprising the beam power deposition optic;

g. wherein, the laser beam as delivered from the bottom hole assembly illuminates the bottom surface of the borehole with a substantially even energy deposition profile on the bottom surface.

2. The system of claim 1, wherein the laser source provides more than one laser beams.

3. The system of claim 1, wherein the laser source provides a plurality of laser beams to the fiber.

4. The system of claim 1, wherein the laser beam is at least about 20 kW at the fiber bottom hole assembly connection.

5. The system of claim 1, wherein the laser beam is at least about 3 kW at the fiber bottom hole assembly connection.

6. The system of claim 1, wherein the laser beam is at least about 5 kW at the fiber bottom hole assembly connection.

7. The system of claim 1, wherein the laser beam is at least about 10 kW at the fiber bottom hole assembly connection.

8. The system of claim 1, wherein the laser beam is at least about 15 kW at the fiber bottom hole assembly connection.

9. The system of claim 1, wherein the laser beam is at least about 20 kW.

10. A system for creating a borehole in the earth comprising:

a. a high power laser source;

b. a bottom hole assembly;

c. a fiber optically connecting the laser source with the bottom hole assembly, such that a laser beam from the laser source is transmitted to the bottom hole assembly, wherein the laser beam has a substantially Gaussian profile at the fiber bottom hole assembly connection;

d. a means for providing the laser beam to a bottom surface of the borehole;

e. a beam power deposition optic having a property of changing an energy distribution profile within the laser beam; and, f. the bottom hole assembly comprising:

i. the means for providing the laser beam to the bottom surface of the borehole; and, ii. the providing means comprising the beam power deposition optic;

g. wherein, the laser beam as delivered from the bottom hole assembly illuminates the bottom surface of the borehole with a substantially even energy deposition profile on the bottom surface.

11. The system of claim 10, wherein the laser source provides more than one laser beam.

12. The system of claim 10, wherein the laser source provides a plurality of laser beams to the fiber.

13. The system of claim 10, wherein the laser beam is at least about 20 kW at the fiber bottom hole assembly connection.

14. The system of claim 10, wherein the laser beam is at least about 3 kW at the fiber bottom hole assembly connection.

15. The system of claim 10, wherein the laser beam is at least about 5 kW at the fiber bottom hole assembly connection.

16. The system of claim 10, wherein the laser beam is at least about 10 kW at the fiber bottom hole assembly connection.

17. The system of claim 10, wherein the laser beam is at least about 15 kW at the fiber bottom hole assembly connection.

18. The system of claim 10, wherein the laser source is at least about 20 kW.

19. A system for creating a borehole in the earth comprising:

a. a high power laser source;

b. a bottom hole assembly;

c. a fiber optically connecting the laser source with the bottom hole assembly, such that a laser beam from the laser source is transmitted to the bottom hole assembly, wherein the laser beam has a super-Gaussian profile at the fiber bottom hole assembly connection;

d. a means for providing the laser beam to a bottom surface of the borehole;

e. a beam power deposition optic having a property of changing an energy distribution profile within the laser beam; and, f. the bottom hole assembly comprising:

i. the means for providing the laser beam to the bottom surface of the borehole; and, ii. the providing means comprising the beam power deposition optics;

g. wherein, the laser beam as delivered from the bottom hole assembly illuminates the bottom surface of the borehole with a substantially even energy deposition profile on the bottom surface.

20. The system of claim 19, wherein the laser source provides more than one laser beam.

21. The system of claim 19, wherein the laser source provides a plurality of laser beams to the fiber.

22. The system of claim 19, wherein the laser beam is at least about 20 kW at the fiber bottom hole assembly connection.

23. The system of claim 19, wherein the laser beam is at least about 3 kW at the fiber bottom hole assembly connection.

24. The system of claim 19, wherein the laser beam is at least about 5 kW at the fiber bottom hole assembly connection.

25. The system of claim 19, wherein the laser beam is at least about 10 kW at the fiber bottom hole assembly connection.

26. The system of claim 19, wherein the laser beam is at least about 15 kW at the fiber bottom hole assembly connection.

27. The system of claim 19, wherein the laser source is at least about 20 kW.

28. A system for creating a borehole in the earth comprising:

a. a high power laser source;

b. a bottom hole assembly;

c. an optical fiber;

i. having a first and a second end;

ii. having a length between the first and second ends;

iii. the first end being optically associated with the laser source;

iv. the fiber having a length of at least about 1000 ft;

d. a means for delivering a laser beam from the laser source to a surface of the borehole;

e. the laser delivery means connected to and optically associated with the second end of the optical fiber;

f. a means for providing a substantially uniform energy deposition, wherein the means for providing a substantially uniform energy deposition comprises a micro-optics array; and, g. the laser delivery means comprising the means for providing the substantially uniform energy deposition.

29. The system of claim 28 wherein the laser delivery means comprises an optical assembly.

30. The system of claim 28 wherein the laser delivery means is contained within the laser bottom hole assembly.

31. The system of claim 28 wherein the laser delivery means is contained within the bottom hole assembly and the bottom hole assembly comprises a rotating optical assembly.

32. The system of claim 31 wherein the bottom hole assembly comprises a mud motor.

33. The system of claim 28 wherein the laser source provides more than one laser beam.

34. The system of claim 28 wherein the laser source provides a plurality of laser beams to the fiber first end.

35. The system of claim 28 wherein the laser beam has a substantially uniform profile at the fiber second end.

36. The system of claim 28 wherein the laser beam is at least about 10 kW at the fiber second end.

37. The system of claim 28 wherein the laser beam is at least about 3 kW at the fiber second end.

38. The system of claim 28 wherein the laser beam is at least about 5 kW at the fiber second end.

39. The system of claim 28 wherein the laser beam is at least about 15 kW at the fiber second end.

40. The system of claim 28 wherein the laser source is from at least about 5 kW to about 20 kW.

41. The system of claim 28 wherein the laser source is at least about 15 kW.

42. The system of claim 28 wherein the laser source is at least about 5 kW.

43. The system of claim 28 wherein the laser beam has a Gaussian profile at the fiber second end.

44. The system of claim 28 wherein the laser beam has a substantially Gaussian profile at the fiber second end.

45. The system of claim 28 wherein the laser beam has a super-Gaussian profile at the fiber second end.

46. A system for creating a borehole in the earth comprising:

a. a high power laser source;
b. a bottom hole assembly;
c. an optical fiber;
  i. having a first and a second end;
  ii. having a length between the first and second ends;
  iii. the first end being optically associated with the laser source;
  iv. the fiber having a length of at least about 1000 ft;
d. a means for delivering a laser beam from the laser source to a surface of the borehole;
e. the laser delivery means connected to and optically associated with the second end of the optical fiber;
f. a means for providing a substantially uniform energy deposition, wherein the means for providing a substantially uniform energy deposition comprises an axicon lens; and,
g. the laser delivery means comprising the means for providing the substantially uniform energy deposition.

47. The system of claim 46 wherein the laser delivery means comprises an optical assembly.

48. The system of claim 46 wherein the laser delivery means is contained within the laser bottom hole assembly.

49. The system of claim 46 wherein the laser delivery means is contained within the bottom hole assembly and the bottom hole assembly comprises a rotating optical assembly.

50. The system of claim 49 wherein the bottom hole assembly comprises a mud motor.

51. The system of claim 46 wherein the laser source provides more than one laser beam.

52. The system of claim 46 wherein the laser source provides a plurality of laser beams to the fiber first end.

53. The system of claim 46 wherein the laser beam has a Gaussian profile at the fiber second end.

54. The system of claim 46 wherein the laser beam has a substantially Gaussian profile at the fiber second end.

55. The system of claim 46 wherein the laser beam has a super-Gaussian profile at the fiber second end.

56. The system of claim 46 wherein the laser beam has a substantially uniform profile at the fiber second end.

57. The system of claim 46 wherein the laser beam is at least about 10 kW at the fiber second end.

58. The system of claim 46 wherein the laser beam is at least about 3 kW at the fiber second end.

59. The system of claim 46 wherein the laser beam is at least about 5 kW at the fiber second end.

60. The system of claim 46 wherein the laser beam is at least about 15 kW at the fiber second end.

61. The system of claim 46 wherein the laser source is from at least about 5 kW to about 20 kW.

62. The system of claim 46 wherein the laser source is at least about 15 kW.

63. The system of claim 46 wherein the laser source is at least about 5 kW.

64. A system for creating a borehole in the earth comprising:

a. a high power laser source;
b. a bottom hole assembly;
c. an optical fiber;
  i. having a first and a second end;
  ii. having a length between the first and second ends;
  iii. the first end being optically associated with the laser source;
  iv. the fiber having a length of at least about 1000 ft;
d. a means for delivering a laser beam from the laser source to a surface of the borehole, wherein the laser beam has a Gaussian profile at the second end;
e. the laser delivery means connected to and optically associated with the second end of the optical fiber;
f. a means for providing a substantially uniform energy deposition; and,
g. the laser delivery means comprising the means for providing the substantially uniform energy deposition.

65. The system of claim 64 wherein the laser delivery means comprises an optical assembly.

66. The system of claim 64 wherein the laser delivery means is contained within the laser bottom hole assembly.

67. The system of claim 64 wherein the laser delivery means is contained within the bottom hole assembly and the bottom hole assembly comprises a rotating optical assembly.

68. The system of claim 67 wherein the bottom hole assembly comprises a mud motor.

69. The system of claim 64 wherein the laser source provides more than one laser beam.

70. The system of claim 64 wherein the laser source provides a plurality of laser beams to the fiber first end.

71. The system of claim 64 wherein the laser beam is at least about 10 kW at the fiber second end.

72. The system of claim 64 wherein the laser beam is at least about 3 kW at the fiber second end.

73. The system of claim 64 wherein the laser beam is at least about 5 kW at the fiber second end.

74. The system of claim 64 wherein the laser beam is at least about 15 kW at the fiber second end.

75. The system of claim 64 wherein the laser source is from at least about 5 kW to about 20 kW.

76. The system of claim 64 wherein the laser source is at least about 15 kW.

77. The system of claim 64 wherein the laser sources at least about 5 kW.

78. A system for creating a borehole in the earth comprising:

a. a high power laser source;
b. a bottom hole assembly;
c. an optical fiber;
  i. having a first and a second end;
  ii. having a length between the first and second ends;
  iii. the first end being optically associated with the laser source;
  iv. the fiber having a length of at least about 1000 ft;
d. a means for delivering a laser beam from the laser source to a surface of the borehole, wherein the laser beam has a Gaussian profile at the second end;
e. the laser delivery means connected to and optically associated with the second end of the optical fiber;
f. a means for providing a substantially uniform energy deposition; and,
g. the laser delivery means comprising the means for providing the substantially uniform energy deposition.

79. The system of claim 78 wherein the laser delivery means comprises an optical assembly.

80. The system of claim 78 wherein the laser delivery means is contained within the laser bottom hole assembly.

81. The system of claim 78 wherein the laser delivery means is contained within the bottom hole assembly and the bottom hole assembly comprises a rotating optical assembly.

82. The system of claim 81 wherein the bottom hole assembly comprises a mud motor.

83. The system of claim 78 wherein the laser source provides more than one laser beam.

84. The system of claim 78 wherein the laser source provides a plurality of laser beams to the fiber first end.

85. The system of claim 78 wherein the laser beam is at least about 10 kW at the fiber second end.

86. The system at claim 78 wherein the laser beam is at least about 3 kW at the fiber second end.

87. The system of claim 78 wherein the laser beam is at least about 5 kW at the fiber second end.

88. The system of claim 78 wherein the laser beam is at least about 15 kW at the fiber second end.

89. The system of claim 78 wherein the laser source is from at least about 5 kW to about 20 kW.

90. The system of claim 78 wherein the laser source is at least about 15 kW.

91. The system of claim 78 wherein the laser source is at least about 5 kW.

92. A system for creating a borehole in the earth comprising:

a. a high power laser source;
b. a bottom hole assembly;
c. an optical fiber;
  i. having a first and a second end;
  ii. having a length between the first and second ends;
  iii. the first end being optically associated with the laser source;
  iv. the fiber having a length of at least about 1000 ft;
d. a means for delivering a laser beam from the laser source to a surface of the borehole, wherein the laser beam has a super-Gaussian profile at the second end;
e. the laser delivery means connected to and optically associated with the second end of the optical fiber;
f. a means for providing a substantially uniform energy deposition; and,
g. the laser delivery means comprising the means for providing the substantially uniform energy deposition.

93. The system of claim 92 wherein the laser delivery means comprises an optical assembly.

94. The system of claim 92 wherein the laser delivery means is contained within the laser bottom hole assembly.

95. The system of claim 92 wherein the laser delivery means is contained within the bottom hole assembly and the bottom hole assembly comprises a rotating optical assembly.

96. The system of claim 95 wherein the bottom hole assembly composes a mud motor.

97. The system of claim 92 wherein the laser source provides more than one laser beam.

98. The system of claim 92 wherein the laser source provides a plurality of laser beams to the fiber first end.

99. The system of claim 92 wherein the laser beam is at least about 10 kW at the fiber second end.

100. The system of claim 92 wherein the laser beam is at least about 3 kW at the fiber second end.

101. The system of claim 92 wherein the laser beam is at least about 5 kW at the fiber second end.

102. The system of claim 92 wherein the laser beam is at least about 15 kW at the fiber second end.

103. The system of claim 92 wherein the laser source is from at least about 5 kW to about 20 kW.

104. The system of claim 92 wherein the laser source is at least about 15 kW.

105. The system of claim 92 wherein the laser source is at least about 5 kW.

106. A system for creating a borehole in the earth comprising:

a. a high power laser source;
b. a bottom hole assembly;
c. a fiber optically connecting the laser source with the bottom hole assembly, such that a laser beam from the laser source is transmitted to the bottom hole assembly;
d. means for providing the laser beam to a bottom surface of the borehole; and,
e. a beam power deposition optic having a property of changing an energy distribution profile within the laser beam;
f. the bottom hole assembly comprising:
  i. the means for providing the laser beam to the bottom surface of the borehole;
  ii. the providing means comprising the beam power deposition optics; and,
  iii. the means for providing the laser beam to the bottom surface configured to provide a predetermined energy deposition profile;
g. wherein, the laser beam as delivered from the bottom hole assembly illuminates the bottom surface of the borehole with a predetermined energy deposition profile, wherein the predetermined energy deposition profile comprises at least two concentric areas having different energy deposition profiles.

107. The system of claim 106, wherein the predetermined energy deposition profile is biased toward an outside area of the borehole bottom surface.

108. The system of claim 106, wherein the predetermined energy deposition profile is biased toward an inside area of the borehole bottom surface.

109. The system of claim 106, comprising a mechanical removal means.

110. The system of claim 106, wherein the laser beam at the bottom hole assembly has a power of at least about 10 kW.

111. The system of claim 106, wherein the laser beam at the bottom hole assembly has a power of at least about 15 kW.

112. A system for creating a borehole in the earth comprising:

a. a high power laser source;
b. a bottom hole assembly;
c. a fiber optically connecting the laser source with the bottom hole assembly, such that a laser beam from the laser source is transmitted to the bottom hole assembly;
d. a means for providing the laser beam to a bottom surface of the borehole; and,
e. a beam power deposition optic having a property of changing an energy distribution profile within the laser beam;
f. the bottom hole assembly comprising:
  i. the means for providing the laser beam to the bottom surface of the borehole;
  ii. the providing means comprising the beam power deposition optics; and;
  iii. the means for providing the laser beam to the bottom surface configured to provide a predetermined energy deposition profile;
g. wherein, the laser beam as delivered from the bottom hole assembly illuminates the bottom surface of the borehole with a predetermined energy deposition profile, wherein the predetermined energy deposition profile is provided by a series of laser shot patterns.

113. The system of claim 112, wherein the predetermined energy deposition profile is biased toward an outside area of the borehole bottom surface.

114. The system of claim 112, wherein the predetermined energy deposition profile is biased toward an inside area of the borehole bottom surface.

115. The system of claim 112, comprising a mechanical removal means.

116. The system of claim 112, wherein the laser beam at the bottom hole assembly has a power of at least about 10 kW.

117. The system of claim 112, wherein the laser beam at the bottom hole assembly has a power of at least about 15 kW.

118. A system for creating a borehole in the earth comprising:

a. a high power laser source;
b. a bottom hole assembly;
c. a fiber optically connecting the laser source with the bottom hole assembly, such that a laser beam from the laser source is transmitted to the bottom hole assembly;
d. a means for providing the laser beam to a bottom surface of the borehole; and,
e. a beam power deposition optic having a property of changing an energy distribution profile within the laser beam;
f. the bottom hole assembly comprising:
   i. the means for providing the laser beam to the bottom surface of the borehole;
   ii. the providing means comprising the beam power deposition optics; and,
   iii. the means for providing the laser beam to the bottom surface configured to provide a predetermined energy deposition profile;
g. wherein, the laser beam as delivered from the bottom hole assembly illuminates the bottom surface of the borehole with a predetermined energy deposition profile, wherein the predetermined energy deposition profile is provided by a scattered laser shot pattern.

119. The system of claim 118, wherein the predetermined energy deposition profile is biased toward an outside area of the borehole bottom surface.

120. The system of claim 118, wherein the predetermined energy deposition profile is biased toward an inside area of the borehole bottom surface.

121. The system of claim 118, comprising a mechanical removal means.

122. The system of claim 118, wherein the laser beam at the bottom hole assembly has a power of at least about 10 kW.

123. The system of claim 118, wherein the laser beam at the bottom hole assembly has a power of at least about 15 kW.

124. A system for creating a borehole in the earth comprising:

a. a high power laser source;
b. a bottom hole assembly;
c. a fiber optically connecting the laser source with the bottom hole assembly, such that a laser beam from the laser source is transmitted to the bottom hole assembly;
d. a means for providing the laser beam to a bottom surface of the borehole; and,
e. a beam power deposition optic having a property of changing an energy distribution profile within the laser beam;
f. a mechanical removal means;
g. the bottom hole assembly comprising:
   i. the means for providing the laser beam to the bottom surface of the borehole;
   ii. the providing means comprising the beam power deposition optic; and,
   iii. the means for providing the laser beam to the bottom surface configured to provide a predetermined energy deposition profile;
h. wherein, the laser beam as delivered from the bottom hole assembly illuminates the bottom surface of the borehole with a predetermined energy deposition profile, where in the predetermined energy deposition profile is based, at least in part, upon the mechanical stresses applied by the mechanical removal means.

125. The system of claim 124, wherein the predetermined energy deposition profile is biased toward an outside area of the borehole bottom surface.

126. The system of claim 124, wherein the predetermined energy deposition profile is biased toward an inside area of the borehole bottom surface.

127. The system of claim 124, wherein the laser beam at the bottom hole assembly has a power of at least about 10 kW.

128. The system of claim 124, wherein the laser beam at the bottom hole assembly has a power of at least about 15 kW.

129. A system for creating a borehole in the earth comprising:

a. a high power laser source;
b. a bottom hole assembly;
c. a fiber optically connecting the laser source with the bottom hole assembly, such that a laser beam from the laser source is transmitted to the bottom hole assembly;
d. a means for providing the laser beam to a bottom surface of the borehole; and,
e. a beam power deposition optic having a property of changing an energy distribution profile within the laser beam;
f. a mechanical removal means;
g. the bottom hole assembly comprising:
   i. the means for providing the laser beam to the bottom surface of the borehole;
   ii. the providing means comprising the beam power deposition optic; and,
   iii. the means for providing the laser beam to the bottom surface configured to provide a predetermined energy deposition profile;
h. wherein, the laser beam as delivered from the bottom hole assembly illuminates the bottom surface of the borehole with a predetermined energy deposition profile, wherein the predetermined energy deposition profile has at least two areas of differing energy and the energies in the areas correspond inversely to the mechanical forces applied by the mechanical means.

130. The system of claim 129, wherein the predetermined energy deposition profile is biased toward an outside area of the borehole bottom surface.

131. The system of claim 129, wherein the predetermined energy deposition profile is biased toward an inside area of the borehole bottom surface.

132. The system of claim 129, wherein the laser beam at the bottom hole assembly has a power of at least about 10 kW.

133. The system of claim 129, wherein the laser beam at the bottom hole assembly has a power of at least about 15 kW.

134. A method of advancing a borehole using a laser, the method comprising:

a. advancing a high power laser beam transmission means into a borehole;
   i. the borehole having a bottom surface, a side wall surface, a top opening, and a length extending between the bottom surface and the top opening of at least about 1000 feet;
   ii. the transmission means comprising a distal end, a proximal end, and a length extending between the distal and proximal ends, the distal end being advanced down the borehole;

iii. the transmission means comprising a means for transmitting high power laser energy;

b. providing a laser beam to the proximal end of the transmission means;

c. transmitting substantially all power of the laser beam down the length of the transmission means so that the beam exits the distal end having a first energy distribution profile;

d. transmitting the laser beam from the distal end to an optical assembly in a laser bottom hole assembly, wherein the laser beam is changed to a second energy distribution profile;

e. directing the laser beam, having a power of at least about 5 kW and having the second energy distribution profile, to a surface of the borehole; and, f. therein providing the laser beam to the surface of the borehole in a predetermined pattern; wherein the borehole surface defines a borehole surface area, the predetermined pattern defines a pattern area, and the laser beam defines a spot area; wherein the borehole surface area is equal to or greater than the pattern area, and the pattern area is greater than the laser spot area; wherein the predetermined pattern is configured to illuminate a majority of the borehole surface area with the laser beam and in a predetermined energy deposition profile to the borehole surface area;

g. whereby the length of the borehole is increased, in part, based upon the interaction of the laser beam with the surface of the borehole.

135. The method of claim 134, comprising mechanically removing laser illuminated material from the borehole surface using a mechanical force, and wherein the predetermined energy deposition profile is based, at least in part, upon the mechanical force applied during mechanical removal.

136. A method of advancing a borehole using a laser, the method comprising:

a. advancing a high power laser beam transmission fiber into a borehole;

i. the borehole having a bottom surface, a side wall surface, a top opening, and a length extending between the bottom surface and the top opening of at least about 1000 feet;

ii. the transmission means comprising a distal end, a proximal end, and a length extending between the distal and proximal ends, the distal end being advanced down the borehole;

b. providing a laser beam, having a power of at least about 10 kW, to the proximal end of the transmission fiber;

c. transmitting the power of the laser beam down the length of the transmission fiber so that the beam exits the distal end; and, d. creating a laser beam spot, having a power of at least about 5 kW, and directing the laser beam spot to the bottom surface of the borehole in a predetermined pattern; wherein the predetermined pattern defines an area illuminating essentially all of the bottom surface; and, wherein the predetermined pattern provides a substantially uniform energy deposition profile to the area;

e. whereby the length of the borehole is increased, in part, based upon the interaction of the laser beam with the bottom surface of the borehole.

137. The method of claim 136, comprising mechanically removing laser illuminated material from the borehole surface using a mechanical force, and wherein the substantially uniform energy deposition profile is based, at least in part, upon the mechanical force applied during mechanical removal.

138. A method of advancing a borehole using a laser, the method comprising:

a. advancing a high power laser beam transmission fiber into a borehole;

i. the borehole having a bottom, a side wall, a top opening, and a length extending between the bottom surface and the top opening of at least about 1000 feet;

ii. the transmission fiber comprising a distal end, a proximal end, and a length extending between the distal and proximal ends, the distal end being advanced down the borehole;

b. providing a laser beam, having a power of at least about 10 kW and having an energy distribution profile, to the proximal end of the transmission means;

c. transmitting the power of the laser beam down the length of the transmission fiber so that the beam exits the distal end and enters a laser bottom hole assembly;

d. changing the energy distribution profile of the laser beam; and, e. directing the laser beam, having a power of at least about 5 kW, toward the bottom of the borehole in a predetermined pattern defining a first area, and the laser beam as directed having a cross section defining an area smaller than the first area; and, wherein the predetermined pattern provides a predetermined energy deposition profile to the bottom of the borehole, wherein a majority of the bottom is illuminated by the predetermined pattern, and whereby the length of the borehole is increased, in part, based upon the interaction of the laser beam with the bottom of the borehole.

139. A laser bottom hole assembly for creating a borehole in the earth comprising:

a. a laser beam path;

b. a first chamber along the beam path;

c. a rotatable optical connector means located along the beam path;

d. a beam shaping optics located along the beam path;

e. a beam power deposition optics located along the beam path;

f. a second chamber along the beam path, the second chamber containing the beam shaping optics, the beam power optics and an incompressible transmissive fluid; and, g. a beam delivery opening in the laser bottom hole assembly along the beam path;

h. whereby, a laser beam is capable of traveling along the laser beam path and exiting the bottom hole assembly through the delivery opening so that it may illuminate a borehole surface.

140. A laser bottom hole assembly for creating a borehole in the earth comprising:

a. a laser beam path;

b. a first chamber along the beam path;

c. a rotatable optical connector means located along the beam path;

d. a beam shaping optics located along the beam path;

e. a second chamber along the beam path, the second chamber containing the beam shaping optics, the beam power optics and an incompressible transmissive fluid; and, f. a beam delivery opening in the laser bottom hole assembly along the beam path;

g. whereby, a laser beam traveling through the bottom hole assembly along the beam path travels through b), then c) then e) and then f).

141. A laser bottom hole assembly for creating a borehole in the earth comprising:

a. a laser beam path;

b. a first chamber along the beam path;

c. an optical connector means located along the beam path;
d. a collimating optics located along the beam path;
e. an axicon optics located along the beam path;
f. a second chamber along the beam path, the second chamber comprising d) and e), and a means to resist downhole pressures; and,
g. a beam delivery opening in the laser bottom hole assembly along the beam path;
h. whereby, a laser beam is capable of traveling along the laser beam path and exiting the bottom hole assembly through the delivery opening so that it may illuminate a borehole surface.

142. A system for creating a borehole in the earth comprising:
a. a high power laser source;
b. a bottom hole assembly;
c. an optical fiber;
i. having a first and a second end;
ii. having a length between the first and second ends;
iii. the first end being optically associated with the laser source;
iv. the fiber having a length of at least about 1000 ft;
d. a means for delivering a laser beam from the laser source to a surface of the borehole;
e. the laser delivery means connected to and optically associated with the second end of the optical fiber; and,
f. a means for providing a substantially uniform energy deposition, comprising a micro-optics array.

143. A system for creating a borehole in the earth comprising:
a. a high power laser source;
b. a bottom hole assembly;
c. an optical fiber;
i. having a first and a second end;
ii. having a length between the first and second ends;
iii. the first end being optically associated with the laser source;
iv. the fiber having a length of at least about 1000 ft;
d. the laser beam having a Gaussian profile at the fiber second end;
e. a means for delivering a laser beam from the laser source to a surface of the borehole;
f. the laser delivery means connected to and optically associated with the second end of the optical fiber; and,
g. a means for providing a substantially uniform energy deposition, comprising a micro-optics array.

144. A system for creating a borehole in the earth comprising:
a. a high power laser source;
b. a bottom hole assembly;
c. an optical fiber;
i. having a first and a second end;
ii. having a length between the first and second ends;
iii. the first end being optically associated with the laser source;
iv. the fiber having a length of at least about 1000 ft;
d. the laser beam having a substantially Gaussian profile at the fiber second end;
e. a means for delivering a laser beam from the laser source to a surface of the borehole;
f. the laser delivery means connected to and optically associated with the second end of the optical fiber; and,
g. a means for providing a substantially uniform energy deposition.

145. A system for creating a borehole in the earth comprising:
a. a high power laser source;
b. a bottom hole assembly;
c. an optical fiber;
i. having a first and a second end;
ii. having a length between the first and second ends;
iii. the first end being optically associated with the laser source;
iv. the fiber having a length of at least about 1000 ft;
d. the laser beam having a super-Gaussian profile at the fiber second end;
e. a means for delivering a laser beam from the laser source to a surface of the borehole;
f. the laser delivery means connected to and optically associated with the second end of the optical fiber; and,
g. a means for providing a substantially uniform energy deposition.

146. A system for creating a borehole in the earth comprising:
a. a high power laser source;
b. a bottom hole assembly; and,
c. a fiber optically connecting the laser source with the bottom hole assembly, such that a laser beam from the laser source is transmitted to the bottom hole assembly;
d. the bottom hole assembly comprising:
i. a means for providing the laser beam to a bottom surface of the borehole;
ii. the providing means comprising the beam power deposition optics; and,
iii. the means for providing the laser beam to the bottom surface configured to provide a predetermined energy deposition profile;
d. wherein, the laser beam as delivered from the bottom hole assembly illuminates the bottom surface of the borehole with a predetermined energy deposition profile, comprising at least two concentric area having different energy deposition profiles.

147. A system for creating a borehole in the earth comprising:
a. a high power laser source;
b. a bottom hole assembly; and,
c. a fiber optically connecting the laser source with the bottom hole assembly, such that a laser beam from the laser source is transmitted to the bottom hole assembly;
d. the bottom hole assembly comprising:
i. a means for providing the laser beam to a bottom surface of the borehole;
ii. the providing means comprising the beam power deposition optics; and,
iii. the means for providing the laser beam to the bottom surface configured to provide a predetermined energy deposition profile;
e. wherein, the laser beam as delivered from the bottom hole assembly illuminates the bottom surface of the borehole with a predetermined energy deposition profile, and wherein the predetermined energy deposition profile is provided by a series of laser shot patterns.

148. A system for creating a borehole in the earth comprising:
a. a high power laser source;
b. a bottom hole assembly; and,
c. a fiber optically connecting the laser source with the bottom hole assembly, such that a laser beam from the laser source is transmitted to the bottom hole assembly;
d. the bottom hole assembly comprising:
i. a means for providing the laser beam to a bottom surface of the borehole;
ii. the providing means comprising the beam power deposition optics; and, iii. the means for providing the laser beam to the bottom surface configured to provide a predetermined energy deposition profile;

e. wherein, the laser beam as delivered from the bottom hole assembly illuminates the bottom surface of the borehole with a predetermined energy deposition profile, and wherein the predetermined energy deposition profile is provided by a scattered laser shot patterns.

149. A system for creating a borehole in the earth comprising:

a. a high power laser source;

b. a bottom hole assembly;

c. a mechanical removal means; and, d. a fiber optically connecting the laser source with the bottom hole assembly, such that a laser beam from the laser source is transmitted to the bottom hole assembly;

e. the bottom hole assembly comprising:

i. a means for providing the laser beam to a bottom surface of the borehole;

ii. the providing means comprising the beam power deposition optics; and, iii. the means for providing the laser beam to the bottom surface configured to provide a predetermined energy deposition profile;

f. wherein, the laser beam as delivered from the bottom hole assembly illuminates the bottom surface of the borehole with a predetermined energy deposition profile, and wherein the predetermined energy deposition profile is based, at least in part upon, the mechanical stresses applied by the mechanical removal means.

150. A system for creating a borehole in the earth comprising:

a. a high power laser source;

b. a bottom hole assembly;

c. a mechanical removal means; and, d. a fiber optically connecting the laser source with the bottom hole assembly, such that a laser beam from the laser source is transmitted to the bottom hole assembly;

e. the bottom hole assembly comprising:

i. a means for providing the laser beam to a bottom surface of the borehole;

ii. the providing means comprising the beam power deposition optics; and, iii. the means for providing the laser beam to the bottom surface configured to provide a predetermined energy deposition profile;

f. wherein, the laser beam as delivered from the bottom hole assembly illuminates the bottom surface of the borehole with a predetermined energy deposition profile, and wherein the predetermined energy deposition profile has at least two areas of differing energy and the energies in the areas correspond inversely to the mechanical forces applied by the mechanical means.

151. A system for creating a borehole in the earth comprising:

a. a high power laser source;

b. a bottom hole assembly;

c. a fiber optically connecting the laser source with the bottom hole assembly, such that a laser beam from the laser source is transmitted to the bottom hole assembly, wherein the laser beam has a Gaussian profile at the fiber bottom hole assembly connection;

d. a means for providing the laser beam to a bottom surface of the borehole;

e. a beam power deposition optic having a property of changing an energy distribution profile within the laser beam;

f. a mechanical removal means; and, g. the bottom hole assembly comprising:

i. the means for providing the laser beam to the bottom surface of the borehole; and, ii. the providing means comprising the beam power deposition optics;

h. wherein, the laser beam as delivered from the bottom hole assembly illuminates the bottom surface of the borehole with a substantially even energy deposition profile on the bottom surface, and wherein the substantially even energy deposition profile is based, at least in part, upon mechanical forces applied by the mechanical removal means.

152. A system for creating a borehole in the earth comprising:

a. a high power laser source;

b. a bottom hole assembly;

c. an optical fiber;

i. having a first and a second end;

ii. having a length between the first and second ends;

iii. the first end being optically associated with the laser source;

iv. the fiber having a length of at least about 1000 ft;

d. a means for delivering a laser beam from the laser source to a surface of the borehole;

e. the laser delivery means connected to and optically associated with the second end of the optical fiber;

f. a means for providing a substantially uniform energy deposition;

g. a mechanical removal means; and, h. the laser delivery means comprising the means for providing the substantially uniform energy deposition, and wherein the substantially uniform energy deposition profile is based, at least in part, upon the mechanical forces applied by the mechanical removal means.

153. A system for creating a borehole in the earth comprising:

a. a high power laser source;

b. a bottom hole assembly; and, c. a fiber optically connecting the laser source with the bottom hole assembly, such that a laser beam from the laser source is transmitted to the bottom hole assembly;

f. a mechanical removal means; and, e. the bottom hole assembly comprising:

i. a means for providing a laser beam to a bottom surface of the borehole in a predetermined pattern, wherein the predetermined pattern is configured to illuminate a majority of the borehole bottom surface and in a predetermined energy deposition profile, and wherein the predetermined energy deposition profile is based, at least in part, upon the mechanical forces applied by the mechanical removal means.

154. The system of claim 153, wherein the laser beam at the bottom hole assembly has a power of at least about 10 kW.

155. The system of claim 153, wherein the laser beam at the bottom hole assembly has a power of at least about 15 kW.

156. A system for creating a borehole in the earth comprising:

a. a high power laser source;

b. a bottom hole assembly; and, c. a fiber optically connecting the laser source with the bottom hole assembly, such that a laser beam from the laser source is transmitted to the bottom hole assembly, the laser beam at the bottom hole assembly having a power of at least about 5 kW;

d. a mechanical removal means;

e. the bottom hole assembly comprising:

i. a means for providing a substantially elliptical shaped laser beam spot having a power of at least about 5 kW to the bottom surface of the borehole in a rotating manner to thereby provide a predetermined energy deposition profile to the bottom surface of the borehole, and wherein the predetermined energy deposition profile is based, at least in part, upon the mechanical forces applied by the mechanical removal means.

157. A method of advancing a borehole using a laser, the method comprising:

a. advancing a transmission means into a borehole;

i. the borehole having a bottom surface, a side wall surface, a top opening, and a length extending between the bottom surface and the top opening of at least about 1000 feet;

ii. the transmission means comprising a distal end, a proximal end, and a length extending between the distal and proximal ends, the distal end being advanced down the borehole;

iii. the transmission means comprising a means for transmitting high power laser energy;

b. providing a high power laser beam to the proximal end of the transmission means;

c. transmitting substantially all power of the laser beam down the length of the transmission means so that the beam exits the distal end;

d. transmitting the laser beam from the distal end to an optical assembly in a laser bottom hole assembly;

e. the laser bottom hole assembly directing the laser beam to a surface of the borehole;

f. providing a predetermined energy deposition profile to the surface of the borehole; and, g. mechanically removing laser illuminated material from the surface of the borehole using a mechanical force;

h. wherein the predetermined energy deposition profile is based, at least in part, upon the mechanical force.

* * * * *

UNITED STATES PATENT AND TRADEMARK OFFICE

CERTIFICATE OF CORRECTION

PATENT NO. : 8,424,617 B2
APPLICATION NO. : 12/544094
DATED : April 23, 2013
INVENTOR(S) : Brian O. Faircloth et al.

It is certified that error appears in the above-identified patent and that said Letters Patent is hereby corrected as shown below:

In the Claims

In column 28, claim 9, line 62, after "wherein the laser" replace "beam" with --source--.

In column 29, claim 19, line 59, after "deposition" replace "optics;" with --optic;--.

In column 32, claim 77, line 40, after "wherein the laser" replace "sources" with --source is--.

In column 32, claim 78, line 54, before "Gaussian profile" insert --substantially--.

In column 33, claim 86, line 9, after "The system" replace "at" with --of--.

In column 33, claim 96, line 49, before "a mud motor." replace "composes" with --comprises--.

In column 34, claim 106, about line 18, after "deposition" replace "optics;" with --optic;--.

In column 34, claim 112, line 56, after "deposition" replace "optics; and;" with --optic; and,--.

In column 35, claim 118, line 26, after "deposition" replace "optics;" with --optic;--.

In column 37, claim 136, line 43, after "the transmission" replace "means" with --fiber--.

In column 40, claim 146, line 34, after "two concentric" replace "area" with --areas--.

Signed and Sealed this
Ninth Day of July, 2013

Teresa Stanek Rea

Teresa Stanek Rea
*Acting Director of the United States Patent and Trademark Office*

UNITED STATES PATENT AND TRADEMARK OFFICE

CERTIFICATE OF CORRECTION

PATENT NO. : 8,424,617 B2
APPLICATION NO. : 12/544094
DATED : April 23, 2013
INVENTOR(S) : Faircloth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 196 days.

Signed and Sealed this
Thirtieth Day of December, 2014

Michelle K. Lee

Michelle K. Lee
*Deputy Director of the United States Patent and Trademark Office*